US008485512B2

(12) United States Patent
Lewalski et al.

(10) Patent No.: US 8,485,512 B2
(45) **Date of Patent: *Jul. 16, 2013**

(54) SYSTEM AND METHOD FOR INLINE CUTTING AND STACKING OF SHEETS FOR FORMATION OF BOOKS

(75) Inventors: Steven P. Lewalski, Melrose, MA (US); Hans Eliasson, Ljungby (SE)

(73) Assignee: Lasermax Roll Systems, Inc., Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/434,287

(22) Filed: Mar. 29, 2012

(65) Prior Publication Data

US 2012/0193860 A1 Aug. 2, 2012

Related U.S. Application Data

(63) Continuation of application No. 12/868,289, filed on Aug. 25, 2010, now Pat. No. 8,167,293.

(60) Provisional application No. 61/236,792, filed on Aug. 25, 2009.

(51) Int. Cl.
*B65H 37/04* (2006.01)

(52) U.S. Cl.
USPC ..... 270/52.17; 270/58.07; 83/452; 83/733; 83/256; 83/934

(58) Field of Classification Search
USPC ..... 271/185; 270/58.07, 52.17; 83/452, 83/733, 256, 934
See application file for complete search history.

(56) References Cited

U.S. PATENT DOCUMENTS

| | | | | |
|---|---|---|---|---|
| 4,207,667 | A | 6/1980 | D'Angelo et al. | |
| 4,955,965 | A * | 9/1990 | Mandel | 271/225 |
| 5,130,724 | A | 7/1992 | Crowley | |
| 5,172,907 | A * | 12/1992 | Kalisiak | 271/227 |

(Continued)

FOREIGN PATENT DOCUMENTS

| | | | |
|---|---|---|---|
| DE | 2916828 | A1 | 11/1980 |
| DE | 9218874 | U1 | 2/1996 |

(Continued)

*Primary Examiner* — Patrick Mackey
(74) *Attorney, Agent, or Firm* — Loginov & Associates, PLLC; William A. Loginov

(57) ABSTRACT

This invention provides a system and method for aligning, feeding, trimming, slitting, rotating, cross-slitting and stacking sheets, each containing one or more discrete page images thereon that allows for greater automation of the overall process so that reduced or no manual intervention is required to generate completed book stacks or "blocks" from a stream or stack of printed sheets. Sheets are fed to a first, upstream trimming station to remove margin edges and optionally separate the sheets relative to the discrete page images. The sheets are then rotated 90 degrees and fed to a second, downstream trimming station that trims the right-angle edges and optionally separates the sheets into a final group of full-bleed pages, removing margins and gutter strips. The sheets are feed to a stacking assembly to be tacked in page order and any rejected, defective sheets or stacks are removed from the order.

20 Claims, 41 Drawing Sheets

U.S. PATENT DOCUMENTS

| | | | | |
|---|---|---|---|---|
| 5,692,746 | A | 12/1997 | Herrick, Jr. | |
| 5,695,185 | A * | 12/1997 | Bell | 271/185 |
| 5,751,298 | A | 5/1998 | Crowley | |
| 5,818,470 | A | 10/1998 | Crowley | |
| 5,882,006 | A * | 3/1999 | Bell | 271/186 |
| 6,012,366 | A | 1/2000 | Shimizu | |
| 6,260,456 | B1 | 7/2001 | Schaede | |
| 7,402,130 | B1 | 7/2008 | Sjostedt et al. | |
| 8,061,709 | B2 * | 11/2011 | Lewalski et al. | 271/225 |
| 8,167,293 | B2 * | 5/2012 | Lewalski et al. | 270/52.17 |
| 2008/0048386 | A1 | 2/2008 | Smith | |
| 2010/0090395 | A1 | 4/2010 | Lewalski et al. | |

FOREIGN PATENT DOCUMENTS

| | | | |
|---|---|---|---|
| DE | 19830489 | A1 | 2/1999 |
| EP | 0587531 | A2 | 3/1994 |
| EP | 0869092 | A1 | 10/1998 |
| EP | 1457296 | A1 | 9/2004 |
| EP | 1624346 | A1 | 2/2006 |
| EP | 1927563 | A1 | 6/2008 |
| WO | 0142216 | A2 | 6/2001 |

* cited by examiner

SYSTEM AND METHOD FOR INLINE CUTTING AND STACKING OF SHEETS FOR FORMATION OF BOOKS

RELATED APPLICATION

This application is a continuation of co-pending U.S. patent application Ser. No. 12/868,289 entitles SYSTEM AND METHOD FOR INLINE CUTTING AND STACKING OF SHEETS FOR FORMATION OF BOOKS, filed Aug. 25, 2010, the entire disclosure of which is incorporated herein by reference, which claims the benefit of U.S. Provisional Application Ser. No. 61/236,792, filed Aug. 25, 2009, entitled SYSTEM AND METHOD FOR INLINE CUTTING AND STACKING OF SHEETS FOR FORMATION OF BOOKS, the entire disclosure of which is herein incorporated by reference.

FIELD OF THE INVENTION

This invention relates to systems for creating stacked book pages from an electronic or other print engine for subsequent binding into finished books.

BACKGROUND OF THE INVENTION

The creation of finished, bound books using "print on-demand" processes and electronic print engines is becoming ever more popular for publishers of all sizes. Unlike traditional printing processes, which employ fixed plate presses to transfer images to the web or sheet, electronic printing allows for the creation of smaller print runs that can be customized, on a book by book basis. To maximize efficiency, pages for finished books are often printed on a larger overall web or sheet, which is subsequently cut and slit into the desired page dimensions. These cut pages are thereafter fed to a collection point and stacked into finished "book blocks." The book blocks are trimmed into squared-off stacks using a three-knife trimmer, and directed to a binding process, wherein an outer cover is bound to the book page stack.

The creation of book blocks often involves a number of manual steps. For example, printers often generate a plurality of page images on a larger sheet (sized 11×17 inch, for example). These images must be separated into separate pages of appropriate size. The manipulating of sheets from the printer can entail forming secondary stacks and thereafter physically moving and directing the stacks through cutters and slitters to generate the final set of pages in the appropriate page order. This book block stack is then directed to the trimming and binding process by another set of manual tasks. Any defective pages or stacks are removed and dealt with by hand, typically requiring the reassembly of the defective stack with new replacement pages as appropriate.

Currently available electronic printers, such as the Indigo™ 5500 Digital Press, available from the Hewlett-Packard Company of Palo Alto, Calif., offer a wide range of print versatility at high levels of print quality. Such printers allow for the duplex (two-sided) printing of full color photo-quality images on a variety of paper types (matte, glossy, etc.), fed from sheets. These printers, and other of similar type, offer a high throughput speed (for example, currently up to approximately 70 pages per minute (ppm) for color print and up to approximately 270 ppm for monochrome print). Completed sheets, typically containing multiple, two-sided page images in appropriate sizes are stacked on an output stack that is subsequently divided into appropriate pages for binding in a finished book. A printing computer and associated software application(s), which interconnected with the print engine controller, organizes the order and location of images on each side of each sheet.

To fully take advantage of the speed and versatility of such electronic printers, the automation of the handling of output sheets is highly desirable. In general, it is desirable that the output sheets be automatically cut and slit to appropriate sizes and that this sizing process allow for the creation of accurate, full-bleed (e.g. marginless) pages that are ready to stack into completed books. It is further desirable that the automated cutting and slitting process occur at a speed that can accommodate the output speed of the printer, enables the identification and handling of defective pages and stacks and can be variably set to handle a wide range of page sizes, shapes and numbers on a given output sheet.

SUMMARY OF THE INVENTION

This invention overcomes the disadvantages of the prior art by providing a system and method for aligning, feeding, trimming, slitting, rotating, cross-slitting and stacking sheets, each containing one or more discrete page images thereon that allows for greater automation of the overall process so that reduced or no manual intervention is required to generate completed book stacks or "blocks" from a stream or stack of printed sheets. Sheets are fed downstream on a feed surface, trimmed at a first, upstream trimming station to remove margin edges and optionally separate the sheets relative to the discrete page images. The sheets are then rotated 90 degrees and fed to a second, downstream trimming station that trims the right-angle edges and optionally separates the sheets into a final group of full-bleed pages, removing margins and gutter strips. The sheets are feed to a stacking assembly to be tacked in page order and any rejected, defective sheets or stacks are removed from the order.

In an illustrative embodiment, the feed surface of the system that defines a feed path, receives the sheets from a de-stacker or alignment station and feeds the sheets downstream in a registered manner to a first, upstream trimming station. The trimming station can include one or more slitter elements, supported on an overlying support that allows for widthwise adjustability of the elements, as well as attachability and detachability of elements with respect to the support, so as to define the desired slitting arrangement. The widthwise adjustment of elements can be automated using actuators, lead screws and the like. Likewise, slitter elements can be adapted to be selectively engageble so that certain slitter elements can be disengaged when not in use. The elements can employ slitters in the form of overlapping shear wheels or cutting wheels that bear upon an opposing hardened anvil roller embedded in the feed surface. The first, upstream trimming station operates to trim at least one margin edge, and can trim both opposing margin edges, producing waste strips that can be vacuumed away or directed into a waste bin (or other disposal location). In addition, one or more central slitter elements can separate each sheets along the downstream direction. A gutter waste strip can be defined between separated sheets and that strip is also disposed of as described above. The gutter strip can be removed by closely confronting slitter elements or by a dual-slitter-wheel unit that can provide for manual or automatic (via a lead screw, for example) adjustment of spacing therebetween. After upstream trimming, the sheet(s) then move under operation of a set of actuatable drives (nip rollers, in an illustrative embodiment) in a timed manner into a rotator section, which selectively engages the sheet(s) and rotates the sheet(s) into an illustrative 90-degree/right-angle with respect to the original orientation. This places the rotated, right-angle edges parallel to the downstream direction.

The sheet(s) are then driven by selectively actuable drive elements into a second, downstream trimming station that trims one or more margins along the rotated (right-angle adjacent) edges of the sheet(s) and can also include one or more central slitter elements that are manually or automated engaged and/or widthwise-adjusted. This downstream trimming station removes the remainder of margin edges and central gutter strips (if any) from sheet(s), thereby producing discrete pages ready for stacking into a book block. The page sheets are fed at an appropriate timing into selectively actuable right-angle nip rollers (or other drives) in a right-angle (or other direction) merge assembly, against a guide wall, which acts as a sheet stop. One or more feed surface decks with associated right-angle nip rollers and guide wall can be provided, wherein page-cut sheets are directed to each deck via a divert gate that receives sheets from the output of the second, downstream trimming station. Sheets can be distributed among the decks to improve throughput speed, or to provide different output options. For example, the divert gate can select between a pass-through raceway, a stacker feed path and a waste feed path. When the stacking option is selected, the page sheets are then each driven along the feed surface of a predetermined path downstream direction to a stacker. Sheets are stacked in page order on an elevator-equipped conveyor surface that descends as the stack grows and ascends to off-load and/or receive a new stack. The elevator conveyor of the stacker can optionally deliver stacks to either a reject stack location (if defects exist) or to a completed stack conveyor or other location that allows the stack to move on to a post-production process, such as binding.

In an illustrative embodiment, the sheets can be provided with barcodes or other indicia within margins and/or gutters that identify sheets and/or individual pages therein by the upstream sheet printer, or another printing device. Appropriate ID readers can be located along the feed path to read and track the sheets and associated pages (for page ordering, book beginning and end, etc.) based upon the read IDs, and where appropriate determine whether defects exist. In another illustrative embodiment, a pair of stackers can be arranged to receive page sheets from the right-angle merge assembly, whereby one stacker receives sheets while another off-loads and/or resets to receive a new stack thereon. In this manner, throughput is increased by continuous stack formation from received page sheets. In another illustrative embodiment, the upstream side of the feed path can include a buffering mechanism that allows sheets to be continuously delivered from the source (printer, de-stacker, etc.), while the system resets parameters for a new job (i.e. a job with differing page numbers, sheet size, page size, etc., requiring a different number and/or spacing of slitter elements, stacker backstops, etc.). The buffer mechanism illustratively consists of two conveyors, including an upstream conveyor that receives sheets from the source and moves slowly or becomes stationary for a predetermined period, thereby allowing sheets to be shingled, delaying their downstream movement onto a second, downstream conveyor that operates at the normal throughput rate of the system. The upstream conveyor speeds up to a normal rate when the delay period has ended and the system can return to normal operation.

In another illustrative embodiment, a completed stack conveyer is located with an output over a stack carrier conveyor that locates each of a stream of carriers adjacent to the output. The tow conveyors are positioned at orthogonal orientations with respect to each other. Each completed stack at the output is driven onto a carrier in the appropriate orientation. The stack is centered on the carrier by movable belts that pass selectively through slats in the carrier. When loaded, each carrier is transported further downstream by the carrier conveyor to a post-processing location. The completed stack conveyor can illustratively include a stack rotator that orients the book stack/block into a desired orientation before being deposited on the carrier. In this manner, the stack is properly oriented for binding and other post-processing operations.

In a further illustrative embodiment, the system and method can provide sheets from a source to an alignment assembly. The sheets are driven through a first trimming station that trims edges and can also provide separation of the sheet into one or more widthwise, side-by-side sheets. The trimmed sheet or sheets is/are driven from the first trimming station into a right-angle (or another direction) divert assembly that includes orthogonal, selectively engaged, sets of nips that direct the sheet(s) initially into the divert assembly, and thereafter into a second trim assembly. The second trim assembly trims orthogonal edges of the sheet(s) to produce a finished page sheet that is directed to a downstream right-angle (or another direction) merge assembly. The second trimming station can also include one (or more) centralized slitter element that divides the sheet into side-bay side page sheets. In an embodiment, the arrangement can be adjusted between a one-up, two-up and four-up configuration, but other sheet numbers and sizes can be produced in alternate embodiments. The merge assembly includes electively engaged, orthogonal nips that initially receive the page sheet(s), and then drive the page sheet(s) in an orthogonal direction into a stacking location in the appropriate page order. Various sensors can be employed to track sheets and to remove defective sheets or pages. For example, the right-angle divert assembly in this embodiment (and other embodiments herein) can operate in an edgeless mode, so that certain sheets can be directed in a non-orthogonal direction to an alternate location for disposal or alternate handling. The edgeless arrangement allows the nips in the divert assembly to alter the drive distance of sheets entering from the first trimming station, thereby allowing the production of offset sheets, sections and stacks.

In an illustrative embodiment, a system for feeding, aligning, slitting, rotating and stacking sheets is provided. The system includes an alignment unit that employs and an acutely (with respect to the downstream direction) angled belt having a plurality of overlying, freely-rotating and free-floating (within a predetermined range of vertical distance) balls that form a lightweight nip with respect to the belt. Sheets from a source, typically including up to eight (or more) separate printed pages are directed at a predetermined time through the alignment unit, where they are biased by the belt against an edge guide that is parallel to the downstream direction, thereby aligning each of the sheets. The sheets are received by a feed section of a slitter and rotator unit. The slitter and rotator unit includes a first slitter station cartridge with a plurality of adjustable, rotating shear wheels located to initially trim each of the sheets to a predetermined size and number of slit sheet sections. These sections correspond to one or more pages arranged along the downstream direction. The feed section contains a plurality of drive roller pairs that remain in contact with each slit sheet section so as to avoid skew. Sheets are received from the first slitter station in a rotator section having a plurality of pairs of drive rollers in each of two orthogonal directions. The slid sheets are initially received by side-by-side by drive roller nips in the input direction from the feed section. A set of cams operate on a spring-loaded frame to selectively release the idler rollers for these nips and a second set of cams engage idler nips on a spring loaded frame associated with the drive rollers in the orthogonal direction. The nips are timed so that the sheet sections remain in constant contact with at least one roller pair at all times to avoid skew. The rollers are arranged so that a pair is available for each page to be formed from each slit sheet as the slit sheets are moved in the orthogonal direction trough a second slitter station cartridge that contains a plurality of adjustable, powered shear wheels. The resulting second-slit sheet sections are received by a plurality of drive roller pairs that are engaged by cam-actuated idlers. The sheets, in final page form are then directed to a feed location where another set of orthogonal rollers are engaged by cam activated idlers while the other idlers are disengaged by the cams. The completed, page-size sheets are then directed orthogonally into a stacking unit that contains a divert gate. The divert gate selects between three destinations. The first destination is an upper feed path that allows sheets to pass in a stream bypassing the stacking mechanism, to a downstream location or component. The second destination directs sheets to a waste location if they are determined by the printer or other controller to be defective or unneeded. The third destination is the stacking mechanism. The stacking mechanism includes a drive that decelerates sheets into contact with an adjustable backstop assembly. The sheets are deposited on an elevator having moving belts that allow stacks to be transported downstream to a stack output location when complete. The elevator moves downwardly to provide clearance as the stack grows. A set of movable temporary support fingers are deployed to support a new stack when the old stack is completed and the elevator descends vertically to a position to offload the completed stack. The fingers descend vertically a small distance to allow for stack growth while the elevator completes its stack-offload cycle. When the elevator is clear, it ascends to take over support of the new stack, and the fingers are refracted.

BRIEF DESCRIPTION OF THE DRAWINGS

The invention description below refers to the accompanying drawings, of which.

DETAILED DESCRIPTION

I. Sheet Rotator Principles of Operation

Figure 1:
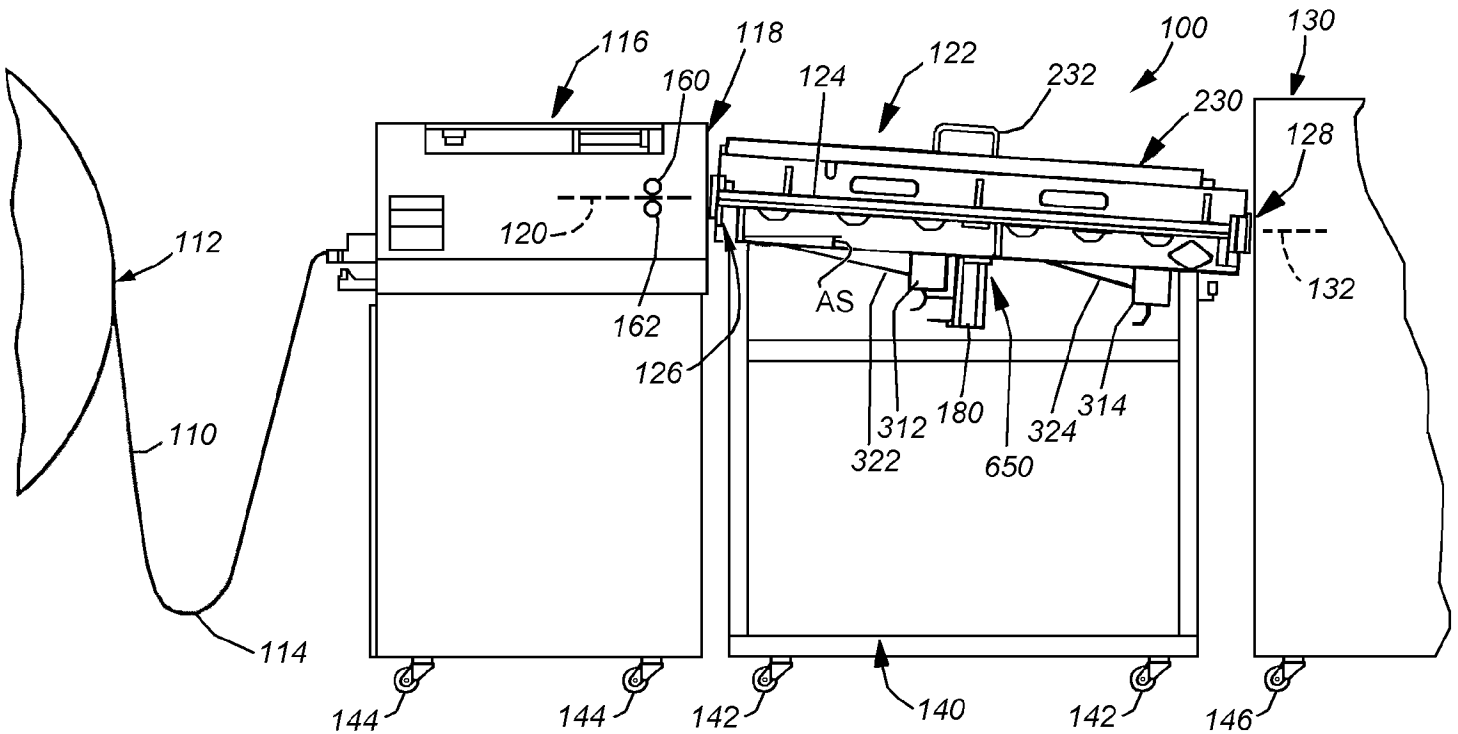
FIG. 1 is a side view of a sheet cutting, feeding, rotating and utilization system, including a sheet rotator according to an illustrative example.

FIGS. 1-6 detail an overall view of an arrangement of a sheet-feeding and rotating system 100 according to commonly assigned, co-pending U.S. patent application Ser. No. 12/249,857, entitled SYSTEM AND METHOD FOR ROTATING SHEETS, by Lewalski, et al., the teachings of which are incorporated by reference by way of useful background information. This arrangement is shown to illustrate the concepts provided herein, and the rotator component of the illustrative invention includes additional operative components as will be described in detail below. The arrangement 100 in this example includes a source of continuous web 110 that can comprise a continuous driven roll 112 of conventional design. The roll is driven by a portable roll stand having, for example a peripheral drive member (no shown). The driven roll can include a sensing loop 114 that responds to draw of the web by a downstream cutter 116. The cutter 116 can also be of conventional design, such as a commercially available "guillotine" cutter which uses a reciprocating, sliding blade to separate the continuous web adjacent to the downstream end 118 of the cutter. An exemplary cutter is the Model 310 available from Bowe Systec AG of Germany. The cutter 118 includes a feed plane (dashed line 120) that is aligned with a corresponding surface of the feed table 124 of the sheet rotator 122 according to an illustrative embodiment of this invention. The sheet rotator 122, and its structure and operation, will be described in full detail below. In general, it receives cut sheets from the cutter 116 and selectively rotates sheets at least 90 degrees (orthogonal to the original feed orientation). This rotation facilitates re-alignment of grain direction or other desirable goals. For example, the rotator allows a wide or narrow dimension of an input sheet to be switched before a sheet is passed from the rotator 122 into the sheet utilization device 130.

The utilization device 130 can be any device that allows for the feeding of cut sheets of predetermined dimensions. In this embodiment it includes a dedicated slot and feed surface 132 that is aligned for receiving sheets from the rotator 122 (or any other feeding device). As will be described below, the rotator of the present invention typically receives printed, cut sheets from a printer, or other inline device (embosser, spot printer, etc.), and thus, the cutter 116 and roll 112 would be substituted with an sheet outfeed from the upstream device.

With further reference to FIGS. 2-6, the rotator 122 of the illustrative embodiment of the rotator 122 is defined by the above-described feed surface 124, which, in this embodiment, includes an upstream or infeed end 126 and a downstream or outfeed end 128. The feed surface 124 is optionally tilted at a slightly downward angle AS based upon a portable stand 140. The stand 140 includes casters or other mobility devices 142 that allow the rotator 122 to be portable, and thereby employed in a flexible printing environment. Other devices in the printing arrangement 100 may, likewise be portable. For example, the cutter 116 includes appropriate casters 144, as well as the utilization device 146 and the web source 112 (not shown). Casters or other portability elements can include appropriate locking mechanisms and/or retractable feet (not shown) in accordance with conventional designs. Likewise, the various joined-together components of the overall printing arrangement 100 can include appropriate alignment and locking devices that allow the components to be removably secured to each other. This prevents undesired separation of the devices as a result of vibrations and other forces during operation.

The rotator stand 140 is depicted as an open framework. In alternate embodiments, it can be fully or partially enclosed, and used to house various power, control and drive components as appropriate. The tilt angle AS of the feed surface 124 can be adjustable in various embodiments by use of automated or manual screw drives, linear actuators or other movement devices. The tilt angle AS allows sheets to pass from the cutter feed plane or surface 120 which is at a higher elevation with respect to a floor surface than the utilization device sheet feed-port surface 132, which is at a lower level. As shown, the underside of the rotator 122 includes the drive mechanism 310 according to the illustrative embodiment. The rotator's sheet transport drive mechanism 310 includes a pair of independently powered drive motors 312 and 314 that are linked by appropriate drive belts 322 and 324, respectively. The motors 312 and 314 can be servo motors, stepper motors or another motor that is controllable. The belt 322 drives an upstream set of drive roller pairs 330, 332 and 334. The downstream belt 324 drives a downstream set of drive roller pairs 336, 338 and 340. The belts can include a timing belt surface and the drive/driven pulleys can include interengaging teeth. Idlers 342, 344, 346 and 348 maintain a predetermined tension on the belt so that it securely engages the drive pulley of each drive roller pair without slippage.

The drive roller pairs 330, 332, 334, 336, 338 and 340 are mounted on bearings beneath the feed table surface 124 and extend through associated slots 610 in the feed surface. The rollers of each of the pairs can be include an outer surface constructed from a durable elastomeric compound (such as polyurethane or ethylene propylene diene M-class (EPDM) rubber) to provide gripping friction when engaging sheets. The rollers can be positioned slightly above or approximately level with, the plane of the feed table surface 124 to ensure proper engagement. As described further below, an additional downstream-most clutch-driven outfeed roller assembly 350 is provided at the downstream, outfeed end 128 of the rotator 122. In the illustrative embodiment, the lower, driven rollers include an EPDM surface, while the upper, freewheeling rollers are constructed from smooth-surfaced aluminum alloy. The surfaces of the upper and lower rollers are highly variable in alternate embodiments.

Figure 2:
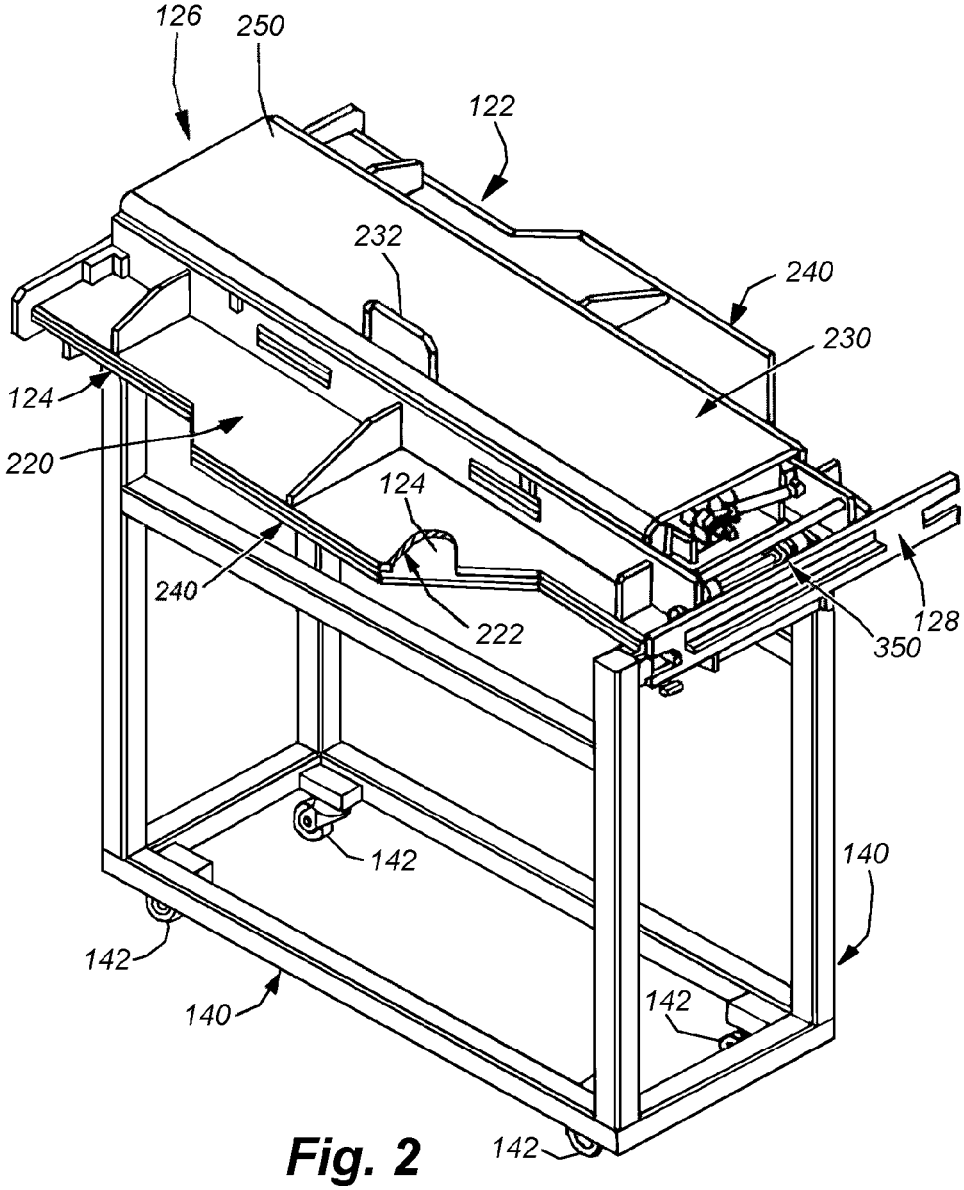
FIG. 2 is a more detailed perspective view of the exemplary sheet rotator of FIG. 1 with top covers closed.
Figure 3:
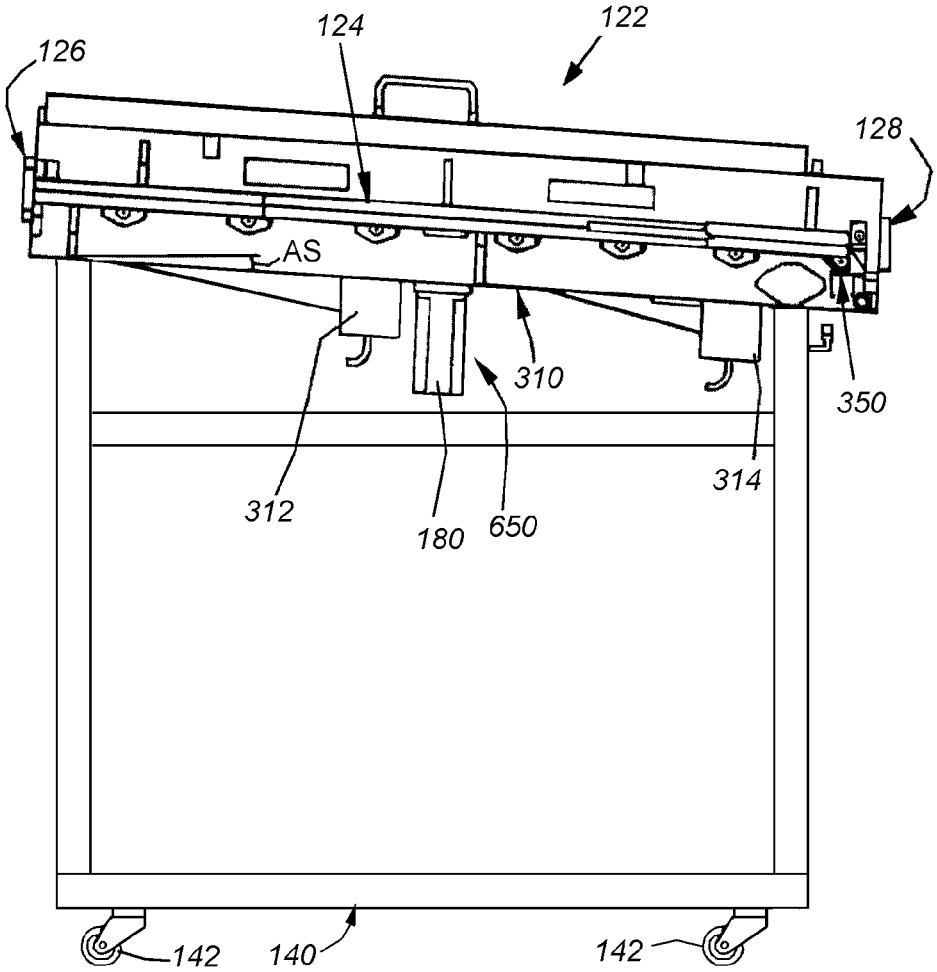
FIG. 3 is a more detailed side view of the exemplary sheet rotator of FIG. 1, taken along a right-angle side thereof.
Figure 4:
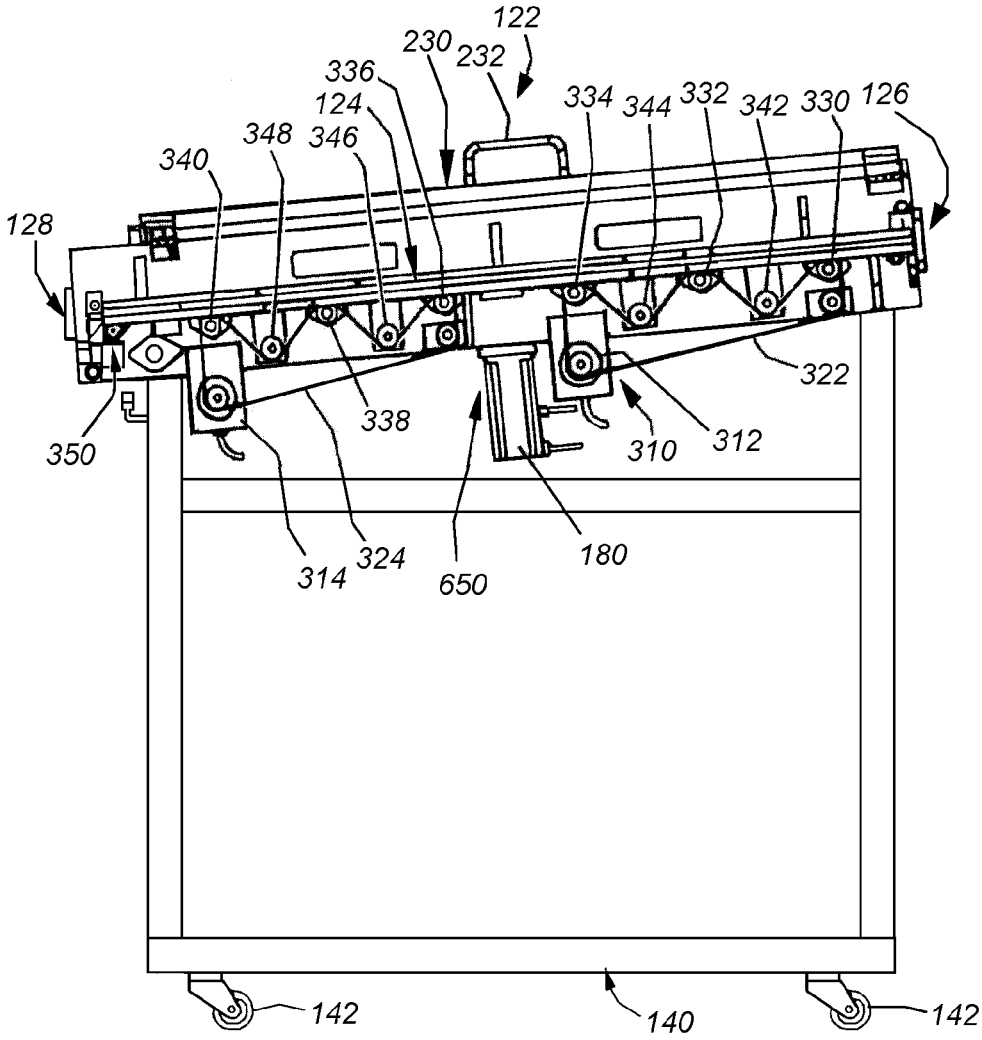
FIG. 4 is a more detailed side view of the exemplary sheet rotator of according to FIG. 1, taken along a left-hand side thereof.

As shown particularly in FIG. 2, the opposing sides of the feed table surface 124 are covered by corresponding sections of a top plate 220 that is spaced apart from the feed table surface 124 to provide a gap space 222 (shown in cutaway) with respect to the underlying feed table surface 124. This gap space 222 is sufficient to allow sheets of a variety of predetermined thicknesses (i.e. any conventional thickness) to pass between the top plate 220 and feed surface 124 without interference. A portion of the feed table surface 124, in a central region thereof, is not covered by the top plate 220, and is instead covered by a hinged cover assembly 230. The cover assembly 230 is shown hinged open in FIG. 6. A handle 232 can be provided to assist hinged opening of the cover assembly 230 along the opposing hinge line. The hinged cover assembly 230 allows the user access to the central region of the rotator 122 to perform service, adjustments, jam clearance, and other needed operations. In this embodiment, the feed table surface 124 and top plate 220 are narrowed (in a widthwise direction) at the upstream and downstream ends, and define a widened central region 240. The narrow-to-wide-to-narrow transition is an optional design feature. Alternatively, the entire surface can define the full width of the central region 240. As will be described below, the widened central region defines the sheet-rotation section of the rotator 122 and facilitates an enlarged radius that permits the unimpeded rotation of sheets in accordance with this invention.

Figure 6:
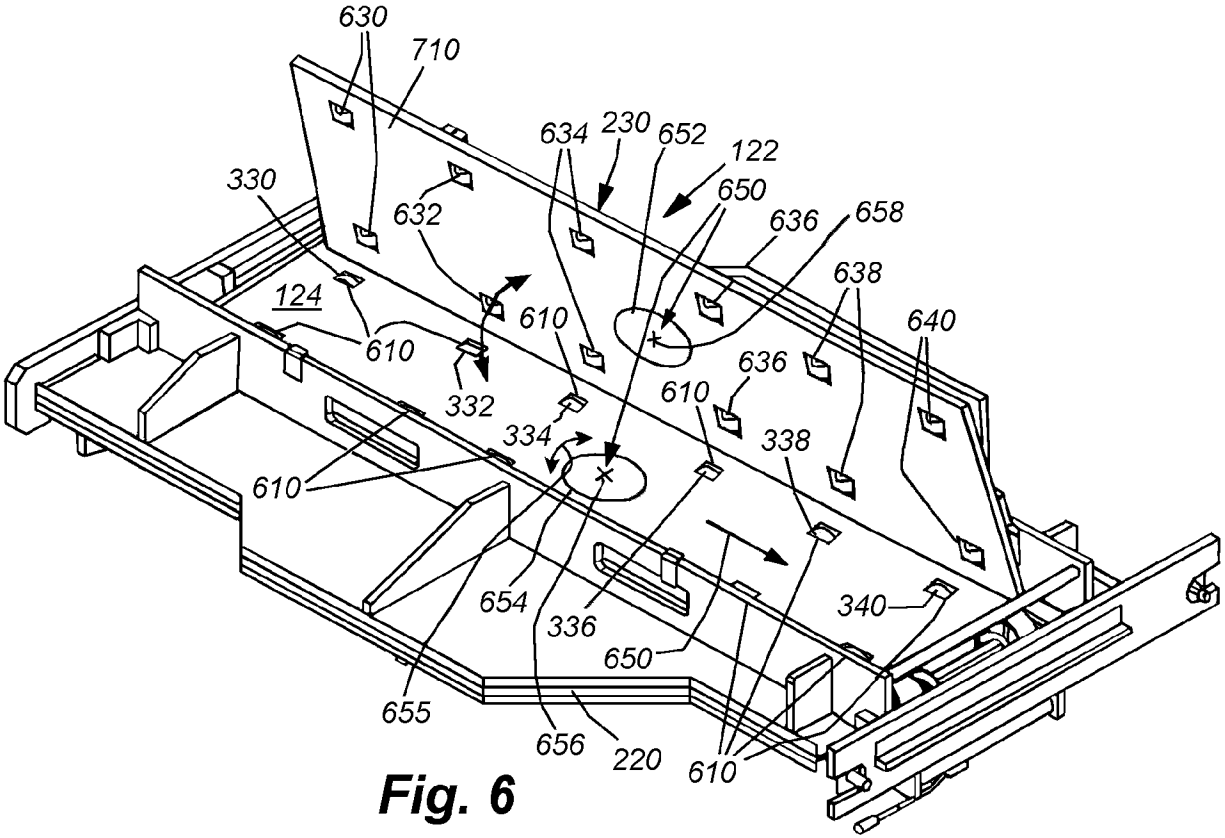
FIG. 6 is top perspective view of the exemplary sheet rotator of FIG. 1 with supporting legs omitted showing the nip roller cover in a raised orientation.

As shown further in FIG. 6, the top cover assembly 230 houses freely rotating nip rollers 630, 632, 634, 636, 638 and 640, that are constructed and arranged to overlie respective driven rollers 330, 332, 334, 336, 338, and 340 when the cover assembly 230 is lowered into a closed position (as shown, for example, in FIGS. 1-4). These nip rollers (also termed simply "nips") 630, 632, 634, 636, 638 and 640 respectively engage the driven rollers 330, 332, 334, 336, 338 and 340 to define a drive nip roller assembly that securely passes the sheets in a downstream direction (arrow 650) along the feed surface 124. Because each drive nip defines a pair of widthwise-spaced rollers, each rotating at an identical rate (on a common drive shaft), the drive nip passes a sheet located therebetween without skewing or lateral drift. As will be described further below, this facilitates the transport of sheets through the rotator 122 using as little as one nip roller pair, and enables sheets of various sizes to be continually engaged by at least one pair of rollers at all times during transport, eve as other nips along the transport feed path are disengaged to allow clearance for entering, exiting and rotating sheets. The size of the driven and nip rollers in this invention is highly variable. In an illustrative embodiment the contact surface of the rollers (driven and nip) each have a diameter of between approximately ½ inch and 1½ inch and an axial length approximately ½-1½ inches. These dimensions are highly variable. In alternate embodiments other types of drive components, such as belt assemblies may be employed.

Figure 5:
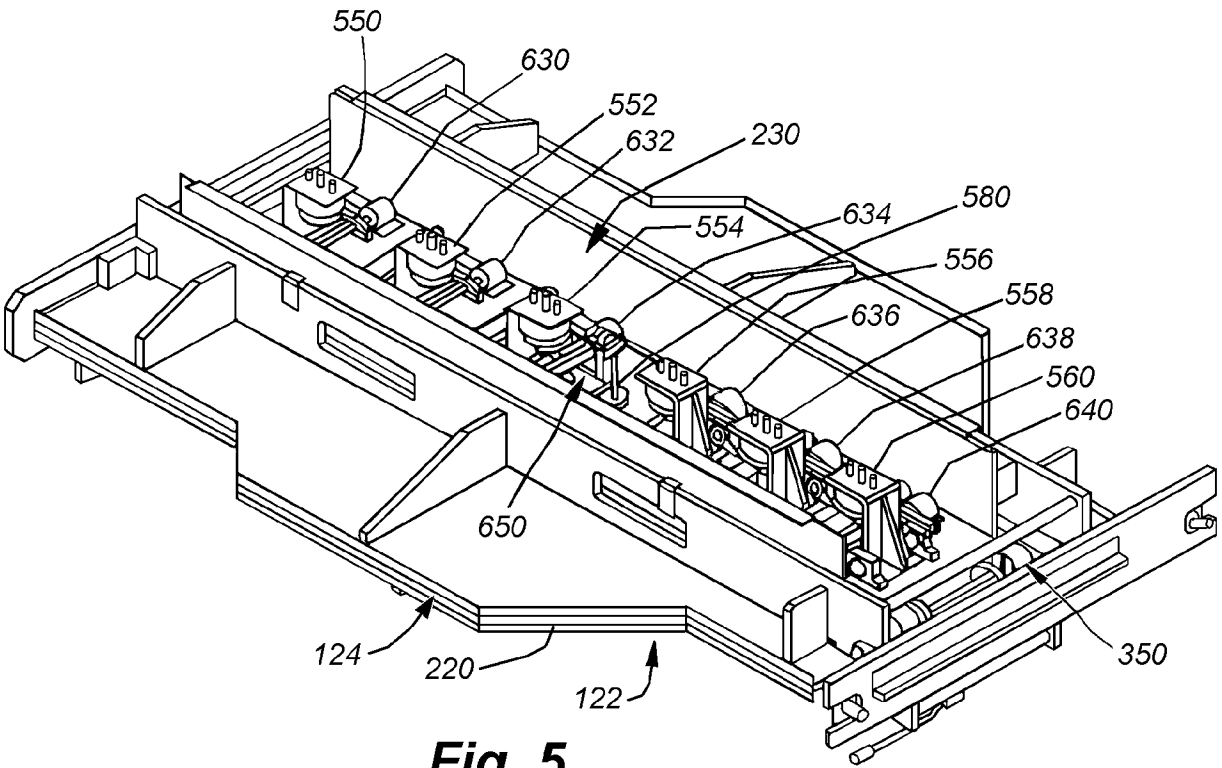
FIG. 5 is a bottom perspective view of the sheet rotator of FIG. 1 with supporting legs omitted for clarity.

The cover assembly 230 includes a top cover plate 250, which can be transparent or opaque. As shown in FIG. 5, when the plate 250 is removed, it reveals the internal mechanism of the cover assembly 230. The internal mechanism allows for the selective engagement of each set of nip rollers 630, 632, 634, 636, 638, and 640 with respect to their corresponding driven rollers 330, 332, 334, 336, 338 and 340. That is, each discrete pair of nip rollers can be moved into and out of engagement with their opposing driven rollers so as to selectively form a drive nip assembly or render the rollers undriven with a gap therebetween through which a sheet can pass free of interference. Selective engagement and disengagement of the nip assemblies (330 and 630, 332 and 632, 334 and 634, 336, and 636, 338 and 638, and 340 and 640) is achieved using respective solenoid assemblies 550, 552, 554, 556, 558 and 560 (or another controllable actuating mechanism) that selectively lifts each overriding, freewheeling nip roller pair out of engagement with the underlying driven roller pair. That is, when driving is desired, the solenoid or other actuator allows the nip roller pair to pressurably engage its confronting driven roller pair. Conversely, when it is desired to release the drive nip and provide clearance for sheet passage, the solenoid activates to lift the nip roller pair out of engagement with the driven roller pair. Independent activation of each of the nip assembly solenoids 550, 552, 554, 556, 558 and 560 is accomplished through the rotator's controller.

Notably, the ability to selectively engage pairs of nip rollers, and thereby provide a clearance within the rotator's feed surface enables sheets to be selectively rotates when centered with respect to a centralized rotator assembly 650 (FIG. 6) that includes a pair of upper and lower rotating disks 652 and 654. The lower rotating disk 654 is rotated about an axis 656 through at least a 90 degree arc (double arrow 655) by a rotary actuator or solenoid 180 (FIG. 1). The upper rotating disk also rotates about axis 658, which is generally aligned and coaxial with, axis 656 when the cover assembly 230 is closed to overlie the surface 124. The upper disk 652 freely rotates about a bearing structure that is mounted on an axially movable mounting (580 in FIG. 5, and also described below with reference to the illustrative embodiment) that allows to upper disk 652 to be brought into and out of pressurable engagement with the lower disk 654. When disengaged, sheets can pass through the region of the rotator assembly 650. When engaged, sheets are grasped by the rotator assembly 650, and can be rotated to a desired orientation by corresponding rotation of the actuator 180.

During rotation, any adjacent nips that would prevent or interfere with rotation are disengaged. The rotator's controller is adapted to ensure that at least one gripping component (i.e. a pair of nips or the rotator disks) engages the sheet at all times during its presence on the surface 124 so as to avoid undesired movement of the sheet. Thus as a sheet enters the rotator, adjacent nips 332, 632 continue to engage it, until the upper disk 652 is lowered into engagement. Thereafter, the nips 632 are raised (along with any interfering adjacent nips, such as downstream nips 636). The sheet is then rotated, and the downstream nips 636 (and other nips as appropriate) reengage the sheet. Thereafter the upper disk 652 is raised, and the sheet is driven further downstream toward the output.

II. Illustrative Arrangements for Inline Cut-Sheet Processing

Figure 7:
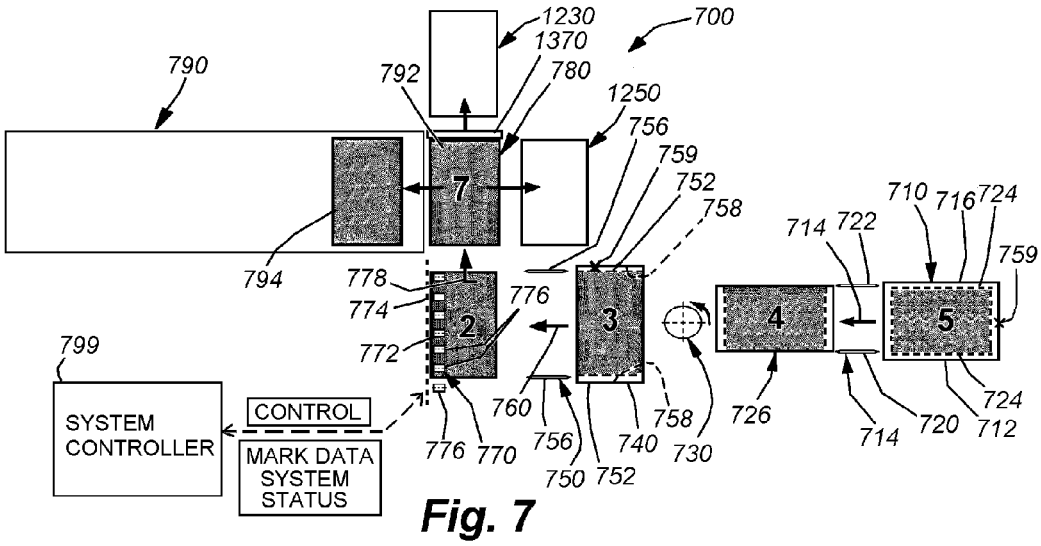
FIG. 7 is a plan view of the operative components of an inline sheet feeding, cutting, rotating, slitting and stacking system according to an illustrative embodiment, arranged in a one-page configuration.

Having described the operational principles of an illustrative rotator in accordance with this invention, reference is now made to FIG. 7, which depicts a system for inline alignment, slitting, rotating, cross-slitting of sheets containing single or multiple-page images according to a first illustrative arrangement 700. As shown, the depicted arrangement 700 is set up to handle single-page sheets. As described herein, each exemplary page in a book-to-be-stacked is provided with a centered number (in this example, pages 1-5). As will be described below, individual sheets can include 1, 2 or more page images that each define individual printed pages to be provided to a book. The page images are originally provided by a sheet printer, such as the above described Indigo unit. Note that the exemplary page numbers used herein are typically indicative of an ordering in a finished book. In fact, each sheet is often printed in duplex mode with aligned page images on each of opposing sides. Each page side includes an actual, discrete book page number in most instances.

Figure 9:
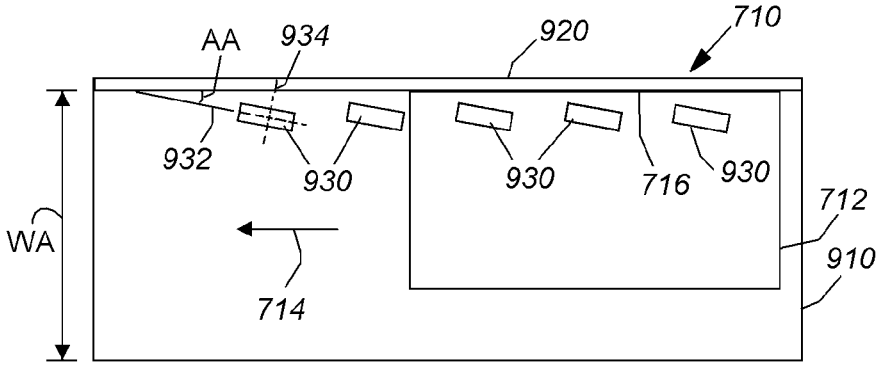
FIG. 9 is a plan view of the alignment station of an inline sheet feeding, cutting, rotating, slitting and stacking system according to an illustrative embodiment.

The arrangement 700 begins the book-stack generation process by inputting sheets from an upstream location (for example, a conveyor directed from the printer) to an alignment station 710. In this example, sheet 712, containing page 5 is positioned at the alignment station, ready to proceed downstream (arrow 714). The alignment station 710 can be any acceptable mechanism for driving at least one edge (in this case edge 716 against an edge guide). With reference to FIG. 9, the alignment station 710 is shown in further detail. It consists of a feed surface 910 having a width WA sufficient to accommodate the widest sheet (for example 712) that will be used in the process. The sheet is directed downstream (arrow 714) against a registration edge guide 920 can comprise a low friction upright wall against which the edge 716 is driven as it proceeds downstream 712. The mechanism for driving and aligning the sheets against the edge guide 920 is highly variable. In this embodiment the mechanism comprises a set of rollers 930 that are angled to rotate (rotation line 932 at an angle AA) that is between approximately 3 and 10 degrees in one embodiment. A variety of alternate angles can be employed. The rollers 930 can each include overriding weighted balls, or another low-friction pressure device (not shown) that creates an appropriate nip for driving the sheets both against the edge guide 920 and predominantly in the downstream direction. Since the angle AA is not parallel to the direction of the edge guide 920, the rotation axis 934 of each roller 930 is at a non perpendicular angle with respect to this edge guide. In alternate embodiments, rotating disks or one or more angled belts (with freely rotating weighted balls overlying them) can be employed to define the alignment drive.

Referring again to FIG. 7, from the alignment station 710, each sheet passes through an upstream or first trimming station 720 in the direction of the downstream arrow 714. The trimming station 720 in this embodiment comprises a pair of pressurably engaged slitter wheels 722 constructed from a hard material (steel, etc.) and bearing against an opposing roller or other impinging surface (described below). The slitter wheels 722 are each part of respective overriding slitter elements (also termed slitter "cartridges") to be described below. They are adjustable in a widthwise direction, perpendicular to the direction of downstream movement. The upstream trimming station 720 removes the margin edge strips 724 (also termed "gutter" strips herein) from each widthwise edge of the sheet thereby producing the trimmed sheet 726 (page 4). The trim lines are typically aligned with the opposing outer edges of the page or pages within the sheet. The trimmed sheet is grasped by a plurality of nip rollers. The nip rollers (not shown) are similar in structure and function to the selectively engageable rollers 330, 332, 334 and 630, 632, 634 described above with respect to the illustrative rotator 122. In this embodiment, instead of a pair of nips, each located on an opposing side of the feed surface center line, two, widthwise, spaced-apart pairs of rollers are provided on each of opposing sides of the center line. The pairs are positioned so that a variety of widths of sheets can be manipulated without skew after they are received from the alignment station. At least one set of nip rollers engage each sheet at any given time. At selected times, each sheet engaged by the nips is driven downstream into the rotator section 730. Adjacent nips are disengaged to allow rotation of sheets (as described above) after the rotator disk assembly firmly grasps the sheet.

Figure 10:
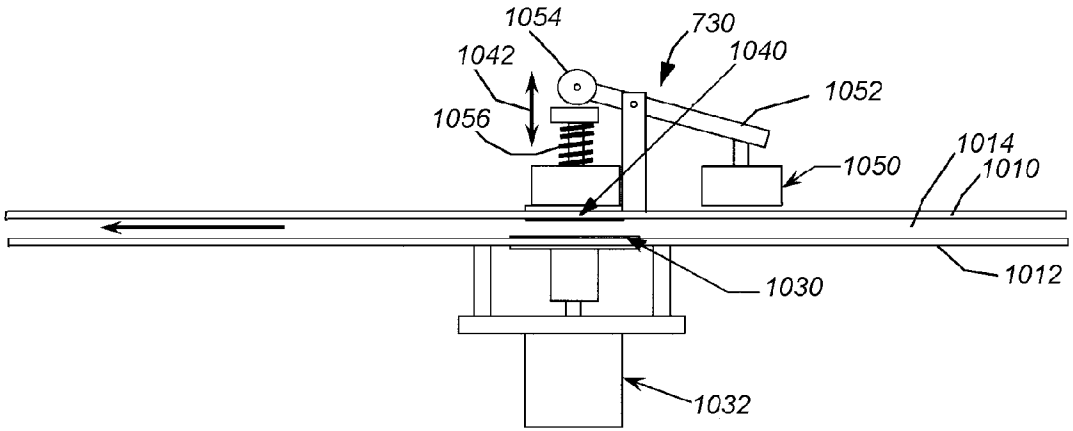
FIG. 10 is a side view of the rotation station of an inline sheet feeding, cutting, rotating, slitting and stacking system according to an illustrative embodiment.
Figure 11:
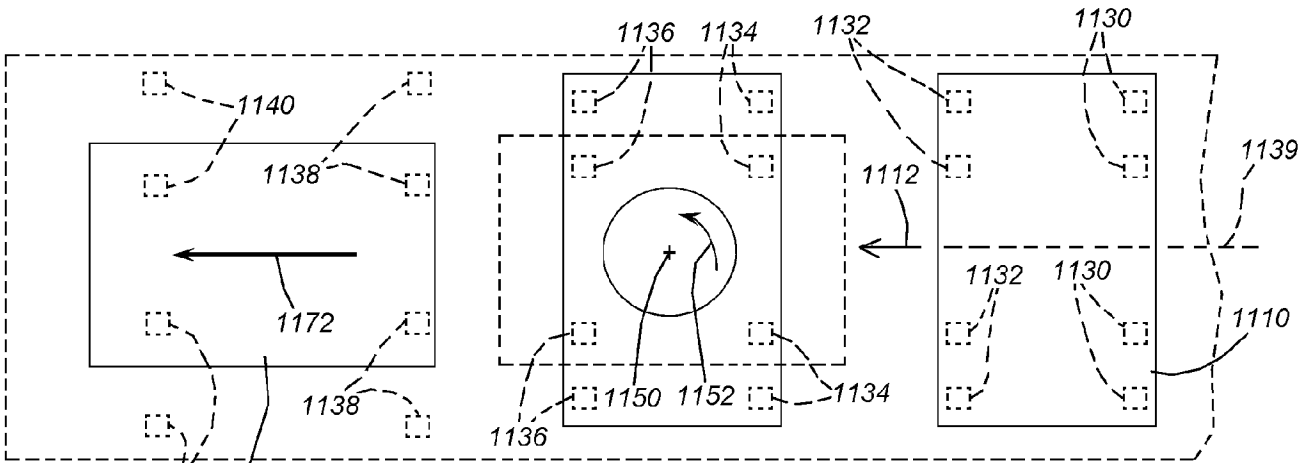
FIG. 11 is a plan view of the operation of the rotation station of FIG. 10 showing the 90-degree rotation of exemplary sheets thereby.

With reference now to FIGS. 10 and 11, an illustrative embodiment of the rotator section 730 as shown in further detail. Sheets pass between an upper guide plate 1010 and a lower plate 1012 which are arranged and function similarly to the overriding plate 220 and the feed surface 124 described above. The space 1014 between the plates 1010 and 1012 is sufficient to allow sheets to pass unimpeded when the rotator disks are disengaged (e.g. a gap of ⅛-¼ inch). Similar to the above-described rotator assembly, the rotator disk assembly 730 of this embodiment includes a lower driven disk 1030 having a frictional surface. The disk 1030 is driven by a rotary solenoid, servo or other actuating mechanism 1032 that allows at least ninety degree rotation about an axis. A freely rotating follower disk 1040 is provided with respect to the upper plate 1010. The follower disk, also generally similar to that described above, is moveable upwardly and downwardly (double arrow 1042) out of and into engagement with sheets that have been driven into the assembly 730. The follower disk 1040 is actuated into engagement using a solenoid 1050 or other actuating assembly that operates a lever 1052. The lever 1052 includes a roller or other bearing 1054 that presses against a return spring 1056 that normally biases the upper rotator 1040 out of engagement with the lower rotator plate 1030.

As shown in FIG. 11, an exemplary sheet 1110 passes downstream (arrow 1112) under operation of the nip rollers 1130, 1132, 1134, 1136 (shown in phantom) note that the nip rollers are placed so that wide sheets are engaged by each of two pairs on opposing sides of the feed surface center line 1139. When the rotator plates 1030 and 1040 are engaged, the sheet can be rotated about a rotational axis 1150 (curved arrow 1152) into a new orientation shown by the more-downstream sheet 1170. The sheet is directed further downstream (arrow 1172) by nip rollers 1140. Since the sheet has a narrower widthwise dimension in this rotational orientation, only the innermost of each pair of the nip rollers 1138 and 1140 (closest to either side of the centerline 1139) engage the sheet during this driving operation. Various nip rollers (for example, rollers 1132, 1134, 1136 and 1138 are disengaged by their respective actuators (not shown, but shown and described above), so as to not interfere with the sheet, as it rotates. Various rollers are reengaged (for example lowers 1136, 1138 and 1140 after the sheet has rotated and the follower rotator disk 1040 has been disengaged.

Referring again to FIG. 7, the rotated sheet 740 (page 3) is now directed downstream to a downstream cutting end trimming station 750. Note that a pair of opposing margins 752 is defined between the sheet edges and the actual page edges (shown by dash lines). The trimming station 750 consists of a pair of opposed slitter wheels 756 that are adjusted to cut along the locations defined by these symbolic dashed lines 758. As the sheet 740 passes downstream (arrow 760) through the slitter wheels 756, it emerges at a right-angle merge assembly 770. Sheet 772 is shown positioned in the right-angle merge assembly 770. All edges have been trimmed to correspond to the approximate page size, thereby providing "a full bleed" page. Note that the upstream printer can provide a code or indicia 759 within an appropriate margin or margins of each sheet or page image. This code (a barcode, for example) allows each sheet and/or page therein to be uniquely tracked through the system process. Appropriate ID readers can be positioned at various stations (described below) to read the codes and thereby track the sheet, and/or pages within sheets, as they pass through the system process. In most instances, the codes are removed when the margin edges or other internal dividing gutter strips between pages, and which contain the codes, are slit-away. In this manner they do not become part of the finished book pages. However, during the process, the codes can provide contemporaneous information that the system controller (799 in FIG. 7) can use to track sheets as they pass through the process. More particularly this tracking information is useful to identify and track the location and identity defective pages, sheets and stacks, so that appropriate rejection operations can occur (described below), and/or replacement sheets can be inserted at a subsequent time.

Referring again to the right-angle merge assembly 770, it further consists of downstream backing/guide wall or rail 774 (shown in phantom) and a set of driven right-angle rollers 776 that rotate along axes parallel to the initial downstream direction (arrow 760) so as to drive sheets from that initial downstream direction shown by arrow 760 into a right-angle downstream direction shown by arrow 778. Each of the right-angle rollers 776 is part of driven nip pair that can be engaged and disengaged (as described generally herein) using a solenoid or other actuation system. This allows sheets entering from the upstream trimming and rotation sections to pass into the nips unimpeded. As sheets reach the wall or rail 774, they are stopped by it, and appropriate nips are engaged based upon the size of the sheets. Upstream nips on the trimming and rotating section are disengaged so the sheet is free to move in the right-angle direction. The rollers 776 are then rotated to drive the sheets along the wall/rail 774, in registration with it, and into a stacker assembly 780. As will be described further below, the sheets entering the right-angle merge assembly 770 can be driven in a close synchronization so that new entering sheets reach the right-angle rollers 776 just as downstream sheets have departed the overlap area for the stacker. The nips in the overlap area disengage to receive the new entrants as downstream rollers 776 outside the overlap area engage and drive the downstream, leaving sheets. The entering and leaving sheets may, in fact be slightly shingled within the feed surface of the merge assembly during the movement.

Note that the depicted guide wall or rail 774 is optional (thus, shown in phantom) in this embodiment, and other embodiments described herein. In alternate embodiments (and as described further below), the wall/rail 774 can be a selectively deployed structure (i.e. retractable) or can be omitted in an "edgeless" implementation of the system. Where omitted, the selectively engaged nip roller sets at the right-angle merge assembly maintain a continuous grip on each sheet (passing each sheet between successive downstream sets) so that each sheet's position is always known, and the sheet is free of skew. Additionally, by omitting or selectively disengaging the rail 774, selected sheets can be directly driven through the merge assembly free of any right-angle turn toward the stacking device. This can expedite the removal of defective sheets or provide a secondary path for feeding sheets to further pos-production operations and/or alternate tacking devices.

Additionally, an edgeless driving arrangement at the right-angle turn assembly enables offsetting of particular sheets, stack sections, or entire stacks. For example, to generate an offset sheet or grouping of sheet, the controller directs such sheets to be drive by ¼-½ inch further into the right-angle nips, before these nips engage and drive the offset sheets in the right-angle direction toward the stack. When the sheets are stacked, they display an offset with respect to non-offset sheets.

Figure 12:
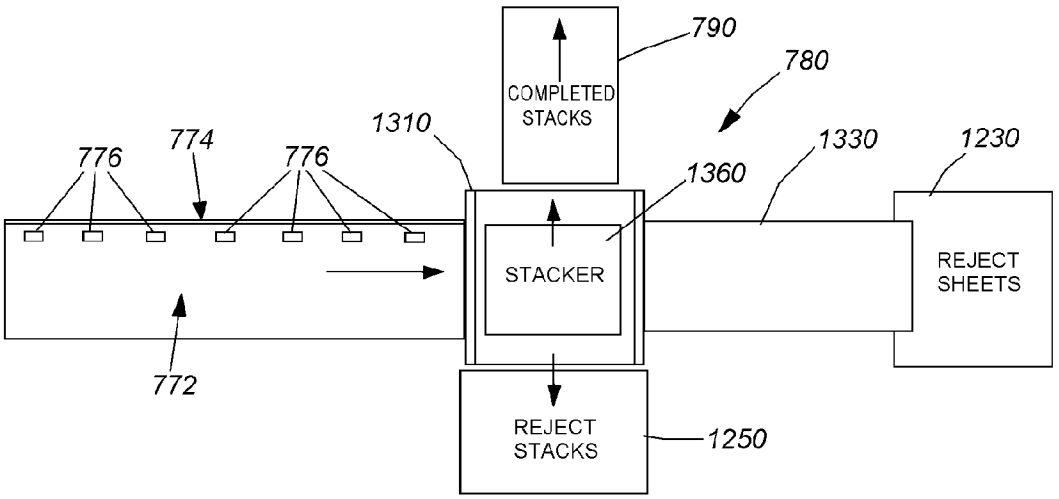
FIG. 12 is a plan view of the stacker assembly of an inline sheet feeding, cutting, rotating, slitting and stacking system according to an illustrative embodiment.
Figure 13:
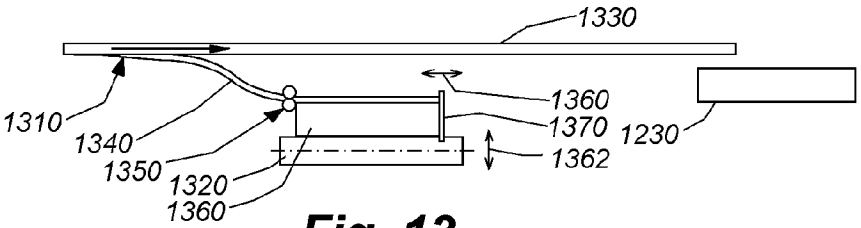
FIG. 13 is a side view of the stacker assembly of FIG. 12 detailing a divert gate assembly for directing rejected sheets to a storage location.

With further reference to FIG. 12, the stacker assembly 780 is now shown in further detail. Sheets enter from the right-angle merge assembly 770 under the drive of the rollers 776. A divert gate 1310 (shown in further detail in FIG. 13) is operated to direct sheets to the lower stacker conveyor 1320 when the sheets and/or stack do not include imperfections requiring rejection. If a sheet is indicated as rejected, the controller 799 notes its identifying code (759) and the divert gate 1310 directs the sheet along a conveyor pathway 1330 to a rejected sheet stack 1230. As noted, non-rejected sheets are directed by the divert gate 1310 along a second pathway 1340 through a pair of decelerating nip rollers 1350 onto the main stack 1360 that resides on the stacker conveyor. The stacker conveyor moves in a direction generally transverse to the direction of deposit thereonto by the rollers 1350. The moveable stack conveyor 1320 also includes an elevator function moves the conveyor's stack-supporting surface upwardly and downwardly (double arrow 1362) as the stack grows, and/or a new stack is formed. If a stack is complete and defect-free, it is directed from the elevator conveyor 1320, and down a completed stack conveyor (790 in FIG. 7). The stacks are thereafter directed to, collection points, binders and/or other post-processing operations. If an entire stack is to be rejected (and defect-free pages therein recycled) then the elevator conveyor 1320 directs the stack in an opposing direction to a reject stack location 1250. As shown in FIG. 7, the sheet 792 (page 1) is part of an acceptable stack that eventually becomes conveyed (for example, stack 794) to a downstream operation. Based upon the size of the pages, a movable (double arrow 1360) backing wall 1370 on the elevator conveyor 1320 is set to ensure registration of the stack with respect to the conveyor 790.

While the sheets pass into a right-angle merge assembly in various embodiments herein, in alternate embodiments, the system can be adapted to provide a different output path in order to collect sheets into a stacking location in an appropriate order. For example, a multi-deck merger can be employed.

Figure 8:
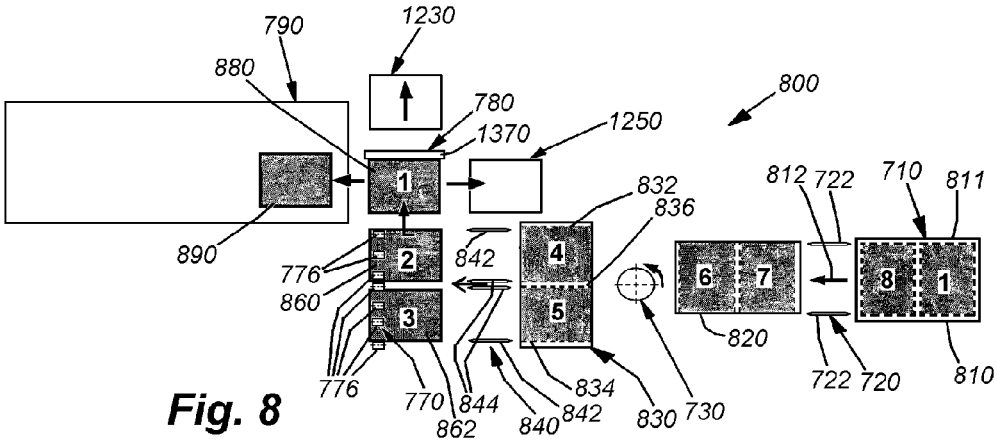
FIG. 8 is a plan view of the operative components of an inline sheet feeding, cutting, rotating, slitting and stacking system according to an illustrative embodiment, arranged in a two-page configuration.

Reference is now made to FIG. 8, which shows the handling of two-page sheets by a slightly modified arrangement 800 of the system initially described in FIG. 7. Accordingly, similar or identical system components are given like reference numbers to those described in FIG. 7. A sheet 810 is provided at the alignment station 710, where it is registered with respect to the edge 811. The sheet 810 includes a pair of pages (page 8 from a downstream job and page 1 of a new job). The feed 810 is directed downstream (arrow 812) through the first upstream trimming station 720, which consists of a pair of outer slitter wheels 722 as described above. The slitter wheels 722 remove the edge strips on either widthwise edge of the sheet 810. An edge-trimmed, two-page sheet 820 is shown located downstream of the trimming station 720. The depicted sheet 820 includes pages 6 and 7. After entering the rotator section 730, each sheet is rotated ninety degrees as shown by the further downstream sheet 830. The downstream sheet 830 is now oriented so that a pair of edge margin strips 832, 834 and a center-dividing gutter strip 836 face a second, downstream trimming station 840. This downstream trimming station 840 consists of a pair of outer slitter wheels 842 adapted to cut-away the edge margin strips 832 and 834, as well as a closely spaced central slitter wheel pair 844 that together separate the two pages (pages 4 and 5 as depicted) and allows removal of the center gutter strip 836.

Figure 14:
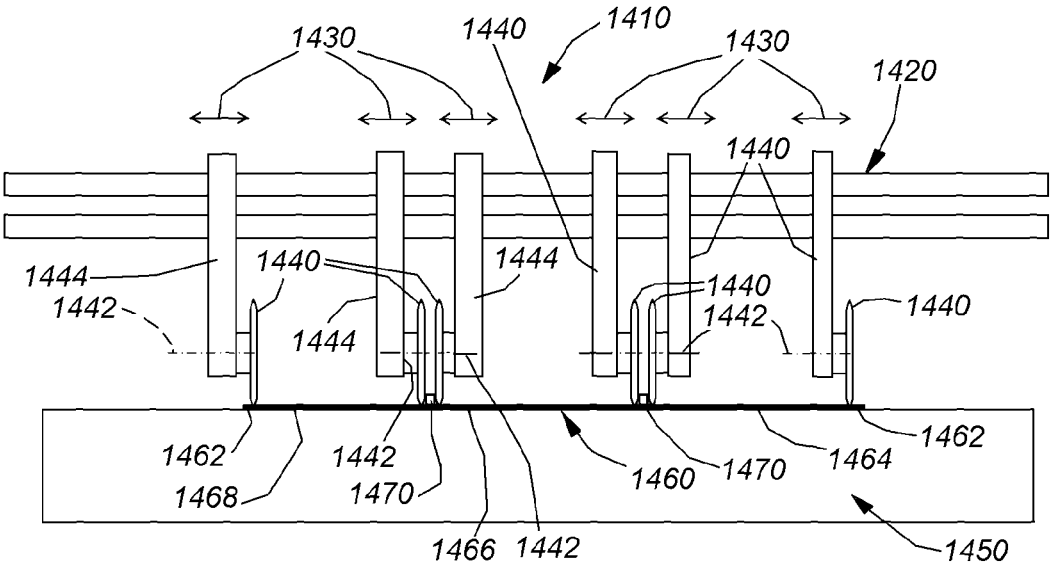
FIG. 14 is a frontal view of a plurality of adjustable slitter elements for use in a downstream slitting and trimming assembly of an inline sheet feeding, cutting, rotating, slitting and stacking system according to an illustrative embodiment.
Figure 20:
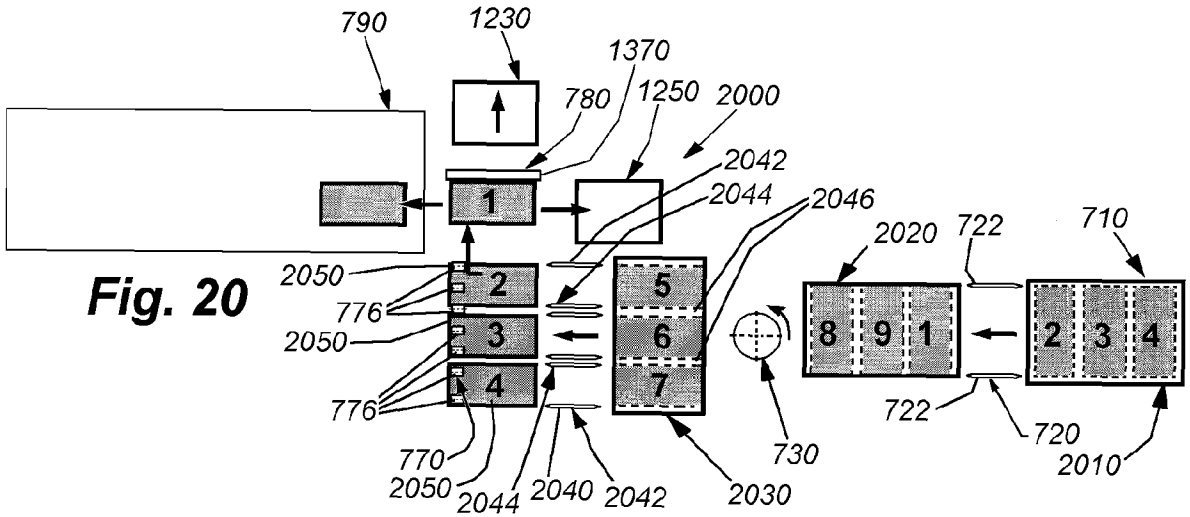
FIG. 20 is a plan view of the operative components of an inline sheet feeding, cutting, rotating, slitting and stacking system according to an illustrative embodiment, arranged in a three-page configuration.

The trim and/or slitter elements are now described in further detail with reference to the general slitter element arrangement 1410 shown in FIG. 14. The individual slitter elements are mounted on an overhead support bar or beam 1420 that provides stability and adjustable movement (double arrows 1430) in a widthwise direction. Each slitter element includes an associated slitter wheel 1440 constructed from a hard material such as tool steel with a coating, such as carbide. Each slitter wheel 1440 rotates on bearings that define a rotational axis 1442. Each slitter wheel 1440 is also mounted on an associated vertical bracket 1444 that can be slid along the bar 1420, and locked in place with respect to the bar 1420 using an appropriate locking mechanism such as one or more turn screws or pinch clamps. The exemplary slitter element arrangement 1410 in FIG. 14 is particularly arranged to provide three separate pages (such as shown in FIG. 20 described below). A variety of sheet-slitting arrangements can be achieved by varying the number and widthwise location or slitter wheels with respect to the feed surface. A grooved surface or roller 1450 engages the sharp edge of each slitter wheel 1440. This engagement creates a slitting geometry that divides the underlying sheet 1460 into individual page sections 1464, 1466, 1468 with removal of associated gutter (1470) and margin (1462) strips as appropriate. As shown, the outer margin edges 1462 of the exemplary sheet 1460 are removed by the outer slitter wheels. The three page sections 1464, 1466 and 1468 within the sheet 1460 are divided by the two inner pairs of slitter wheels 1440 which each generate therebetween a waste gutter strip section 1470.

Figure 15:
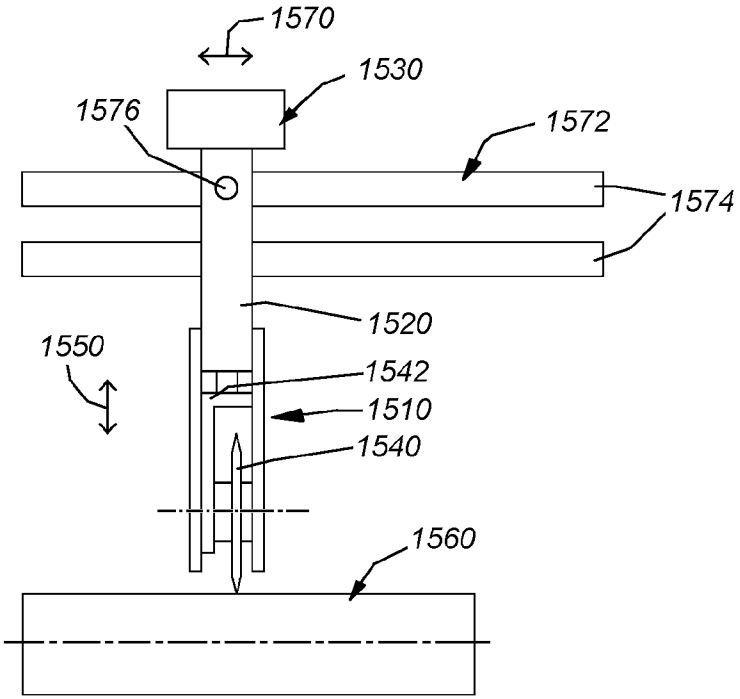
FIG. 15 is a frontal view of a solenoid-engaged slitter element for use with an inline sheet feeding, cutting, rotating, slitting and stacking system according to an illustrative embodiment.

Any of the illustrative slitter elements employed in either the upstream or downstream trimming stations can be automated so as to be selectively engageable on the sheet. With further reference to FIG. 15, a slitter element 1510 that includes a vertical bracket 1520 having an actuating solenoid 1530 (or other actuating mechanism) is provided. The actuating solenoid 1530 allows the slitter wheel 1540, mounted on a separate sliding carriage 1542 to be displaced upwardly and downwardly (double arrow 1550), into and out of engagement with the underlying hardened roller 1560. The slitter element 1510 is also mounted so as to be moveable (double arrow 1570) in a widthwise direction along the overlying support bar 1572. In this embodiment a pair of spaced-apart parallel bars 1574 is employed as the support bar structure for added mounting stability. Appropriate locking mechanisms can be provided to retain slitter elements with respect to the bar 1572, such as a locking turn screw 1576.

Figure 16:
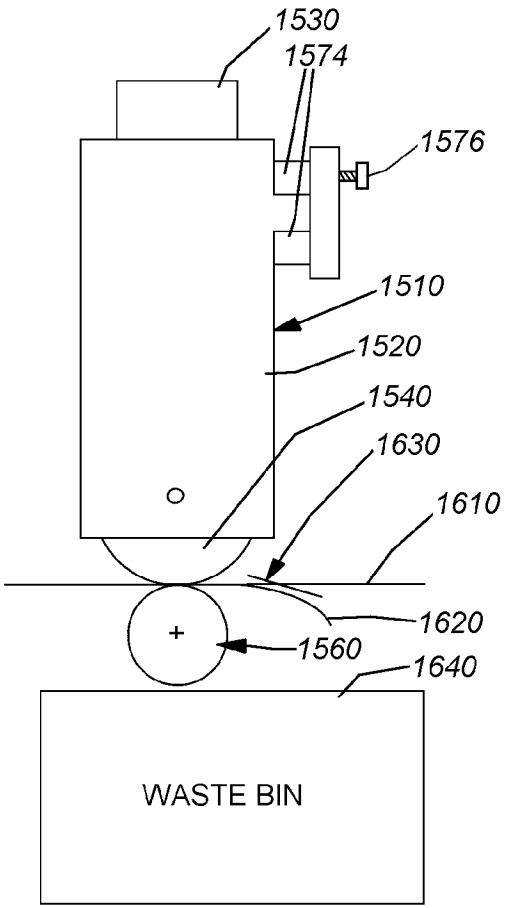
FIG. 16 is a side view of the slitter element of FIG. 15 including a waste bin for receiving excess sheet material removed by the element's slitter wheel.

With reference now to the side view of the slitter element 1510 as shown in FIG. 16, as a sheet 1610 is trimmed, the excess gutter strip 1620 is directed downwardly as shown by a downstream-located deflector 1630 into a waste bin 1640 or other strip-removing structure (e.g. a vacuum port). A variety of alternate arrangements for removing waste strips can be employed. The waste bin can be supplemented with a vacuum or airflow so as to be sure direction of the strip 1620 thereinto.

Figure 18:
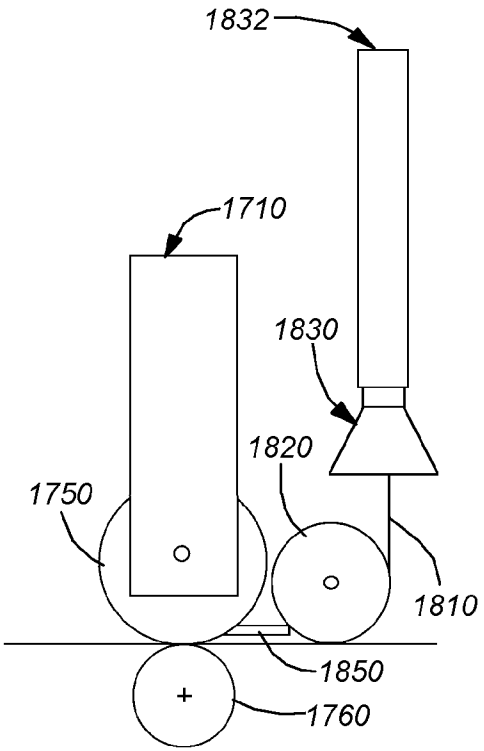
FIG. 18 is a side view of the slitter elements of FIG. 17, showing a vacuum strip-removal assembly according to an illustrative embodiment.
Figure 17:
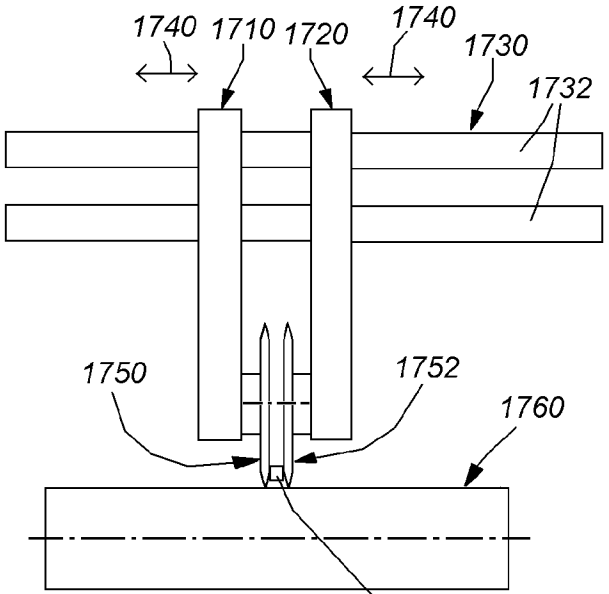
FIG. 17 is a frontal view of a pair of side-by-side slitter elements arranged to create a gutter strip between divided sheet sections for use with an inline sheet feeding, cutting, rotating slitting and stacking system according to an illustrative embodiment.

FIGS. 17 and 18 deal an alternate arrangement for removing slitter-generated waste strips according to an embodiment of this invention, that is also applicable to any of the sheet-trimming arrangements described herein. In this embodiment, a pair of slitter elements 1710 and 1720 is mounted in close proximity along the overhanging support bar assembly 1730. This support bar assembly illustratively consists of two spaced-apart bars 1732 similar to those described above with reference to FIGS. 15 and 16. The slitter elements are movable (double arrows 1740) to provide the appropriate spacing between slitter wheels 1750 and 1752 and define therebetween a gutter strip of a predetermined width. The slitter wheels 1750, 1752 engage a hardened roller 1760 similar to that described above. In this embodiment, with reference particularly to FIG. 18, the waste gutter strip 1810 produced by the confronting slitter wheels 1750 and 1752 is passed under a follower roller 1820, that spaces the extracted strip away from the downstream end of the slitter wheels, and into a vacuum port 1830 of appropriate size and shape to receive the strip. The upper end 1832 of the port 1830 routes the waste strip to an appropriate storage bin or other receptacle using a conduit or other guide structure. A shield 1850 can also be provided upstream of the roller 1820 in order to prevent inadvertent misdirection of the strip end. A vacuum source (not shown) is provided within the circuit of the port 1830.

Figure 19:
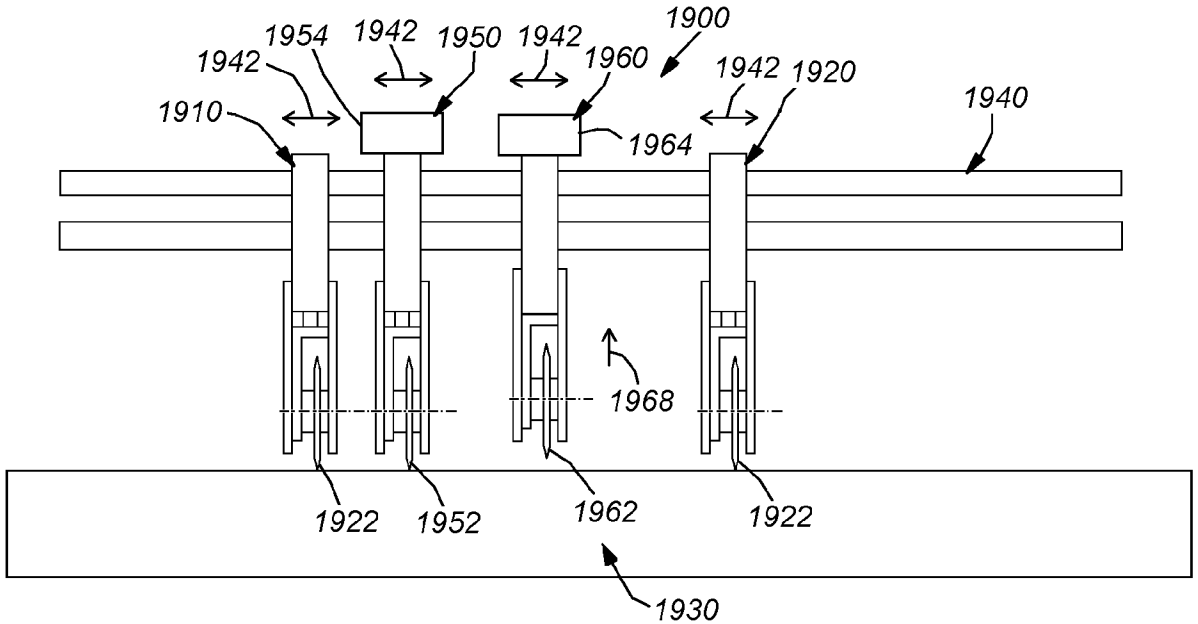
FIG. 19 is a frontal view of a plurality of slitter elements including a combination of solenoid-engaged and fixed slitter elements for use with an inline sheet feeding, cutting, rotating slitting and stacking system according to an illustrative embodiment.

With further reference to FIG. 19, a downstream trimming station setup that can be employed in the depicted arrangement of FIG. 8 is shown. This arrangement 1900 includes a pair of fixed, continually engaged outer slitter elements 1910 and 1920 with associated slitter wheels 1912 and 1922 that bear against a hardened roller 1930. These outer slitter elements 1910 and 1920 are mounted on an overlying support bar structure 1940 so as to be adjustably moveable (double arrows 1942) in a widthwise direction as described above. A pair of central slitter elements 1950 and 1960 with associated slitter wheels 1952 and 1962 are also provided between the outer slitter elements 1910 and 1920. These elements 1950 and 1960 are also adjustable in a widthwise direction (double arrows 1942) along the support bar 1940. Likewise, each element includes an associated actuating solenoid (or other actuating assembly) 1954 and 1964. As shown, the slitter element 1960 is actuated so that its slitter wheel 1962 is raised (upward arrow 1968) as shown. Conversely, the slitter wheel 1952 of the slitter element 1950 is in a lowered position so as to slit underlying sheets. By actuating various slitter elements (to engage sheets) and locating them in a widthwise direction, appropriate page divisions can be made within sheets, which define the desired page widths.

Referring again to the arrangement 800 of FIG. 8, sheets exit the downstream trimming station 840 with a central gutter strip removed (and disposed of as described above) so as to form two discrete, side-by-side cut sheets 860 and 862 (corresponding to pages 2 and 3, respectively). These pages enter the right-angle merge assembly 770 and are driven by the rollers 776 towards the stacker 780. The stacker backing wall 1370 has been moved so that the narrower-width sheets are appropriately aligned with the completed stack conveyor 790. The sheets are driven from the right-angle merge assembly onto the stack, which already includes a first sheet 880 corresponding to page 1. In this manner, a page-ordered stack is formed and subsequently directed along the completed stack conveyor (stack 890). Should any stacks or sheets be defective, such stacks or sheets are directed to the associated rejected stack location 1250 or rejected sheet location 1230 as appropriate. Defective sheets and stacks are particularly tracked using, for example, the tracking codes on sheet margins, combined with the internal logic of the controller, which can time the arrival of a detected, defective sheet by tracking the motion of the feed mechanisms and other sheet detection sensors. In this manner the controller "knows" when a defective sheet or stack has arrived at the stacking location and can appropriately direct it to the reject area.

Reference is now made to FIG. 20, which shows an arrangement 2000 of the system adapted to handle sheets having three page images formed thereon. Again, like reference numbers to those described with reference to the system arrangement 700 (FIG. 7) have been retained for like components in FIG. 20. The three-page sheet 2010, bearing pages 2, 3 and 4 of a nine-page book is fed to the alignment assembly 710, where one edge is justified. The sheet then passes through the upstream trimming station 720 to cut-away the opposing side margin strips. This first trim process thereby results in a downstream sheet 2020 (bearing pages 1, and 8 and 9 of the previous book), which is ready to enter the rotator. The sheet is rotated into the orientation shown by the sheet 2030 in which three pages (pages 5, 6 and 7 in this example) face across the feed surface width, ready to pass through the downstream trimming station 2040. The slitter arrangement of this trimming station 2040 includes opposing outer slitter wheels 2042, and two pairs of inner slitter wheels 2044 that respectively remove a pair of gutter strips 2046 between pages. The fully trimmed sheet set 2050 (pages 2, 3 and 4 in this example) enter the right-angle merge assembly 770 together at various locations along its upstream-to-downstream length (locations where the merge assembly overlaps with the width of the upstream slitter and rotator sections), and are then placed in page-order on the stacker 780 with the backstop 1370 adjusted to accommodate the particular sheet dimensions 2050. Completed stacks, rejected sheets and rejected stacks are handled as described above.

Figure 21:
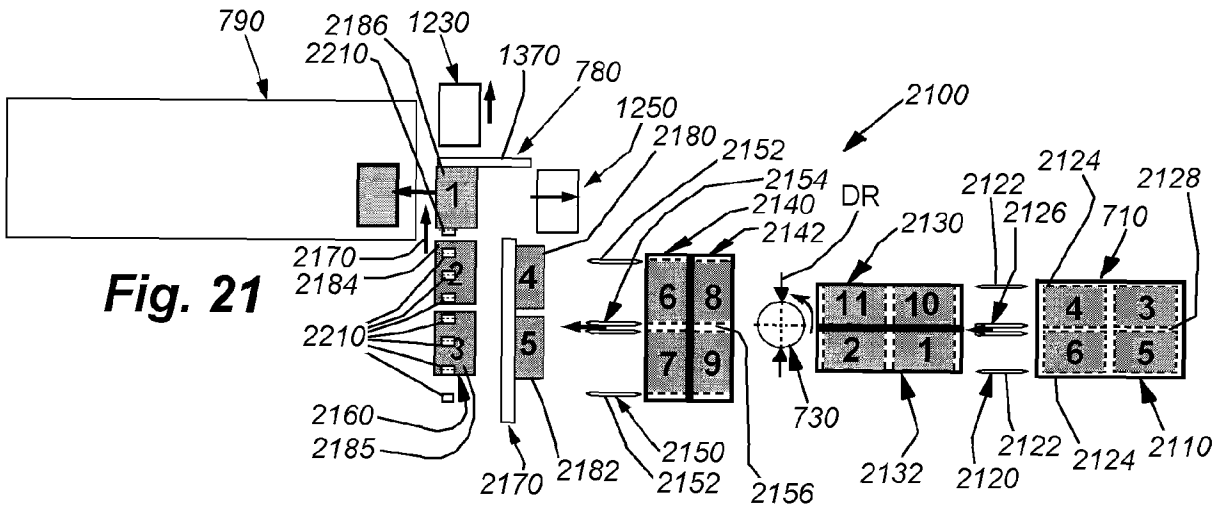
FIG. 21 is a plan view of the operative components of an inline sheet feeding, cutting, rotating, slitting and stacking system according to an illustrative embodiment, arranged in a four-page configuration including a divert gate assembly operatively interconnected with the right-angle merge assembly.

Reference is now made to FIG. 21, which shows and arrangement 2100 of the system adapted to handle four-page sheets. A sheet 2110 (including images of exemplary pages 3, 4, 5 and 6 of a second book in the job) is presented to the alignment assembly 710. Sheets are directed through the upstream trimming station 2120 which, in this arrangement, includes opposing outer trim wheels 2122 to remove widthwise edge strips 2124 and also a pair 2126 of spaced-apart central slitter wheels to remove a central gutter strip 2128 between widthwise pairs of pages (in this example a strip 2128 between pages 3 and 4 and pages 5 and 6). The divided sheets 2130 pass from the upstream assembly 2120 into the rotator 730. As described above, because the nip rollers are arranged in widthwise pairs on each of opposing sides of the center line, the arrow pair of side by side sheets 2130 and 2132 are firmly engaged as they are transported into the rotator section 730. The rotator 730 includes disks that define a sufficient diameter DR so that they can engage and grip appropriate portions of both side-by-side slit sheets 2130 and 2132 during the rotation process. In this manner, the sheets undergoing rotation are free of undesired movement or misalignment (other than the desired rotational motion). Thus, the pair of sheets is rotated into the orientation shown by the pair of side-by-side upstream/downstream sheets 2140 and 2142. The system nip rollers are positioned to maintain engagement with, and transport, the sheets 2140 and 2142 in proximity to each other. Each of the sheets 2140 and 2142 is passed through the downstream trim assembly 2150, which includes outer slitter wheels 2152 to remove edge strips, and a centered pair 2154 of inner slitter wheels that are positioned to remove a central gutter strip 2156 between the pages in each sheet (exemplary pages 6 and 7 in sheet 2140 and exemplary pages 8 and 9 in sheet 2142.

Figure 22:
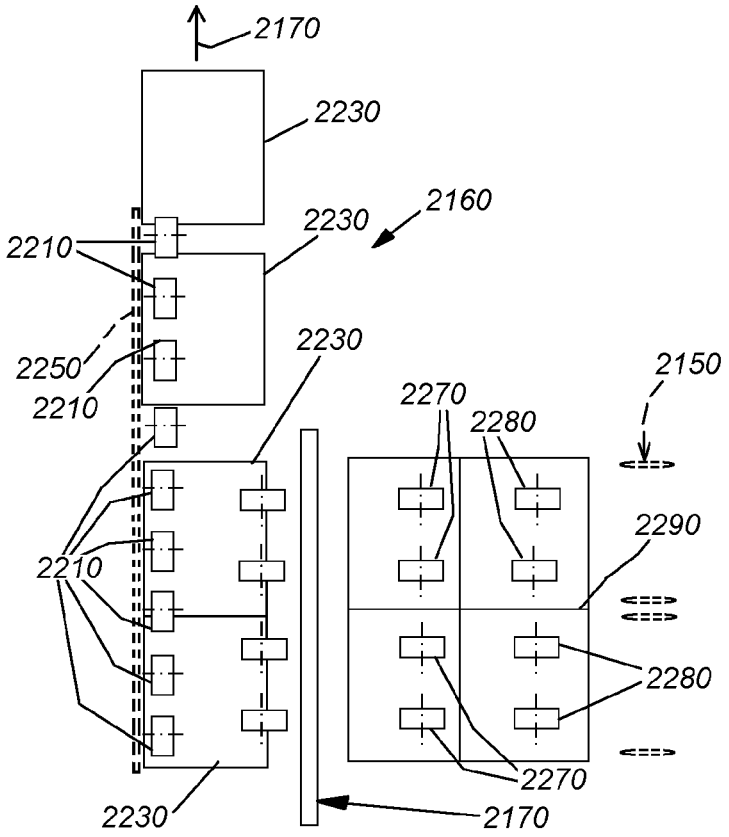
FIG. 22 is a plan view of the divert gate assembly and right-angle merge assembly for use with an inline sheet feeding, cutting, rotating, slitting and stacking system according to an illustrative embodiment.
Figure 23:
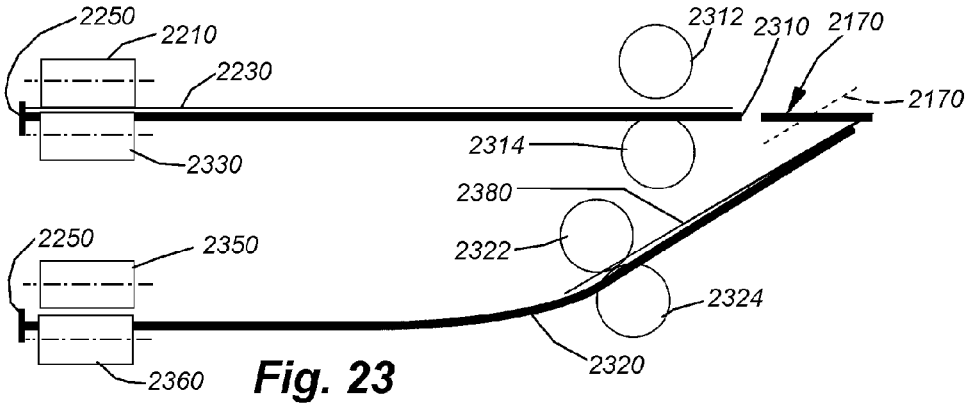
FIG. 23 is a side view of the divert gate assembly and associated feed paths into a two levels of right-angle drives for of the right angle merge assembly of FIG. 22.

In order to maintain a high throughput speed, the right-angle merge assembly 2160 of this invention also includes a divert gate 2170, shown in further detail in FIG. 22. As described above, the right-angle merge assembly generally includes a set of driven, selectively engaged nip rollers 2210 arranged along the right-angle path (arrow 2170 in FIG. 21) that are spaced apart so as to provide continuous engagement and driving to sheets within the various size ranges contemplated herein. The divert gate 2170 is shown further in FIG. 23. It includes an upper feed surface 2310 and a lower feed surface 2320, each of which is served by a pair of decelerating nip rollers 2312, 2314 and 2322, 2324, respectively. The divert gate 2170 moves between a position feeding to the upper feed surface 2310 and the lower feed surface 2320 (the diverted gating position being shown in phantom). The right-angle rollers 2210 form part of the above-described nip that also includes the depicted lower rollers 2330. As described above, at least one element of each pair of confronting rollers 2310 or 2330 can be selectively raised and lowered as each sheet 2230 enters the right-angle merge assembly 2160 so as to engage the right angle guide wall 2250. The lower feed surface 2320 also extends along the right-angle direction (arrow 2170) includes movable upper feed rollers 2350 and lower feed rollers 2360. Note that pairs of upstream feed rollers 2270 and 2280 are provided on opposing sides of the center line 2290 so as to receive sheets from the trimming station 2150, located just upstream of the feed rollers 2270 and 2280. As described above, the rollers are spaced-apart across the widthwise direction so as to selectively engage sheets of varying sizes with at least two separate nips in a widthwise set engaging each sheet (so as to avoid skew, misalignment, etc.).

Referring further to FIG. 21, when a plurality of smaller page-cut sheets are presented to the divert gate, the system controller (799) operates a divert gate so that one set of side-by-side sheets enters the upper feed surface while another, follow-on set of sheets (for example sheet 2360 in FIG. 23 and sheets 2180 and 2182 in FIG. 21) from the second (downstream) slitting station 2150 is presented to the lower feed surface 2320. The use of two levels of feed surface decks allows sheets received at a high-speed from upstream system components to be driven at a corresponding speed in the right-angle direction 2170 to arrive at the stacker 780 in the appropriate page order. The stacking order is maintained by operation of the system controller that can be adapted to read indicia located within the margins of the sheets or otherwise track their location in the overall system feed path. Thus, as shown in FIG. 21, the two-deck, right-angle merge assembly first stacks pages 2 and 3 (sheets 2184 and 2185) over the page 1 (sheet 2186) and then, receiving sheets 2180 and 2182 (pages 4 and 5), directs them through the divert gate 2170 so as to be stacked over the previously stacked pages. An output section adjacent to each of the right-angle feed surface decks 2310 and 2320 can appropriately direct sheets onto the top of the stack as they are driven thereonto. In other words, a further gating assembly at the downstream end of each feed surface 2310 and 2320 can be provided with respect to the stacker to ensure that the sheets are properly stacked. Alternatively, the geometry of the downstream ends of the feed surface decks 2310 and 2320 can be adapted so that sheets entering the stack from either output are appropriately laid upon the stack.

Figure 24:
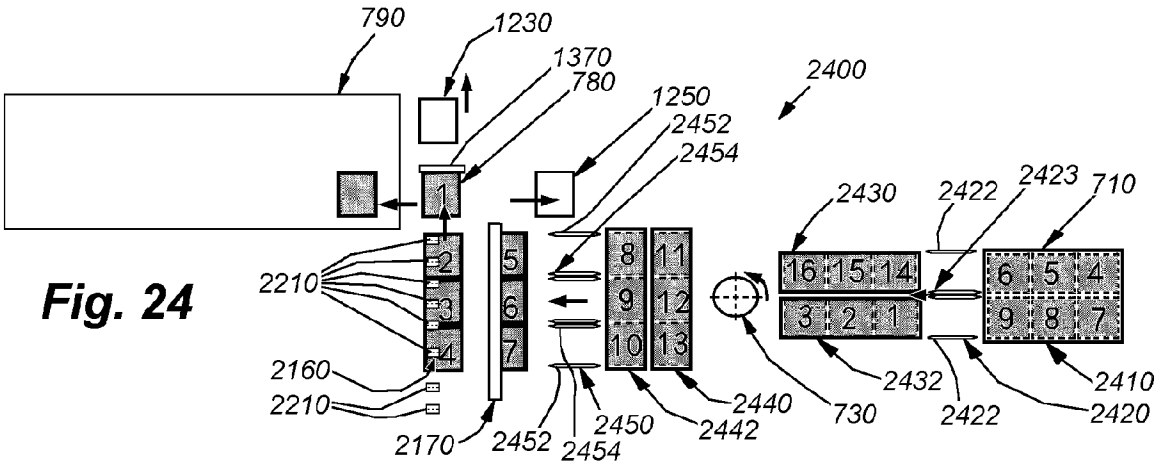
FIG. 24 is a plan view of the operative components of an inline sheet feeding, cutting, rotating, slitting and stacking system according to an illustrative embodiment, arranged in a six-page configuration, and including a divert gate assembly according to FIGS. 22 and 23.

By particularly arranging the number, widthwise location and engagement of slitter wheels in the upstream trimming station and the downstream trimming station of the system, a variety of additional slit page arrangements can be created and stacked in an appropriate order. FIG. 24 shows an arrangement 2400 which provides sheets including six individual page images defined thereon.

The sheet 2410 (herein shown with images of six pages 4-9) is initially received and aligned at the alignment assembly 710. Sheets are then passed through the upstream trimming station 2420 which, in this embodiment includes a pair of out slitter wheels 2422 and a central pair 2423 of inner slitter wheels that divide the sheet 2410 into two separate sheets such as the downstream sheets 2430 and 2432. The sheets 2430 and 2432 each, respectively, define images for pages 14-16 and pages 1-3. The outer edge strips and a central gutter strip have been removed by the upstream trimming station 2420 as shown. The doubled-up nip rollers drive sheets into the rotator section 730, where each of the sheets is engaged firmly when the rotator disks are compressed together. Following disengagement of adjacent nip rollers, the sheets are rotated into a ninety-degree orientation as shown by the downstream rotated sheets 2440 and 2442, which have been driven from the rotator section to a position just upstream of the downstream trimming station 2450 by selectively engaged nip rollers. These sheets are passed into the downstream trimming station 2450, which (in this arrangement) consists of a pair of outer slitter wheels 2452 and two pairs 2454 of double slitter wheels, each arranged to remove gutter strips between individual pages (for example between pages 8, 9 and 10 in sheet 2442, and between pages 11, 12, 13 in sheet 2440). After passing through the downstream trimming station 2450 individual pages, free of margins and gutters are defined as shown. Pages 2, 3 and 4 are passed into the right-angle merge assembly 2160 along the upper deck as shown, while the diverter gate 2170 passes pages 5, 6 and 7 into the lower deck of the right-angle merge assembly 2160. All sheets are delivered in appropriate order by the right-angle rollers 2210 and 2330 (under operation of the controller (799)) from the upper deck into the stack 780 and by the rollers 2350 and 2360 from the lower deck in an appropriate order. Completed stacks are driven down the completed stack conveyor 790 to a subsequent binding or other process. Any rejected stacks or sheets are handled as described above. As in other arrangements, the stack backing surface 1370 is adjusted to accommodate the size of pages so that the completed stack is appropriately aligned with respect to the conveyor 790.

Figure 25:
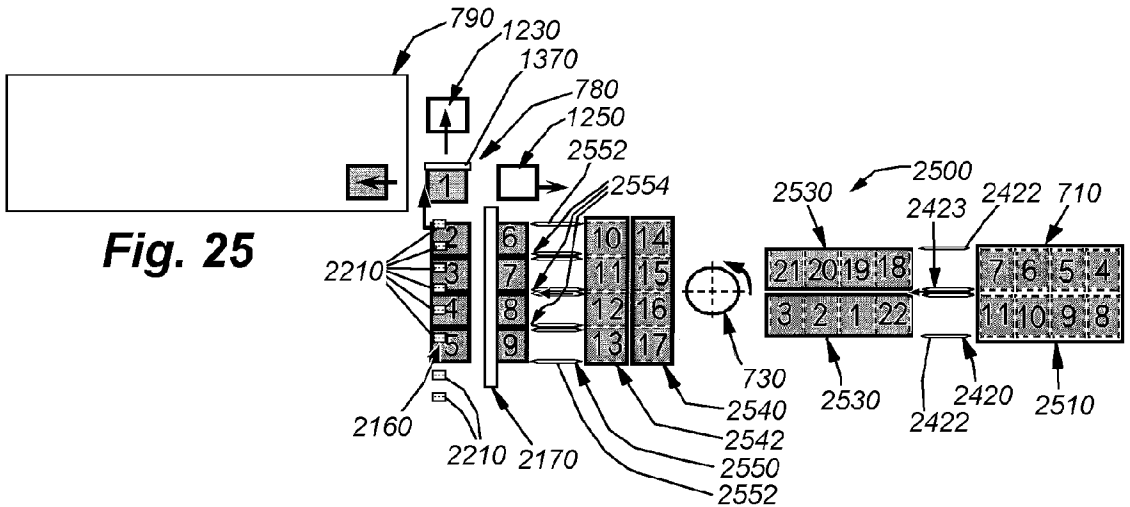
FIG. 25 is a plan view of the operative components of an inline sheet feeding, cutting, rotating, slitting and stacking system according to an illustrative embodiment, arranged in a eight-page configuration, and including a divert gate assembly according to FIGS. 22 and 23.

A further arrangement 2500 of the system is shown in FIG. 25. In this arrangement, a sheet is divided into eight individual pages. The size of each individual page can be 4×6 inches or smaller in an illustrative embodiment. The overall sheet 2510 is initially located at the alignment assembly 710 from a location upstream (such as the printer) as described above. In this arrangement, the sheet 2510 contains exemplary pages 4-11. Sheets are passed through the upstream trimming station 2420, as described above, to create two side-by-side sheets 2530 that are elongated in the upstream-to-downstream direction. In the process, a central gutter strip and the margin strips on either edge have now been removed by the upstream trimming station's slitter wheels. Each of the side-by-side sheets is passed into the rotator section 730 where they are firmly gripped and rotated ninety degrees. The resulting rotated sheets 2540 and 2542 are shown just upstream of the downstream trimming station 2550 after being driven there by adjacent nip rollers. Each slit sheet contains four relatively small individual pages (10-13 for sheet 2542 and pages 14-17 for sheet 2540). These sheets are passed, in turn, through the downstream trimming station which includes a pair of outer slitter wheels 2552 and three pairs 2554 of spaced-apart slitter pairs. After passing through the downstream trimming station 2550, the two sheets are divided into individual, marginless pages, four of which (pages 2-5) are directed by the diverter gate 2170 onto the upper deck, while another four of which (pages 6-9) are placed on the lower deck by the diverter gate 2170. The sheets are stacked by the selectively engaged right-angle rollers (described above) of the two decks of the right-angle merge assembly onto the stack 780 as described above. Completed stacks are driven down the conveyor 790 when appropriate, while rejected sheets and/or stacks are driven to respective locations as described above.

Figure 26:
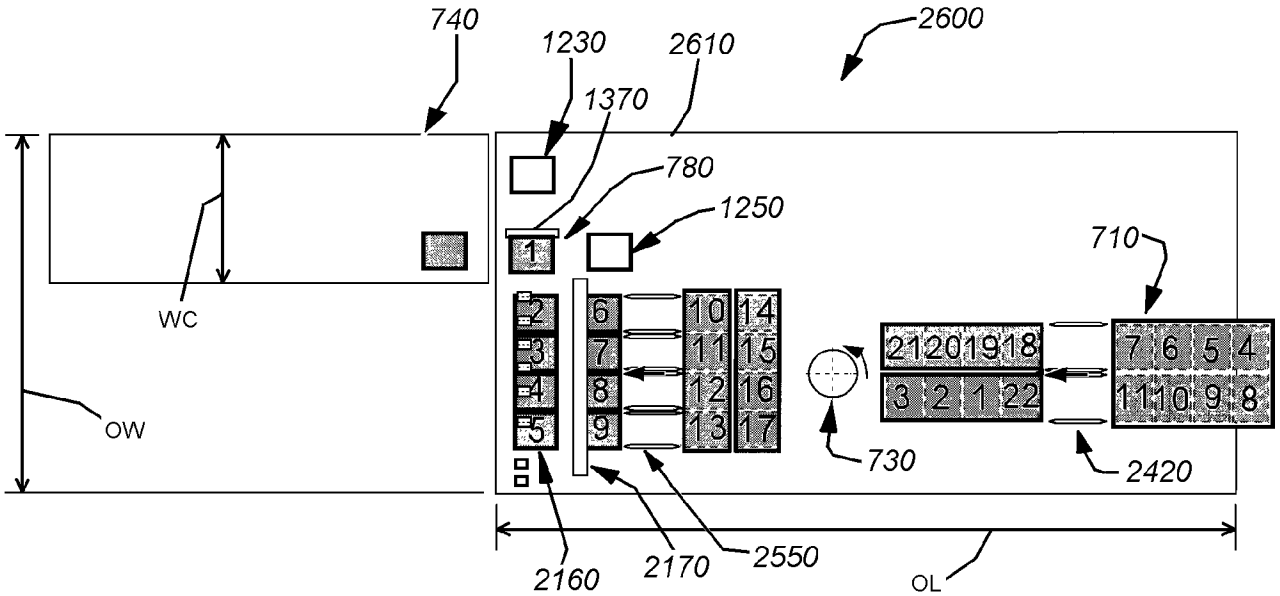
FIG. 26 is a plan view of the overall dimensions of the feed and transport surfaces of an inline sheet feeding, cutting, rotating, slitting and stacking system according to an illustrative embodiment, arranged to handle the exemplary eight-page configuration of FIG. 25.

FIG. 26 shows an overview of the system 2600 according to the various arrangements described above. In an illustrative embodiment the above-described components including the alignment assembly 710, rotator section 730 and right-angle merge assembly 2160 (with diverter gate 2170), as well as the stacker 780 and associated reject locations 1230 and 1250 are contained within a feed surface 2610 having an overall length OL of approximately eight feet (2.5 meters) an and an approximate width OW of three feet (1 meter). The width WC of the conveyor 790 is highly variable. In general, it should be as wide as the widest pages to be delivered from the stacker 780. More generally, it is contemplated that the system 2600 of an illustrative embodiment can handle sheets having a maximum size of approximately 13×19 inch, and typically 11×17 inch. The maximum image size (e.g. page size) is approximately 12.49×18.26 inch. A variety of types and weights of papers (or other printable substrates), both coated and uncoated can be employed. The resultant pages handled by the system can define a variety of sizes. For example, sheets having sizes of 13×13 inches, 12×18 inches, 11×17 inches, 8.5×11 inches, 5.5×8.5 inches, 4×6 inches and/or 6×9 inches can be divided, transported and stacked×as well a variety of custom page dimensions. To generate custom-dimensioned pages, the various slitting elements of the upstream trimming station and the downstream trimming station accordingly adjusted. Typically, a discarded gutter strip between separated pages in a sheet has a size of between approximately 0.197 inch and 2.95 inch (five millimeter to seventy-five millimeter). In an embodiment, the resulting book stacks generated by the stacker 780 can be up to approximately ten inches in height. It should be noted that the backing surface 1370 of the stacker 780 can be adapted to move automatically so as to create an offset between stacked sheets in each book. In an embodiment, a distance of approximately 0.5 inch is generated between book stacks in this embodiment so as to provide a plurality of books or other sections within an overall stack that are delineated by jog offsets therebetween.

II. Optional Components

To assist in the customization of page dimensions, automated operation, and/or ease of use of the system, a variety of optional features can be provided in accordance with alternate embodiments. FIGS. 27-36 describe a plurality of optional features.

Figure 27:
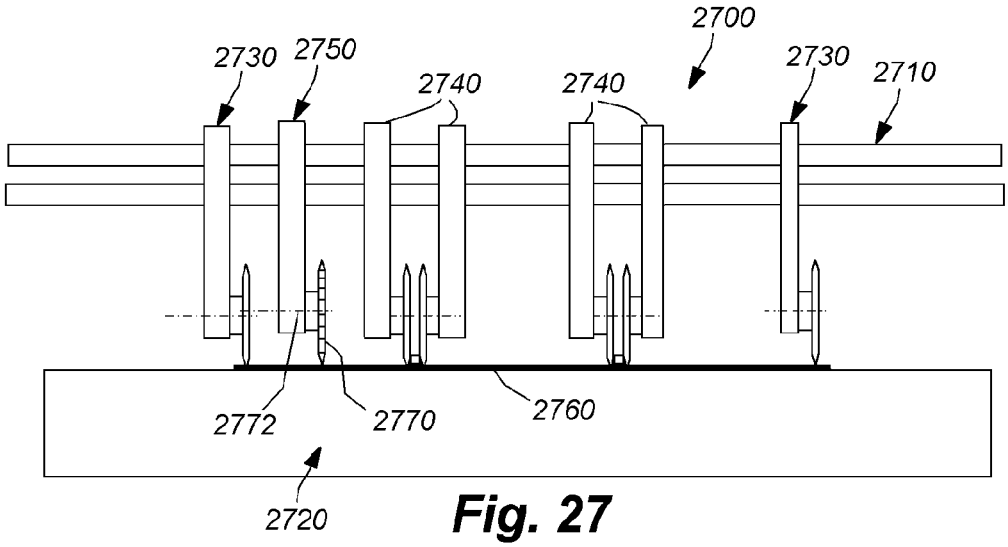
FIG. 27 is a frontal view a plurality of slitter elements including an optional perforation (perf) wheel for use with an inline sheet feeding, cutting, rotating, slitting and stacking system according to an illustrative embodiment.

FIG. 27 shows arrangement 2700 of slitter elements, typically positioned at the above-described downstream trimming station. The slitter element arrangement 2700 includes an overhanging support bar 2710 as described generally above and a hardened roller 2720, as also described above. A pair of outer slitter elements 2730 is provided to remove margin strips and, in this example, two pairs of closely spaced slitter elements 2740 are provided to remove gutter strips between pages. The elements can be actuable as described above or fixed. In addition, at least one perforating slitting element 2750 is provided at a selected location along the support bar 2710 so as to provide a perforated surface to the underlying sheet 2760. The perforating element includes a variation of a slitter wheel 2770 having circumferential breaks in the sharpened surface. As the wheel 2770 rotates on its axis 2772 in response to the rotation of the hardened roller 2720 in association with the sheet's passage in the downstream direction, it provides a perforated cut within the sheet's surface.

Figure 28:
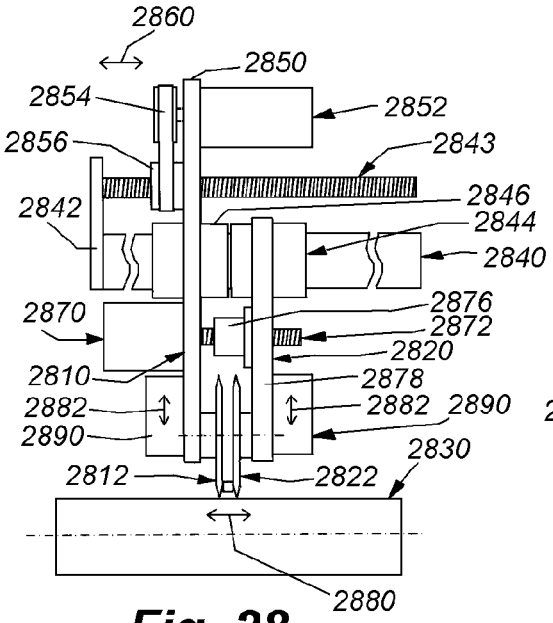
FIG. 28 is a frontal view of a pair of slitter elements for use in slitting a gutter strip between pages on a sheet and including an automated widthwise location-adjustment drive and automated cut-strip spacing-width-adjustment drive for use with an inline sheet feeding, cutting, rotating, slitting and stacking system according to an illustrative embodiment.
Figure 29:
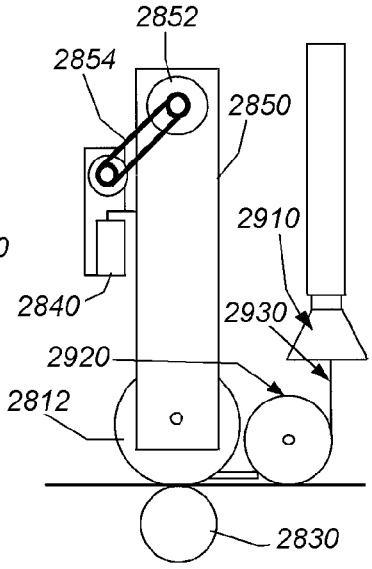
FIG. 29 is a side view of the automated adjustable slitter elements of FIG. 28 including a vacuum strip removal assembly according to an illustrative embodiment.
Figure 30:
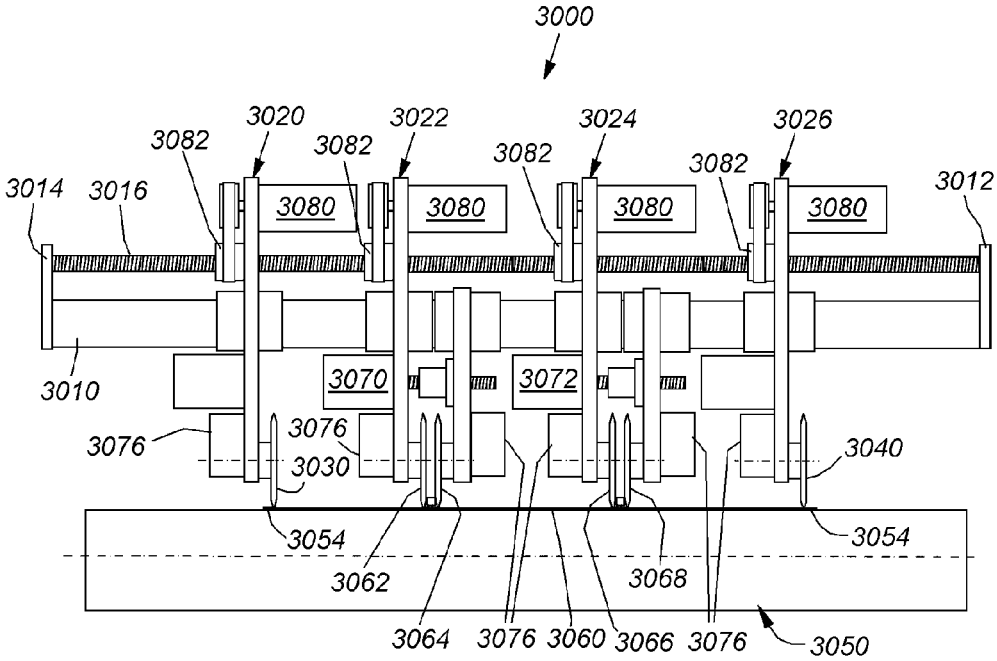
FIG. 30 is a frontal view of a frontal view of a plurality of adjustable slitter elements, including associated widthwise location-adjustment drives and automated cut-strip spacing-width-adjustment drives, for use in a downstream slitting and trimming assembly of an inline sheet feeding, cutting, rotating, slitting and stacking system according to an illustrative embodiment.

With reference now to FIGS. 28-30, it is contemplated that the widthwise movement of slitter elements can be automated, both with respect to the overall width of the feed surface and with respect to each other. FIG. 28 details a pair of widthwise adjustable slitter elements 2810 and 2820, each having an associated slitter blade 2812 and 2822, which are pressurably biased against a hardened roller 2830 as described above. The pair of slitter elements is mounted on an overhanging support bar 2840 of predetermined length. One end of the rod 2840 includes an end plate 2842 upon which is mounted a lead screw 2843. The overall assembly of two slitter elements 2810 and 2820 moves along the bar 2840 based upon a pair of conforming blocks 2844 and 2846 that ride along the bar 2840. One of the blocks 2846 is attached to an extended bracket plate 2850 of the slitter element 2810. A drive motor (e.g. a stepper motor, rotary solenoid, servo, etc.) 2852 drives a belt 2854 (or other transmission, such as a gear train) under operation of the controller that, in turn, rotates a belt-driven, internally threaded hub or nut 2856. The nut 2856 provides for widthwise motion (double arrow 2860) of the overall assembly with respect to the lead screw 2843 and bar 2840. The width/spacing of the individual slitter wheels 2812 and 2822 is adjustable using a second motor 2870 mounted on the bracket plate 2850. This motor drives a second, shorter lead screw 2872 that engages a stationary nut 2876 on the opposing bracket plate 2878 of the slitter element 2820. The rotation of the motor 2870, under operation of the controller, causes the pair of slitter wheels to move toward and away from each other (double arrow 2880). For full automation, both slitter wheels are translatable upwardly and downwardly (double arrows 2282) by interconnected solenoids 2890 or other actuators, so as to provide selectively engageable slitter wheels. Thus, the arrangement of FIG. 28 allows for fully adjustable widthwise positioning and actuation of the slitter wheels 2812 and 2822. Note that the moving and stationary elements can be varied. That is, lead screws can be adapted to rotate while nuts can be stationary with respect to their underlying elements. Likewise, while the lead screw system is used in this embodiment for precision and efficiency, a moving rack system can be substituted in alternate embodiments and/or another linearly driving motor system can be employed.

With further reference to the side view of FIG. 29, the arrangement can include a vacuum port 2910 as described above and a guide wheel 2920 that directs a waste gutter (or margin) strip 2930 through the vacuum port 2910 and to a remote waste-collection site (not shown). Alternate waste-removal assemblies can be provided, such as the above-described waste bin arrangement.

As shown in FIG. 29, the entire trimming station arrangement can be automated so that the system controller (799) can automatically operate on the appropriate sheet size and sheet page-count. As shown, the automated trimming station arrangement 3000 includes a main overlying support bar or guide 3010 having a pair of opposed end plates 3012 and 3014. The end plates 3012, 3014 support a stationary lead screw 3016 upon which each of the individual slitter elements 3020, 3022, 3024 and 3026 ride. The end slitter elements 3020 and 3026 each include a single slitter wheel 3030 and 3040, each biased against the hardened roller 3050 so as to remove margin strips 3052 and 3054 from respective widthwise edges of the underlying sheet 3060. The central assemblies 3020 and 3024 each include a pair of slitter wheels 3062, 3064, 3066 and 3068 that are moveable toward and away from each other as described above under action of secondary drive motors 3070 and 3072, also described above, so as to remove predetermined-width gutter strips between pages. Slitter wheels can be selectively raised out of, or lowered into, engagement with respect to the underlying sheet by a corresponding solenoid or other actuator 3076. Moreover, the slitter elements 3020, 3022, 3024 and 3026 are moveable in the widthwise direction by associated motors 3080 that drive rotating nuts 3082, which ride upon the main lead screw 3016. It should be clear that the arrangement 3000 provides a wide range of adjustability to the downstream slitter station for use with the slitting and rotation system of this invention. A similar arrangement can be provided at the upstream trimming station, optionally employing fewer central slitter elements, as fewer initial slit-sheet sections are typically produced at this location in the process.

Figure 31:
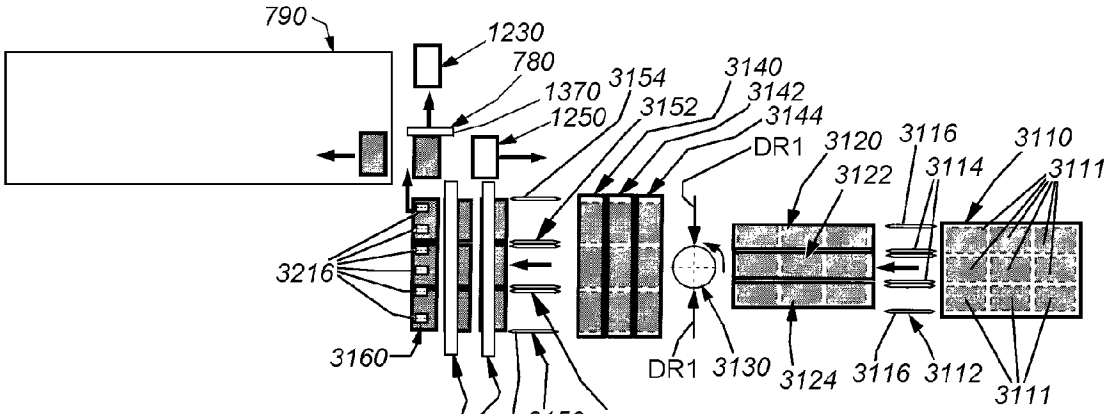
FIG. 31 is a plan view of the operative components of an inline sheet feeding, cutting, rotating, slitting and stacking system according to an illustrative embodiment, arranged in a nine-page configuration including a three-level divert gate assembly operatively interconnected with the right-angle merge assembly.
Figure 32:
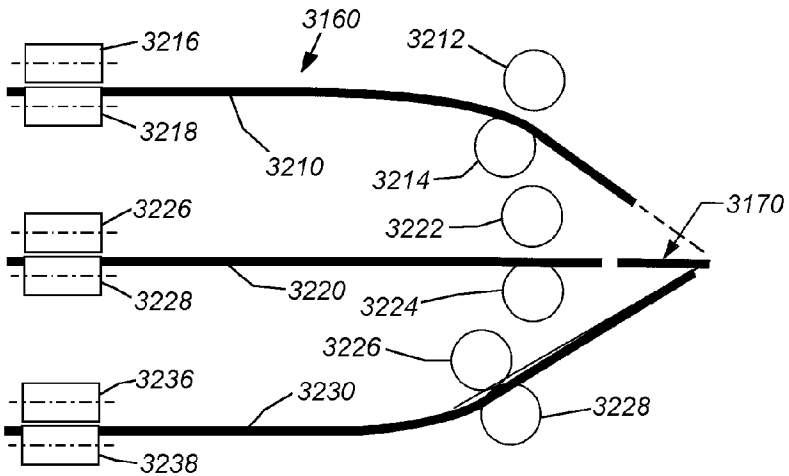
FIG. 32 is a side view of the three-level divert gate assembly and associated feed paths into a three levels of right-angle drives for of the right angle merge assembly of FIG. 31.

It is contemplated that the sheets handled by the system according to an illustrative embodiment can each define a larger number of individual page images by providing components that can accommodate the feed and rotation of the pages in a manner that maintains desired throughput speed. FIGS. 31 and 32 show an arrangement 3100 of the system in a further embodiment in which an initially aligned sheet 3110 includes nine individual, equally sized page images 3111 spaced-apart by appropriately sized gutter strips therebetween. The pages are first directed through an upstream trimming station 3112 with two pairs of central slitter elements 3114 and two outer, margin-edge slitter elements 3116. The trimming process produces the resulting sheets 3120, 3122 and 3124. The rotator 3130 includes a diameter DR1 that is sufficient to grasp all three sets of side-by-side sheets 3120, 3122, and 3124 free of unwanted motion (other than rotation), and thereby rotate the sheets into the rotated orientation as depicted by sheets 3140, 3142 and 3144. These three separated, side-by-side sheets 3140, 3142, and 3144 each include three pages arranged widthwise across the sheet in the rotated orientation. They are passed, in turn, through the downstream trimming station 3150 with associated inner pairs of slitters 3152 and outer slitters 3154 to produce three individual pages from each driven sheet 3140, 3142, 3144. These nine sheets are directed in rows of threes into the right-angle merge assembly 3160 according to this embodiment.

Referring further to FIG. 32, the right-angle merge assembly 3160 includes a dual divert gate system 3170 that directs the sheets to each of three feed surface decks 3210, 3220 and 3230. Each deck 3210, 3220, 3230 is served by a respective pair of decelerating nip rollers 3212, 3214, 3222, 3224, and 3226, 3228. The sets of three-in-a-row sheets are thereby directed into the associated right-angle rollers 3216, 3218, 3226, 3228, 3236 and 3238 for direction, in turn, into the stacker 780 in an appropriate page order (by selective driving of the rollers in each deck by the system controller (799)). As described above, this drive order can be based upon, for example, marks provided in the margins of sheets and/or pages. Note that a variety of communication protocols between upstream and downstream utilization devices and the system controller (799) can be used. In an embodiment, the well known JDF and JMF format can be used to communicate job information and to allow for automatic setup of system components, such as number of slitters, slitter placement, location of stack outer surfaces, operation of the divert gate(s) and the like.

Figure 33:
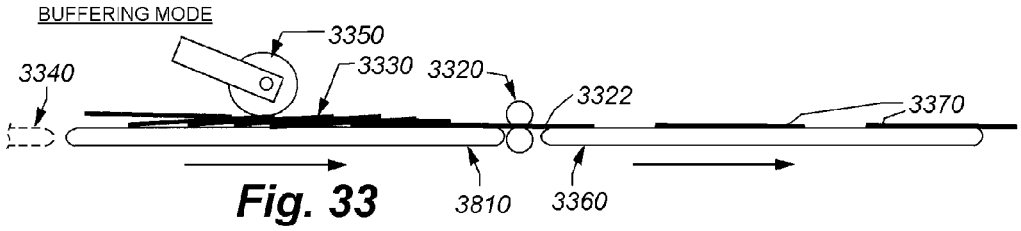
FIG. 33 is a side view of a variable speed conveyor for use with an inline sheet feeding, cutting, rotating, slitting and stacking system according to an illustrative embodiment, shown in a sheet-buffering mode during a change in form size operation.
Figure 34:
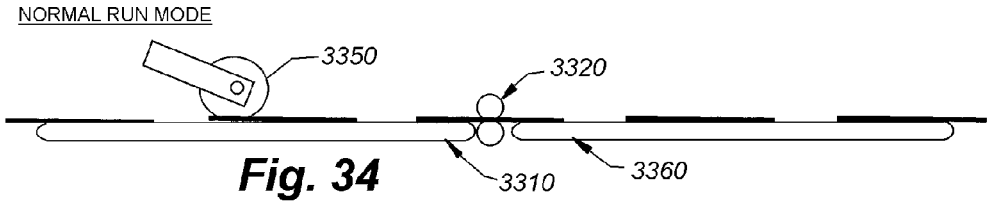
FIG. 34 is a side view of the variable sped conveyor of FIG. 33 shown during a normal run mode, free of the buffering of sheets.

In a case where the print job changes (for example, a change in page or sheet size or number of pages), the system may require time to change its operating parameters. Thus, as shown in FIGS. 33 and 34, the system controller causes one conveyor 3310, located generally upstream of the first trimming station or alignment station, or located at the alignment station, to move at a slower rate, or become stationary. A driving nip roller 3320 maintains an upstream most sheet 3322 in a stationary position while a plurality of downstream sheets 3330 begin to shingle as shown upstream of it along the slowly moving conveyor based upon driving other more upstream conveyor 3340 (shown in phantom). A trolley roller 3350 or other overlying element maintains the integrity of the shingled stream. A faster-moving conveyor 3360 receives sheets 3370 from the nip 3320 when presented, either after a delay, or in at a slower rate due to the slow downstream transfer rate of the conveyor 3340. The faster conveyor 3360 generally operates at the normal system throughput, and transfers any sheets received thereon at that rate. This arrangement allows a gap in sheet delivery to the downstream system components while their settings are changed, but without impacting the delivery of sheets from an upstream process, such as the printer. When normal feed is resumed, the system can be directed to run a higher speed (if possible) until the shingled buffer is exhausted. Alternatively, the buffer continues to feed during any delays in providing new upstream sheets, eventually exhausting the buffer. The system thereby eventually resumes a normal run mode and feed rate as shown in FIG. 34 wherein sheets are delivered in an unshingled manner with both conveyors 3310 and 3360 running at normal speed.

Figure 35:
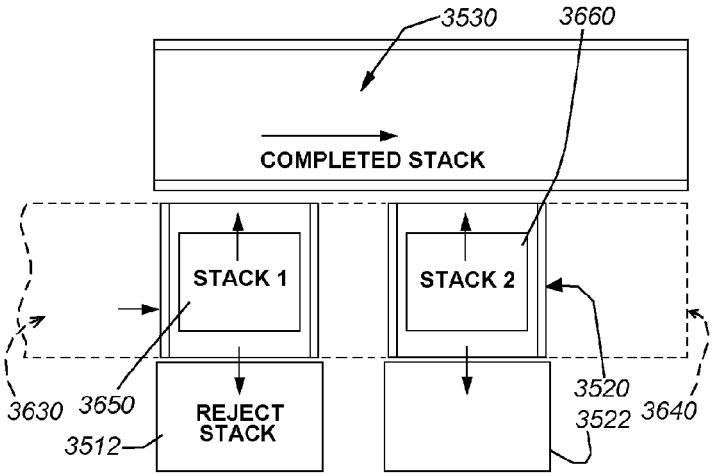
FIG. 35 is a plan view of a side-by-side dual stacker arrangement for use with the output of an inline sheet feeding, cutting, rotating, slitting and stacking system according to an illustrative embodiment.
Figure 36:
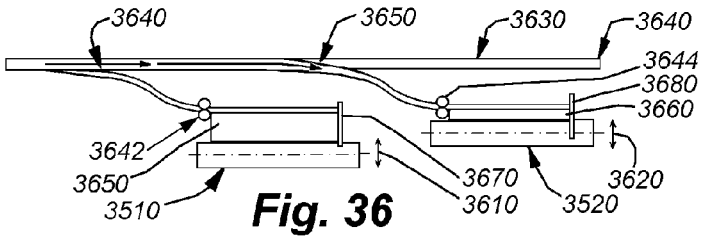
FIG. 36 is a side view of the dual stacker arrangement of FIG. 35.

An additional optional feature for use generally in the system of the illustrative embodiment is shown in FIGS. 35 and 36. Throughput of the system can be improved by providing a pair of side-by-side stackers 3510 and 3520 in association with the completed stack conveyor 3530. With further reference to FIG. 36, each stacker 3510 and 3520 consists of a transverse-oriented conveyor that allows stacks to be moved into an associated reject stack location 3512 and 3522 when appropriate. The conveyor alternately directs stacks onto the completed stack conveyor 3530 when complete. Each conveyor 3510 and 3520 defines an elevator (double arrow 3610 and 3620, respectively). Any reject sheets are directed to the end of the surface 3630 of the conveyor 3530 at a reject sheet location 3640. Each conveyor 3510, 3520 is accessed by a corresponding divert gate 3640 and 3650 that receive sheets from the upstream right-angle merge assembly in accordance with an embodiment of this invention. When completed sheets are directed down the respective divert gate 3640 or 3650, they are driven by a decelerating nip roller pair 3642 and 3644 into the associated stack 3650 and 3660. As each stack grows, the respective conveyor elevator 3610 and 3620 descends. After a stack is transferred by the associated conveyor 3510 or 3520, the elevator moves the conveyor upwardly back into a start position to receive a new stack. A moveable backing wall or backstop 3670 and 3680 is provided, to ensure registration and proper orientation of each stack with respect to the completed stack conveyor 3530. It should be clear that a variety of mechanisms can be employed to create multiple stacks simultaneously. A multiple-stack arrangement has the advantage of allowing one stacker to be reset to an appropriate size (e.g. adjustable movement of the backstop 3670, 3680, and/or ascension of the elevator to a new start position) while another stack continues to form.

IV. Sheet Block-to-Book Block Handling

Figure 37:
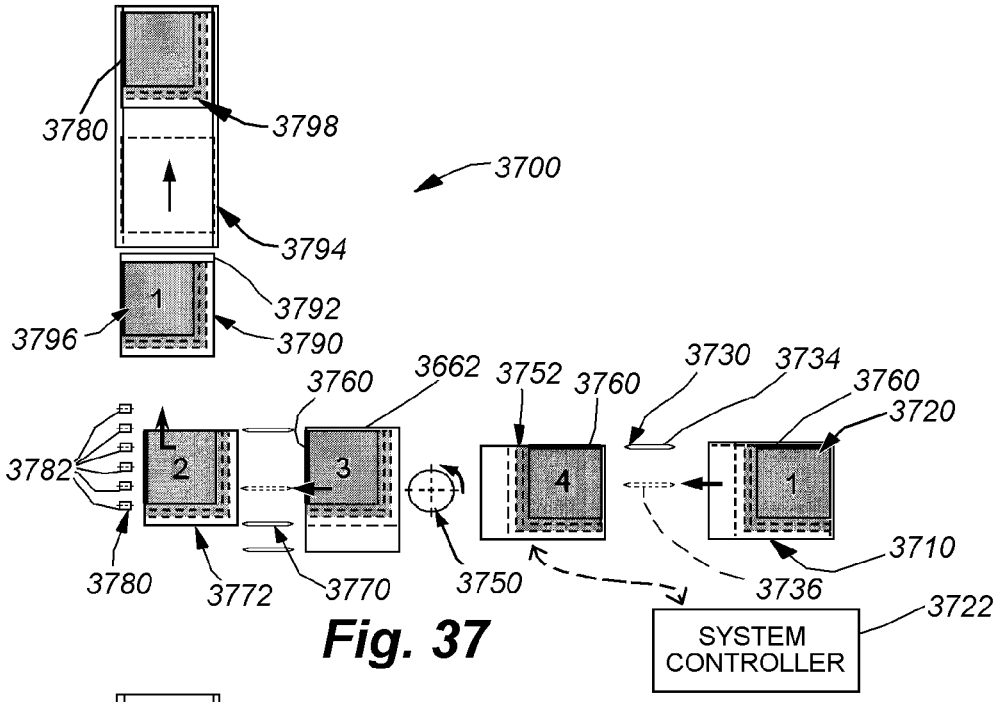
FIG. 37 is a plan view of a system for feeding, cutting, rotating, slitting and stacking of sheet blocks so as to output completed book blocks according to an illustrative embodiment, showing the handling of single-page sheets in a first grain orientation.

FIG. 37 details an arrangement 3700 for a system that de-stacks, slits, rotates, cross-slits merges, restacks and conveys finished book blocks according to an illustrative embodiment. This arrangement can be used in conjunction with an automated book-manufacturing process and system. An exemplary book manufacturing system that can incorporate the illustrative system is commercially available from by C. P. Bourg, Inc. of New Bedford, Mass. under the trademark "Book Factory." This system generates book stacks or sheet stacks for use in downstream slitting, trimming and binding processes. In general, sheet stacks in accordance with this and other systems require significant human interaction through downstream components to achieve a finished book block, ready for the bindery.

Figure 39:
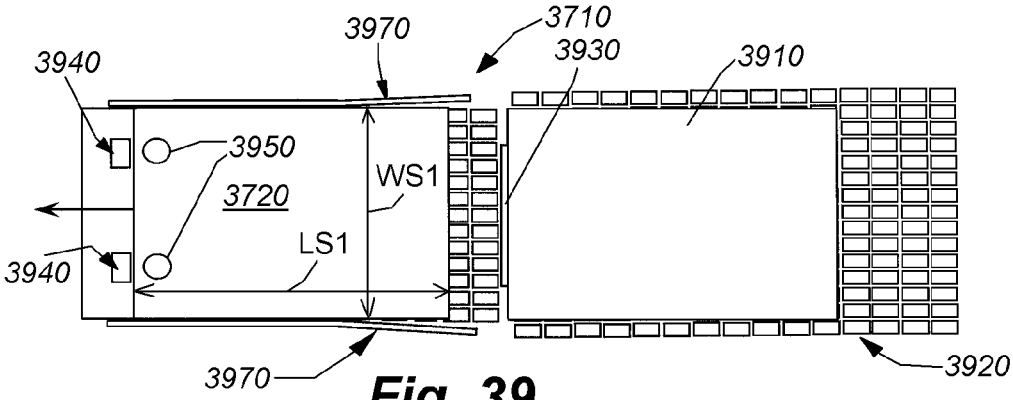
FIG. 39 is a plan view of an exemplary de-stacker for singulating sheets from a sheet stack for input to a system for feeding, cutting, rotating, slitting and stacking of sheet blocks according to an illustrative embodiment.
Figure 40:
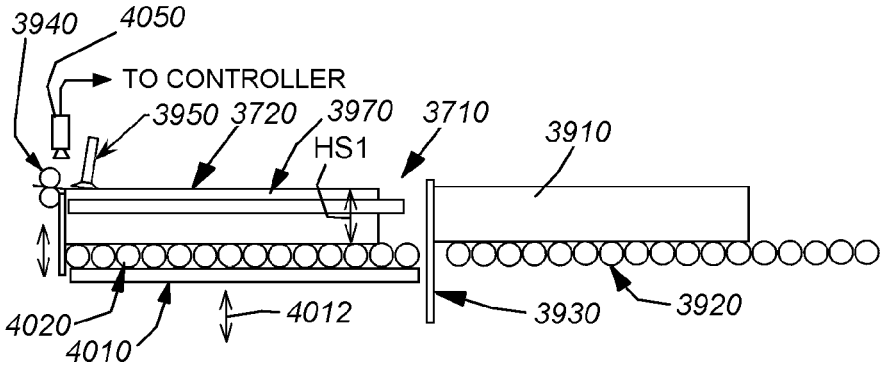
FIG. 40 is a side view of the de-stacker of FIG. 39.

The illustrative system arrangement includes an upstream de-stacker 3710. The de-stacker 3710 is shown in further detail in FIGS. 39 and 40. The de-stacker 3710 receives a sheet stack 3910 from an upstream source that can be part of the larger book printing and biding operation described above. Typically, the sheets in the sheet stack can include one or more page images. In the exemplary arrangement 3700 of FIG. 37, each sheet includes a single page. A single-page sheet having the page image denoted page 1 is shown at the top of the stack 3720, which is being de-stacked in accordance with this embodiment. New stacks wait upstream of the de-stacker mechanism on a conveyor assembly 3920. The new stacks are restrained from entering the de-stacker mechanism by a buffering gate 3930. The buffering gate lowers as each new stack is brought forward into the de-stacking mechanism. The de-stacking mechanism includes an elevator assembly 4010 adapted to move upwardly and downwardly (double arrow 4012) so as to place the top of the stack in alignment with output drive nips 3940 that direct each sheet on the stack 3720 downstream into the arrangement 3700. The elevator 4010 also aligns the stacker mechanism conveyor section 4020 with the upstream conveyor 3920 as each new stack (3910) is brought onto the stacker mechanism after lowering of the buffering gate 3930. In this embodiment, each conveyor 3920 and 4020 can be constructed as a slip-torque "Star" conveyor. Other conveyor mechanisms are expressly contemplated in alternate embodiments. The drive nips 3940, elevator 4010, gate 3930, and other components herein, can be operated via a system controller 3722 that receives sheet parameter and feeding instructions from upstream and downstream utilization devices, as well as user-input control functions. As shown in FIGS. 39 and 40, each top sheet on the stack 3720 is lifted off of the top and directed into the nips 3940 by a vacuum feeder assembly 3950. This is only one exemplary implementation of a singulation device and a variety of alternate singulating mechanisms can be employed. The side edges of the stacking mechanism include guides 3970 that flare outwardly at the upstream end so as to assist in funneling the new stacks into the mechanism in appropriate registration. These guides can be adjustable for width so as to accommodate varying-width stacks. In this embodiment, the stack width WS1 is approximately 322 millimeters while the stack length LS1 is approximately 460 millimeters. The stack height HS1 is approximately up to 100 millimeters. These measurements are only exemplary of a variety of possible measurement for stacks and sheets therein. In this embodiment, the short edge of the stack is fed first from the stacker 3720. In alternate embodiments, a long edge can be fed first.

As described above, the stacker 3710 includes, in line therewith, a barcode or similar ID reader 4050 (FIG. 40) operatively connected to the system controller 3722. The barcode reader detects and decodes information printed on the margins of sheets it the stack to allow for tracking of sheets as well as automatic setup of downstream system operations.

Referring further to FIG. 37, once each sheet is singulated from the stack 3720 it is directed through a trimming station 3730 with a slitter arrangement that can be similar to, or identical to that described in reference to FIGS. 15 and 17 above (or another embodiment described herein). The slitter wheel 3734 removes a side margin edge of each sheet. Note that the sheets are shown with a series of dashed lines around at least two edges. These depict the possible alternate sizes for the sheets in a stack. Once one margin edge is trimmed by the slitter assembly 3730, and the trim waste is removed, the sheets move into a position upstream of the rotator 3750 as shown by page 4 or sheet 3752. In this illustrative embodiment, the system employs a guide edge and one other adjacent (right-angle) registration edge.

Edge-trimmed sheets are driven into the rotator section 3750, and rotated as shown so as to place the registration (or binding) edge 3760 in a downsteammost orientation. Thus, the downstream edge 3762 is then located in a side-oriented position. Each sheet is then passed through the downstream trimming station 3770 where it is trimmed into a final sheet shape (sheet 3772). The sheet is then passed into the right-angle merge assembly 3780, and driven downstream to a stacker assembly 3790 as described above. Rejected sheets pass through a divert gate 3792 into an upwardly positioned reject area 3794, while non-defective sheets form in the resulting completed book block stack 3796. Completed stacks, in book block form, are output to a downstream location 3798. The completed stack can be provided with a book cover over which the book is stacked in alternate embodiments. Note that one of the two registration edges can be the eventual book spine, and is maintained throughout the process. This edge is oriented in the book stack so that a post-processing "three-knife" trimmer (not shown) eventually trims the other three exposed edges of the book to a final size and rectilinear geometry.

Figure 38:
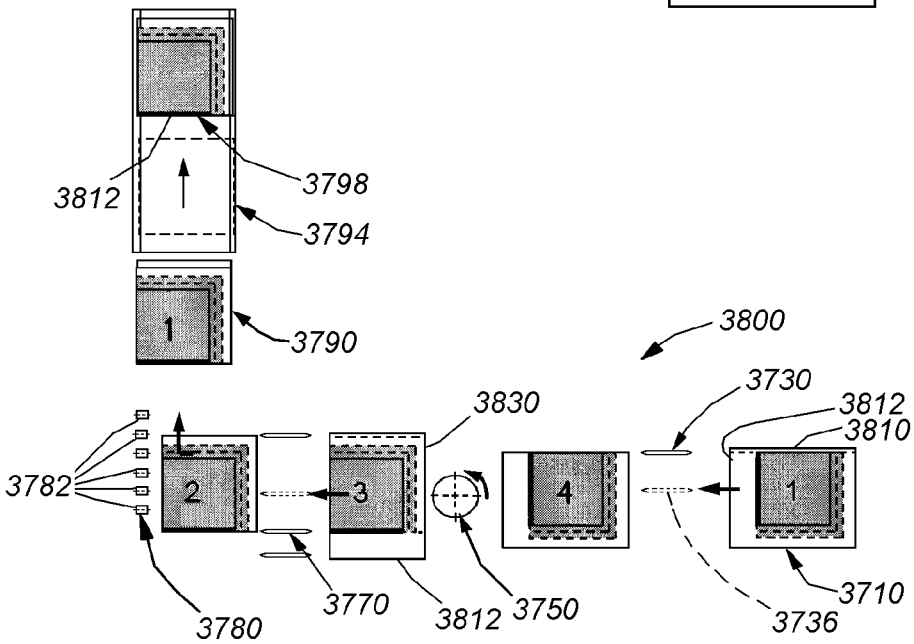
FIG. 38 is a plan view of a system for feeding, cutting, rotating, slitting and stacking of sheet blocks of FIG. 37, showing the handling of single-page sheets in a second grain orientation.

Reference is further made to the arrangement 3800, as shown in FIG. 38, in which sheets similar size, but with an opposing orientation (based, for example, upon the prevailing paper grain direction) are fed from the stacker 3710. In view of this differing orientation, the rotation of the sheets to define registration edges is different. In this arrangement, the exemplary sheet 3810 (denoted as page 1 in a single-page sheet) is again passed through the trimming station 3730 so as to be presented to the rotator 3750. The sheet 3810 is rotated into the orientation of sheet 3830 and then passed into the right-angle merge assembly 3780. It is then directed into the stacker 3790 and handled as described above. In this arrangement, the binding edge 3812 faces downstream at the de-stacker 3710. The rotation section 3750 places this edge at the downstream side of the sheet as it enters the stacker assembly 3790, rather that the side, as in the arrangement of FIG. 37.

Figure 41:
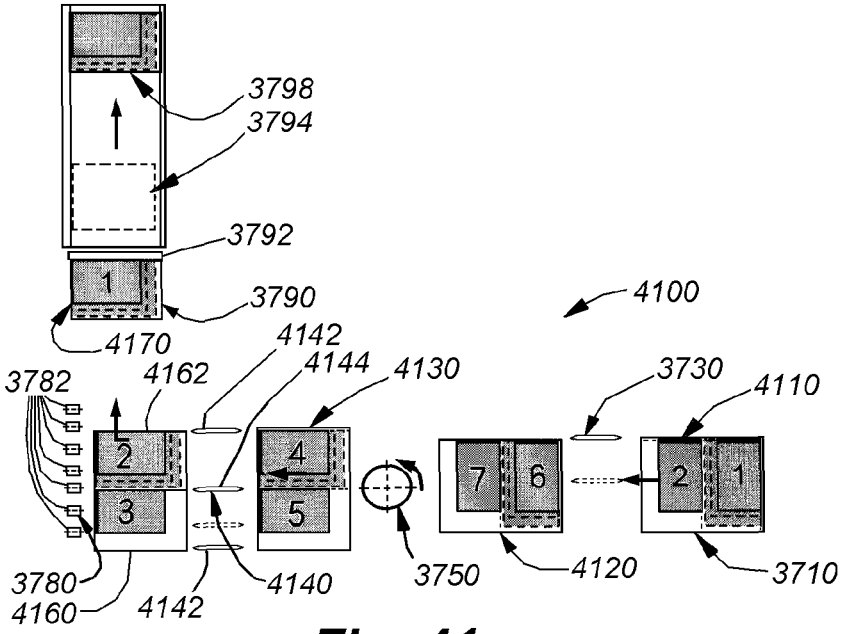
FIG. 41 is a plan view of a system for feeding, cutting, rotating, slitting and stacking of sheet blocks so as to output completed book blocks according to an illustrative embodiment, showing the handling of two-page sheets in a first grain orientation.

FIG. 41 shows an arrangement 4100 in which each of the sheets on a stack includes at least two page images. Again, various sizes available for sheets and pages are represented by a series of nested dashed lines. The sheet 4110 is initially singulated from the stacker 3710 and an edge is directed through the first trimming station to produce a trimmed sheet 4120 with a registration edge. The edge-trimmed sheet 4120 is then directed to the rotator section 3750 where it is rotated to produce a rotated sheet 4130 as shown. The pages (pages 4 and 5 in this example) are now oriented with the separation line parallel to the downstream direction so as to pass through the trim assembly 4140, which in this embodiment, includes two outer slitter elements 4142 and a central slitter element 4144. The outer slitter elements 4142 trim the excess from the side margins while the central element 4140 slits the sheet into two separated page sheets 4160 and 4162 as shown. The two separated sheets 4160, 4162 enter the right-angle merge assembly 3780, and are then driven the stacker 3790 to be placed upon the stack 4170 in appropriate page order. As described above, any rejected sheets are directed to the directed sheet section 3794 via the divert gate 3792 while completed book blocks are directed to the completed book section 3798.

Figure 42:
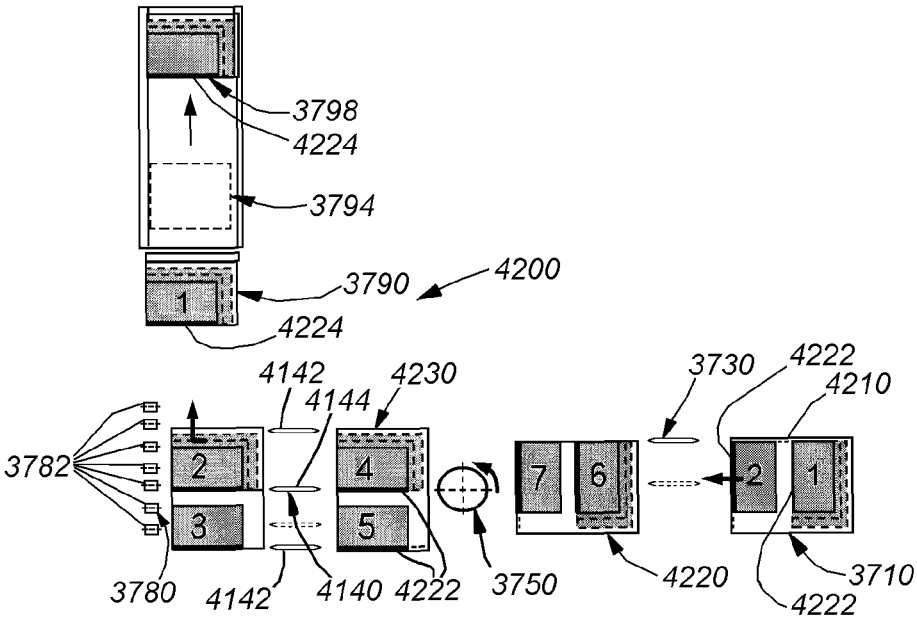
FIG. 42 is a plan view of a system for feeding, cutting, rotating, slitting and stacking of sheet blocks of FIG. 41, showing the handling of two-page sheets in a second grain orientation.

With reference now to FIG. 42, an further arrangement 4200 relative to the above-described system arrangement 4100 (FIG. 41) allows for slitting and stacking of sheets having a different orientation (based on grain direction, for example) than those in FIG. 41. Sheet 4210 is first singulated from the stacker 3710 and passed through the first, upstream trimming station 3730. It is then presented as sheet 4220 to the rotator and then rotated by the rotator 3750. As shown more clearly by the smaller, nested sheet representations, a the binding edge 4222 of each page now faces forward in the stack in accordance with the differing grain direction/orientation. When rotated, this edge will eventually reside at the downstream end 4224 of the stack, rather than the side (as in the arrangement 4100 of FIG. 41. As shown, the rotated sheet 4230 is then presented to the downstream trimming station 4140. It passes through the trimming station 4140 so as to remove the sheet's outer margins using the outer slitter elements 4142, while separating the sheet separated into side-by-side pages using the central slitter 4144. The resulting separated sheets (page 2 and 3 in this example) are directed by the right-angle merge assembly 3780 into the stacker 3790 as described generally above.

It should be clear that the sheet block-to-book block system according the illustrative embodiment allows for wide variability between book sizes on a book-to-book basis. Typically, the system is adapted to register on a single edge, which can be the biding edge. Likewise, the other edge, adjacent to the binding edge is a further reference edge. The binding/registration edge, once formed by the initial trimming process remains untrimmed until the completion of the stacking process. At binding time, a three-knife trimmer (not shown) cuts the book block to final size and geometry.

The system is adapted operate at a high speed allowing for a single deck at the right-angle merge assembly 3780. In alternate embodiments, a diverter can be employed where appropriate. In the illustrative embodiment, and as described generally above, the timing of sheet-passage though the right-angle merge assembly is closely controlled. An upstream sheet passes into the merge assembly just as a more downstream sheet moves sufficiently out of its way to essentially allow the sheets to shingle with respect to each other. As the upstream sheet reaches the merge assembly guide wall, the downstream sheet has exited the overlapping right-angle nip rollers 3782, thereby allowing the nips to be lifted to allow passage of a new sheet thereunder and then become gripped by the nips. More-downstream, right-angle nip rollers 3782 continue to engage the exiting downstream sheet as it passes onto the stacker.

The timing of roller actuation at any stage along the system feed path is controlled by the system controller 3722 based upon either mathematical motion equations or a lookup table, each of which use the size of individual sheets and pages as parameters to determine the timing of roller actuation.

Figure 43:
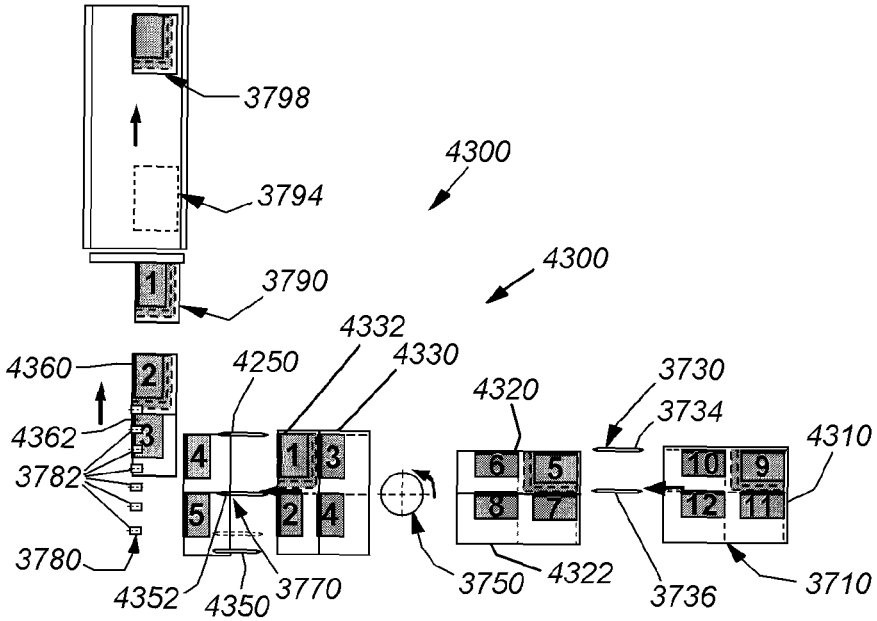
FIG. 43 is a plan view of a system for feeding, cutting, rotating, slitting and stacking of sheet blocks so as to output completed book blocks according to an illustrative embodiment, showing the handling of four-page sheets in a first grain orientation.

With reference now to FIG. 43, a sheet 4310 containing four pages as shown is singulated from the stacker 3710, and passed through the upstream trimming station 3730 which includes a registration edge-slitter element/wheel 3734 and a central slitter element/wheel 3736. The central slitter 3736 generates a pair of separated sheets 4320 and 4322, each containing a pair of the pages in an upstream-to-downstream orientation. These sheets are grasped together in a side-by-side relationship by the rotator section 3750, and rotated 90 degrees so as to define rotated sheets 4330 and 4332. This sheet pair is, in turn, driven by the system's selectively actuated nip rollers through the downstream trimming station 3770 which includes a pair of margin slitter elements/wheels 4350 and a central slitter element/wheel 4352. The resulting four separated sheets are driven side-by-side pairs, one-pair-at-a-time, into the right-angle merge assembly 3780. As discussed, above, as one set of sheets exits the downstream rollers 3782 in the right-angle merge assembly 3782, the next set of sheets is already entering, and therefore arrives at the lifted nip of the rollers 3782 just in time to be grasped again by the nip of the right-angle rollers 3782. The right-angle driven sheets 4360 and 4362 are driven onto the stack 3790 as shown.

Figure 45:
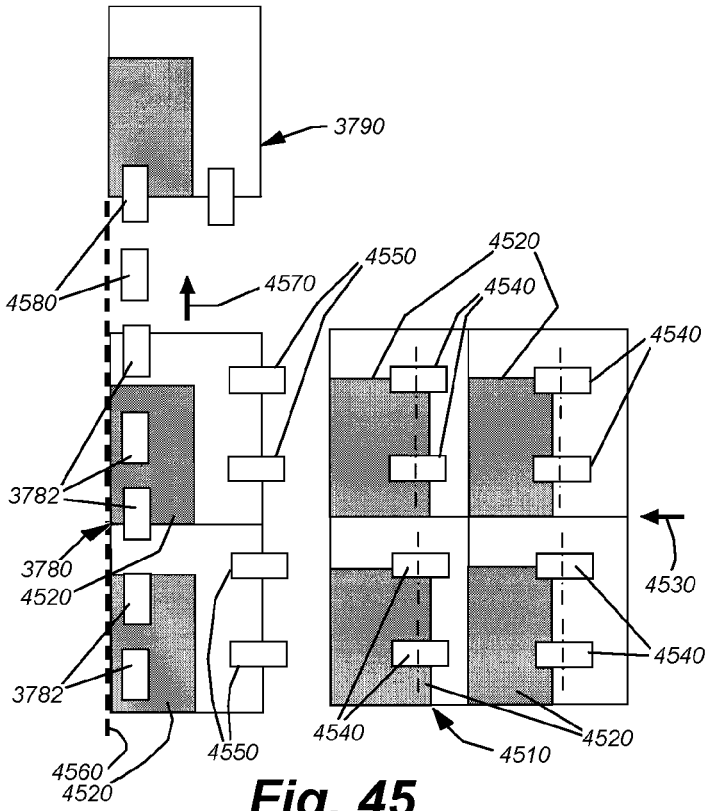
FIG. 45 is a plan view of a right-angle merge assembly for use with a system for feeding, cutting, rotating, slitting and stacking of sheet blocks according to an illustrative embodiment.

Reference is now made to FIG. 45 that shows the input section 4510 and adjacent right-angle merge assembly 3780 along with the stacker 3790. In this example, a "four-up" arrangement (e.g. four page images per sheet) of sheets 4520 has exited the downstream trimming station, and is being directed to the stacker 3790. Because the sheets are oriented with their narrow direction in the upstream-to-downstream direction (arrow 4530), the sheets can be more rapidly directed into the right-angle merge assembly 3780 without a need for a diverter to buffer page sheets for proper stack-ordering as employed in the above-described embodiments. The rollers 4540 selectively operate to drive the sheets downstream into the right-angle merge assembly 3780 where they are passed through the downstream-directed (arrow 4530) nip rollers 4550, and thereafter into the solenoid-actuated right-angle nip rollers 3782. The spacing of the rollers 4540, 4550 and 3782 along the feed path (with respect to each other) is such that each driven sheet (within the predetermined size range) is continuously within the grasp of at least one pair of rollers as it moves from one position to another along the feed path. This defines at least two spatially remote contact points, which prevents skew and misalignment during driving. As sheets reach the right-angle nip rollers 3782 they contact a guide wall or rail 4560 disposed along the right-angle direction, as described hereinabove. After sheets contact the wall 4560, the overlapping right-angle rollers 3782 are selectively actuated to engage the arriving sheet, the upstream delivering rollers (4550, etc.) are disengaged, and the sheet is then driven in the right-angle direction (arrow 4570). The roller-to-roller spacing of the right-angle rollers 3782 is sufficient to maintain continuous engagement of sheets as they are driven along the right-angle direction to the stacker 3790. Note that the right angle rollers 3782 (in any of the right-angle merge assemblies described herein) can define a slightly angular cant, similar to the alignment station rollers described above, so as to maintain sheets in registration with the guide wall 4560, as they pass downstream into the stacker 3790. As the sheets near the stacker, a final pair of outfeed rollers 4580 direct sheets into the stack from the right-angle surface. These rollers 4580 can include appropriate decelerating nip rollers.

As discussed above, the rollers 4540 and 4550 direct new sheets from upstream in a somewhat shingled relationship with respect to the downstream, right-angle directed sheets with the right-angle rollers 3782 disengaging just-in-time for the downstream sheets to exit the rollers 3782 without losing engagement, but in time to allow the right-angle nip rollers 3782 to be disengaged for entry of the new upstream sheets.

Figure 44:
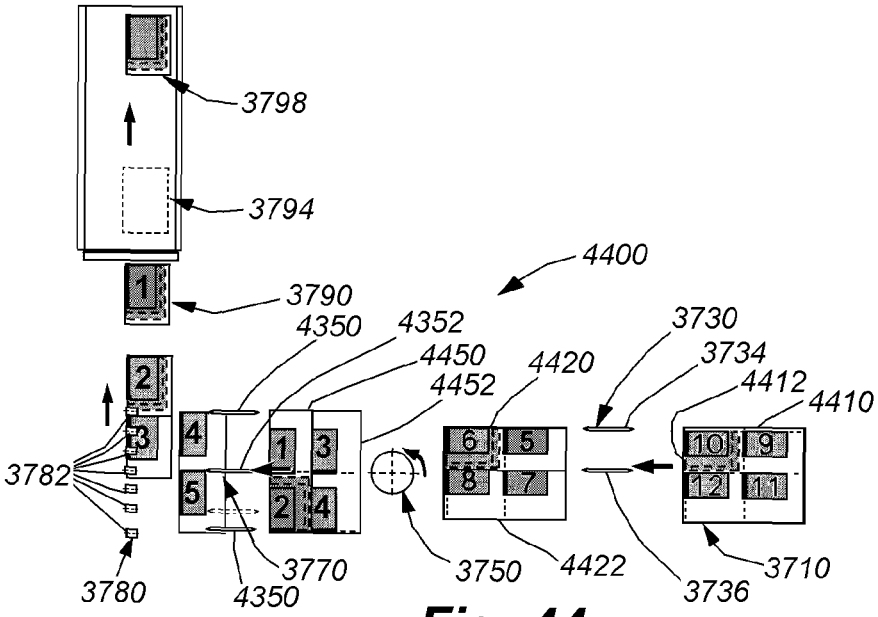
FIG. 44 is a plan view of a system for feeding, cutting, rotating, slitting and stacking of sheet blocks of FIG. 43, showing the handling of four-page sheets in a second grain orientation.

With brief reference to FIG. 44, the feeding of sheets in a second (grain) orientation is shown and described using the arrangement of FIG. 4300. In this alternate grain arrangement 4400, a sheet 4410 is oriented as shown, with a downstream-located binding edge 4412. The sheet is passed through the upstream trimming station 3730 where it is separated into a pair of side-by-side sheets 4420 and 4422, each containing two upstream-to-downstream pages. The sheet pair is then grasped collectively and rotated 90 degrees as shown to generate the depicted rotated sheets 4450 and 4452. These sheets are passed one-at-a-time through the downstream section 3770 to be again separated and passed into the right-angle-merge assembly 3780, in turn.

Figure 46:
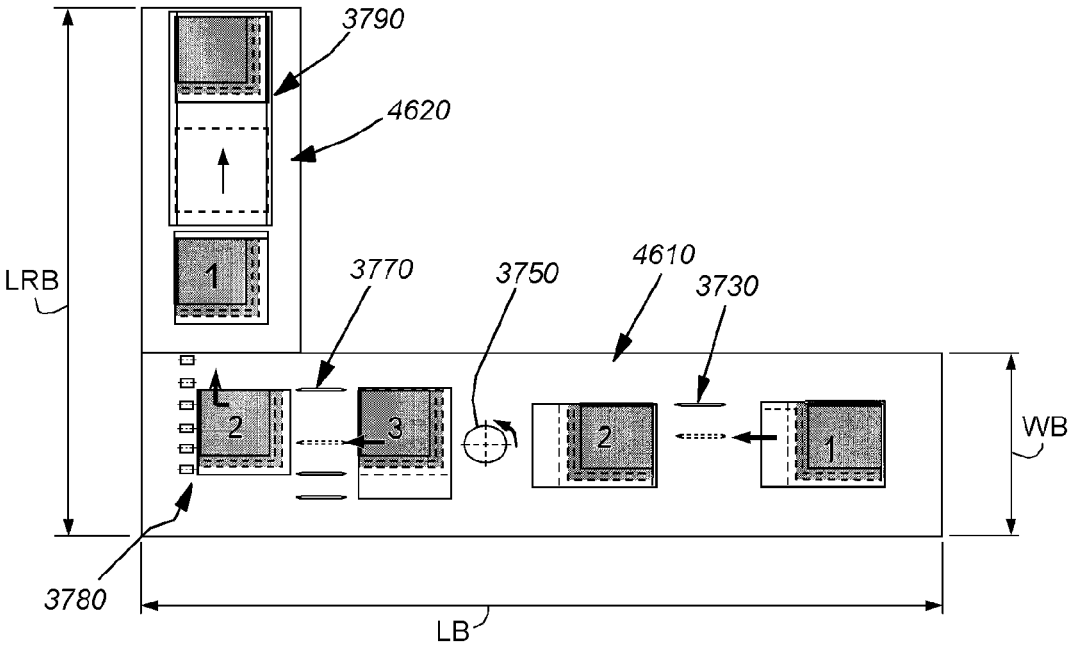
FIG. 46 is a plan view of the overall dimensions of the feed and transport surfaces of a system for feeding, cutting, rotating, slitting and stacking of sheet blocks so as to output completed book blocks according to an illustrative embodiment.

FIG. 46 is a plan view showing the general dimensions of the sheet block-to-book block system according to the illustrative embodiment. As shown, the main downstream feed surface 4610—including the first, upstream trimming station 3730 rotator section 3750, second, downstream trimming station 3770, and right-angle merge assembly 3780—has approximate width WB of approximately 3 feet or 1 meter. The overall length LB of the surface 4610 is approximately 13 feet or 4 meters. The overall length LRB of the right-angle merge assembly 3780 and stacker/conveyor section 4620 is approximately 8 feet or 2.5 meters. These dimensions are highly variable in alternate embodiments.

Figure 47:
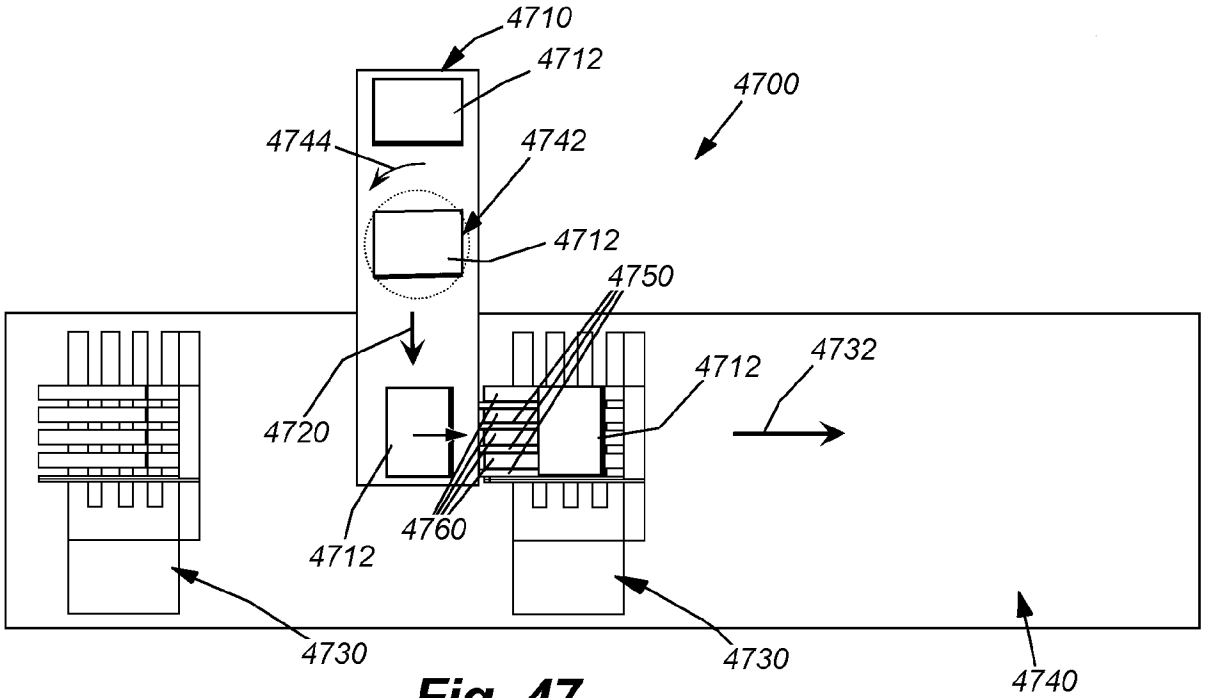
FIG. 47 is a plan view of an automated book-block-carrier loader for use with a system for feeding, cutting, rotating, slitting and stacking of sheet blocks so as to output completed book blocks according to an illustrative embodiment.

It is contemplated that a variety of additional peripherals and/or optional features and functions can be provided to this system in accordance with an illustrative embodiment. Thus, FIG. 47 details a conveyor system 4700 in which a completed stack conveyor 4710 (adapted for used with any of the embodiments herein, or with a different system) delivers stacks 4712 in a downstream direction (arrow 4720) to each of a plurality of conventional stack carriers 4730 that each move (arrow 4732) along a carrier conveyor 4740, in turn, into a position adjacent to the completed stack conveyor 4710. The completed stack conveyor 4710 can include a rotator assembly 4742 that reorients the stack as shown (curved arrow 4744) to be properly oriented for receipt on the adjacently positioned carrier 4730. The carrier is used to ferry the stack to a trimming and/or binding operation as appropriate. It consist of a set of slats 4760 with spaces therebetween that allow the book to be lifted by tines placed between the slates at various stages of the book production process—such as binding. The carrier can include, deposited thereon a book binding over which the stack is placed (optionally). A set of conveyor belts pass through the carrier slats 4760 as the carrier moves with respect to the completed stack conveyor 4710. The belts 4750 raise and lower as appropriate, thereby allowing each stack 4710 to pass onto the carrier, and then rest upon the slats 4760 as the conveyors descend beneath the slats, freeing them from interference with the carrier, and thereby allowing the carrier 4730 to move away from the completed stack conveyor 4710 in the feed direction (arrow 4732). Control of the conveyor can be by accommodated a separate conveyor controller, or by the overall system controller as appropriate. Stacks can be detected by optical tracking or another appropriate mechanism (for example encoders provided on conveyors, timed to the movement of stacks). Once loaded, each carrier moves along the carrier conveyor 4740 to a downstream location that can be a post-production site (e.g. a binding operation, boxing, etc.), or an off-loading point where workers manually manipulate the carrier into a downstream production process.

V. Edgeless Feeding, Trimming, Separating, Merging and Stacking

Figure 48:
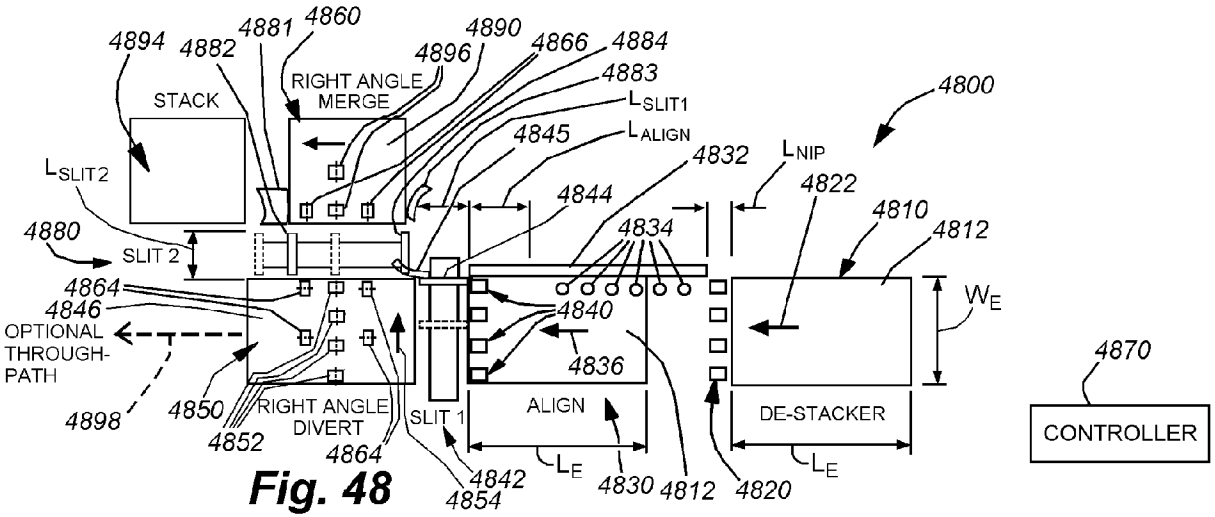
FIG. 48 is a plan view of the operative components of an inline sheet feeding, cutting, rotating, slitting and stacking system according to another illustrative embodiment, arranged in a one-page configuration.

The above-described systems are typically adapted to feed sheets relative to one more reference edges, although, as described above, edgeless feeding can be implemented by providing appropriate continuous grasping and driving of sheets in accordance with the general principles of this invention. FIG. 48 depicts system and method 4800 for feeding, trimming, separating, merging and separating, and stacking sheets into a book that operates according to an edgeless implementation. That is, the merge assembly operates free of a downstream edge-guide or rail, and the system performs cross-separation and slitting of sheets downstream of the right-angle (or other angle/direction) merge assembly thereby allowing omission of the above-described rotator.

The system 4800 includes a destacker 4810 (or another source of a stream of sheets) that presents sheets (4812) having an exemplary length LE of 19 inches and an exemplary width WE of 13 inches to the drive nip assembly 4820, which, in this example, drives sheets downstream (arrow 4822) at approximately 4 sheets per second. These dimensions and speeds, as well as others described herein, are only exemplary and a variety of operating parameters and dimensions can be substituted in alternate implementations. The depicted nip length $L_{nip}$ is approximately 5.0 inches in this embodiment. The sheets 4812 are directed into a first alignment station 4830, wherein their respective side edges are driven against a side guide rail 4832 by a plurality of conventional justifier drive elements (for example an angled belt unit(s) or rotating disk and ball assemblies) 4834. The justifier elements 4834 drive each sheet downstream (arrow 4836) in registration with the guide rail 4832, and into nips 4840 just upstream of the first trimming or slitting section 4842. The sheets pass through a slitter element 4844 that removes one gutter edge 4845 from the sheet 4812. The length $L_{slit1}$ of the first trimming section 4842 is approximately 5.0 inches, and sheets pass therethrough at an exemplary rate of approximately 0.340 sec./sheet. The sheets now define a desired width. Additional slitter elements can be provided across the width of the section 4842 as described below. Each trimmed sheet 4846 is then passed into the right-angle divert assembly 4850.

The right-angle divert assembly receives trimmed sheets 4846 at a set of downstream-driving nips 4852 that are selectively engageable and disengageable with respect to sheets. The nips drive sheets into an appropriate alignment with respect to the right-angle feed path (arrow 4854), which allows direction of each of the sheets into the right-angle merge assembly 4860. Sheets are directed into the merge assembly 4860 by selectively engageable, driven right-angle nips 4864 within the divert assembly 4850, and nips 4866 within the merge assembly 4860. In a manner described above, the system controller 4870 controls the driving and engagement of each set of nips 4852, 4864, 4866 (and other drive components) so that each sheet is continuously gripped by at leas one pair of spaced-apart nips at all times, while other nips are disengaged to allow movement in alternate directions. In other words, nips 4852 receive and engage each sheet 4846 directed from the upstream trimming nips 4840. The sheet is continuously engaged by nips 4852 and nips 4852 in an overlapping manner so that the sheet remains at a known and engaged position free of misalignment and/or skew. Right-angle nips 4864 then variously (or together) engage the sheet 4846 (with an exemplary lift/drop time for each nip of approximately 0.025 sec.) and then the nips 4852 disengage to prevent interference with right-angle movement of the sheet. The sheet is then driven in the right angle direction through the engaged right-angle nips 4864, and into the nips 4866. At least one pair of nips 4864, 4866 maintains engagement with the sheet at all times to prevent skew and misalignment.

As the sheet 4846 is driven by nips 4864 toward the nips 4866 in the right-angle merge assembly, the sheet passes through the second, right-angle slitter assembly 4880, where opposing gutter strips 4881 and 4883 are removed by respective slitter elements 4882 and 4884. The removal of these strips produces the final-dimensioned page sheet 4890. Note that the length $L_{slit1}$ of the exemplary second trimming station 4880 is also approximately 5.0 inches in this embodiment. Gutter strips and other trimmings can be disposed of using any acceptable techniques including those described hereinabove.

Once the sheet is received by the right-angle nips 4866 in the merge assembly 4860, it is presented to the stacker 4894 in appropriate alignment. The stacker can be adjacent to the merge assembly 4860 as shown, or remote therefrom, connected by a raceway or other conveyor assembly (not shown). The sheet 4890 is driven into the stacker/stack 4894 by another orthogonal set of selectively engageable nips 4896. These nips 4896 engage shortly before the nips 4866 disengage so that the sheet is maintained in an essentially "edgeless" manner, in the grasp of the system components, free of skew and misalignment throughout the feeding, trimming and stacking process.

The absence of a backing rail or wall within the divert assembly allows sheets to be selectively driven to an alternate direct-feeding location (dashed arrow 4898), where optional supplemental stacking and/or post-production operations (not shown) can be performed on the initially trimmed sheet, or the sheet can be discarded if defective before reaching the second trimming station 4880. This increases the speed and efficiency of sheet throughput.

Figure 49:
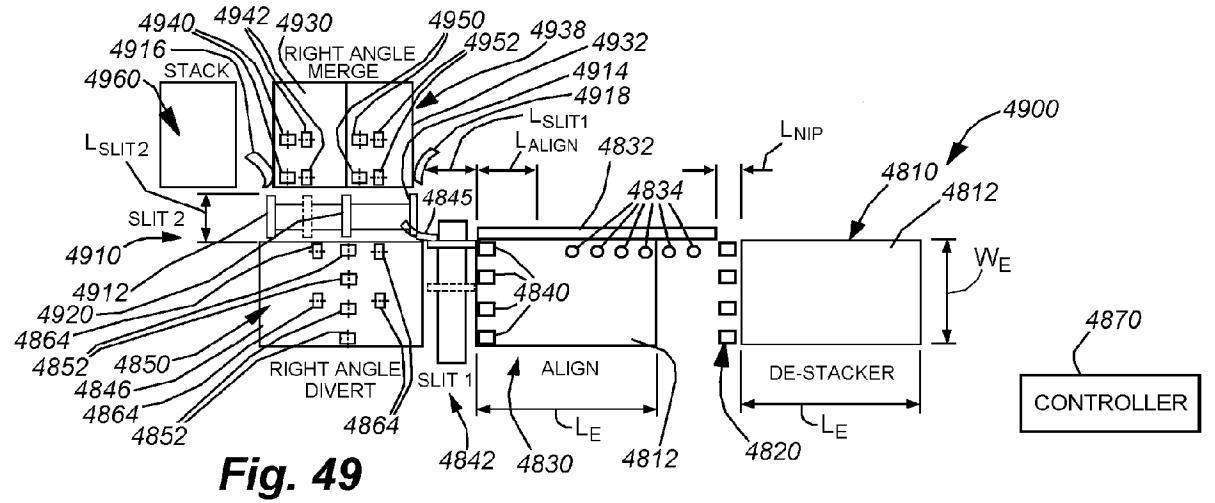
FIG. 49 is a plan view of the inline sheet feeding, cutting, rotating, slitting and stacking system of FIG. 48, arranged in a two-page configuration.

As shown in FIG. 49, the system 4800 of FIG. 48 can be provided in an arrangement 4900, which enables formation of two pages from the input sheet 4812 in a "two-up" configuration. Components that have been unchanged are provided with like reference numbers to the arrangement 4800 of FIG. 48. The sheet 4812 is initially trimmed at the first trimming station 4842 as described above. The edge-trimmed sheet 4846 is then driven into the right angle divert assembly 4850, wherein the engagement of the sheet 4846 passes from nips 4852 to right-angle nips 4864. The engaged right angle nips then drive the sheet 4852 through the second trimming station 4910, which is now provided with opposing edge-trimming slitters 4912 and 4914 that trim-off respective, opposing waste strips 4916 and 4918 of appropriate size. In addition, the second trimming station includes a centrally located slitter element (or gutter-strip-generating slitter element pair) that divides the sheet 4846 into two page sheets 4930, 4932 that are directed into the right-angle merge assembly 4938. Each page sheet 4930 and 4932 is selectively engaged by two respective orthogonal sets of rollers/nips 4940, 4942 and 4950, 4952. The nips 4942 and 4952 drive each respective sheet 4930 and 4932 into an alignment with the stacking location 4960. These nips (4942, 4952) are disengaged after right-angle nips 4940 and 4950 are engaged and thereafter drive each of the sheets 4930, 4932 in an appropriate order through the merge assembly 4938, and onto the stack (location 4960). The layout of nips 4940, 4942, 4950 and 4952 in the merge assembly 4938 is highly variable. Nips and/or other driving elements can be arranged and spaced-apart from each other so as to handle single or multiple page sheets within a given range of sizes. Alternatively, the nips can be retractable or otherwise selectively engaged and/or adjusted relative to the feed path for a given number and size of page sheets to be stacked.

Figure 50:
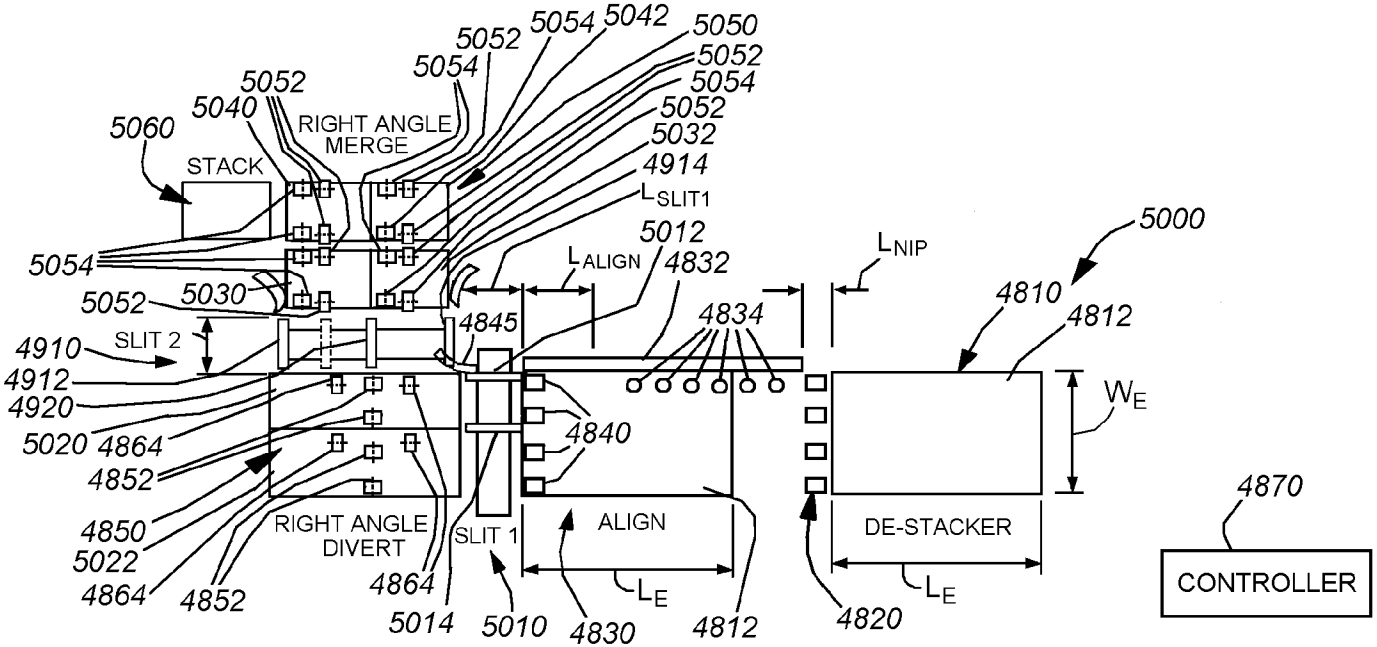
FIG. 50 is a plan view of inline sheet feeding, cutting, rotating, slitting and stacking system of FIG. 48 arranged in a four-page configuration.

As shown in FIG. 50, an arrangement 5000 of the edgeless feeding trimming, slitting, merging and stacking system of this embodiment is provided in a configuration that generates four page sheets from a single input sheet 4812. Like reference numbers to those of the arrangement 4800 of FIG. 48 are used for like components. The arrangement 5000 delivers each sheet from the alignment assembly 4830 into a first trimming station 5010. In this embodiment the trimming station 5010 includes an edge-trimming slitter element 5012 and a centralized slitter element (or gutter-strip-producing slitter element pair) 5014. The centralized slitter element 5014 divides the sheet into two half sheets 5020, 5022 that are delivered side by side to the divert assembly 4850 by the rollers 4840 and selectively engaged divert assembly rollers 4852. As described generally above, the nips/rollers are arranged so that at least two nips maintain contact points with each sheet continuously. After receipt from the trimming station 5010, the pair of sheets 5020, 5022 are driven concurrently by the right-angle nips 4864 across the divert assembly 4850, and through the second trimming station 4910, which includes the above-described slitter elements 4912, 4914 and 4920, arranged to edge-trim and divide each sheet 4850 and 4852 into a respective pair of page sheets 5030, 5032 and 5040, 5042. In this manner, the merge assembly 5050 receives the page sheets 5030, 5032, 5040, 5042 in the depicted arrangement based upon the driving of the selectively engaged nips 5052. Page sheets are thereafter directed by the selectively engaged right-angle nips 5054 into the stacking location 5060 in the appropriate stacking order. Again, the nips 5052 and 5054 are controlled so as to be selectively engagable and arranged so that each page sheet is continuously provided with at least one-to-two points of contact at all times.

It is contemplated that the embodiment of FIGS. 48-50 can be adapted to handle a larger final number of page sheets by providing additional nips to the feed path at appropriate locations as well as additional slitter element at the various trimming stations. To accommodate a larger final number of page sheets, buffering assemblies, such as divert gates (as described generally above) can be employed at various locations long the feed path.

VI. Illustrative System for Feeding, Aligning, Cutting, Rotating, Slitting, Merging and Stacking Sheets into a Book Stack FIGS. 51-59 detail various components of an operational system that operates in accordance with the principles variously described with reference to FIGS. 20-50. The system consists of a plurality of separate, portable components that are assembled to define a single integrated device that feeds, cuts, slits, rotates, merges and stacks sheets into a book of predetermined size from initial sheets of a larger size. A cutter (not shown) of conventional design can be provided in an upstream-most position to generate sheets from a continuous web that includes a plurality of printed pages, as described above. Alternatively, sheets can be provided with preprinted pages from a stack. While illustrated the location and number of various fasteners, bearing and mounting brackets is highly variable and the arrangement of such items is shown for illustrative purposes to assist the reader in visualizing a possible implementation of a functional device.

Figure 51:
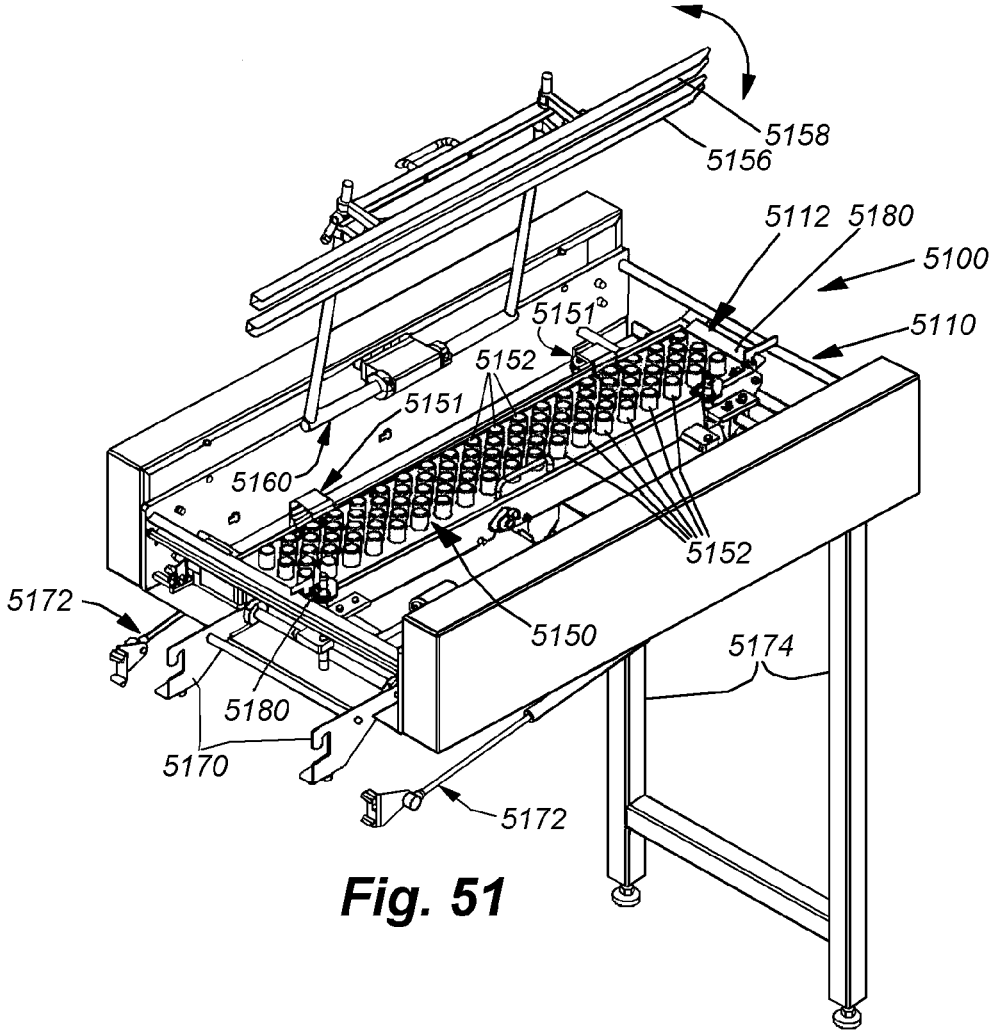
FIG. 51 is a perspective view of an alignment unit for use in an illustrative embodiment for a system for feeding, cutting, rotating, slitting and stacking that operates to rotate, slit and divert sheets generally in accordance with the principles described in the embodiments of FIGS. 20-50.
Figure 52:
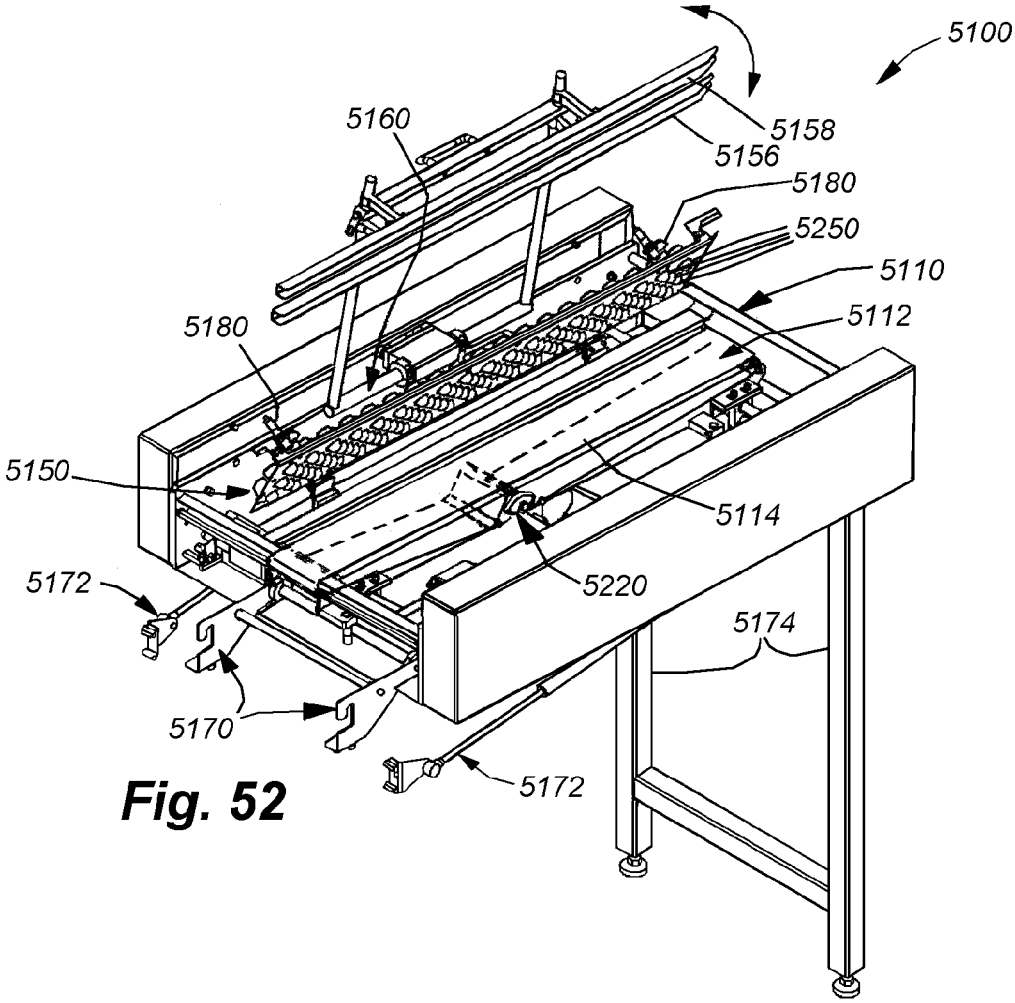
FIG. 52 is a perspective view of the alignment unit of FIG. 51 showing an idler ball assembly lifted to reveal an angled drive belt.
Figure 53:
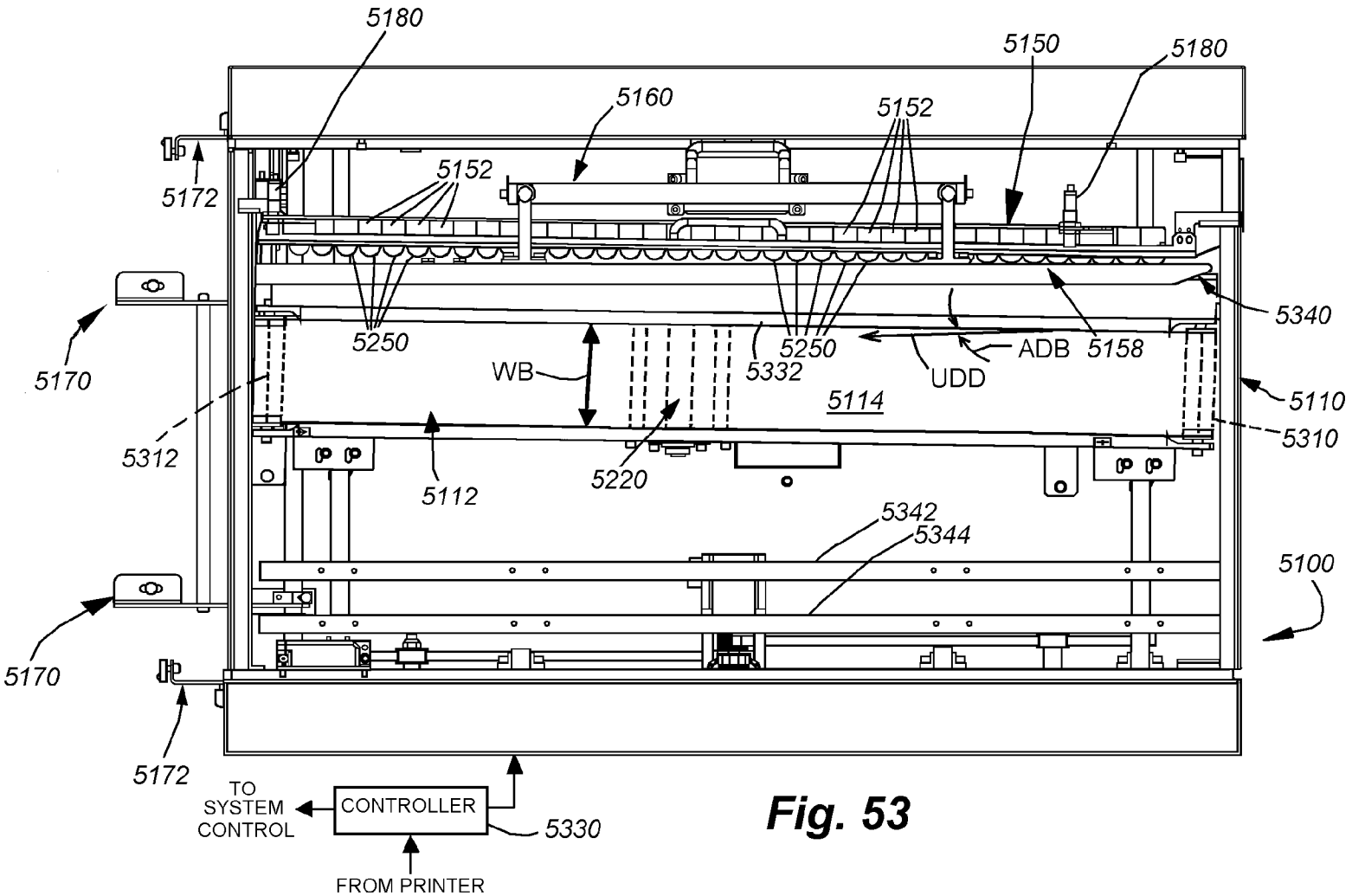
FIG. 53 is a plan view of the alignment unit of FIG. 51 with idler ball assembly lifted to reveal the angled drive belt.

As shown in FIGS. 51-53, sheets (not shown) are initially fed into the upstream (input) end 5110 of an alignment unit 5100. The alignment unit is powered by an independent drive motor (not shown) that operates a drive belt assembly 5112.

The drive belt assembly is oriented at a slight acute angle ADB, with respect to the upstream-to-downstream direction UDD. The angle ADB can be between approximately 2-5 degrees in an embodiment, but other angles are expressly contemplated. The belt 5114 is constructed from a durable elastomer, such as polyurethane. It has a width WB of between 3 and 6 inches in an embodiment. The belt 5114 is disposed between a pair of idler rollers 5310 and 5312 (FIG. 53, shown in phantom). It is driven by a drive roller assembly 5220 that bears upon the bottom interior of the belt 5114 at the mid-section thereof. The motor is driven by a controller 5330 that communicates with the printer (not shown) that provides instructions with respect to printed sheets. The controller 5330 also communicates with the controls in other downstream system components (described below). The belt provides an orthogonal biasing force that urges each sheet against an edge guide 5340 that is arranged parallel to the upstream-to-downstream direction UDD. The adjacent edge 5332 of the belt 5114 is located relatively close (within approximately 2-4 inches) with respect to the edge guide 5340 to allow for a range of sheet widths to be fed through the alignment unit. The overlying sheet portion, opposite the edge guide is supported by a pair of channel members 5342, 5344 that ensure the sheet travels along the feed path without binding.

The sheets are biased against the belt 5114 by an idler ball assembly 5150 that overlies the belt (as shown in FIG. 51). The assembly 5150 can be hinged into and out of an overlying position (the closed state being shown in FIG. 51 and the open state being shown in FIGS. 52 and 53) via a hinge assembly 5151 to allow the unit to be serviced and jams to be cleared. The idler ball assembly 5150 defines a plate that includes a plurality of cylindrical housings 5152. The housings each contain a freely rotating polymeric ball 5250 that applies a weight to the sheet to maintain it in frictional contact with the belt. The balls 5250 rotate in all directions to accommodate both the downstream and orthogonal components of sheet movement as they are justified against the edge guide 5340.

The unit 5100 also includes a pair of hinged bars 5156, 5158, mounted on a hinge assembly 5160. These bars 5156, 5158 respectively overly the guide bars 5342, 5344 and provide a limited gap that prevents sheets from binding as they travel downstream.

The unit 5100 includes a pair of brackets 5170 that removably attach to a downstream unit (the slitter and rotator as described below, for example). A pair of gas spring assemblies 5172 allows the unit to be hinged downwardly, when the upstream legs 5174 are folded away. This movability enables servicing of adjacent units.

While not shown, a variety of movable transparent, translucent and/or opaque covers can be used to shield the mechanism of this unit and others described below from the outside environment.

The belt assembly 5112 drives the sheets at a predetermined feed speed (for example, approximately 70 inches per second). The unit 5100 can include edge sensors 5180 that track sheet motion for feeding purposes and to detect possible jams. The signals from the sensors can be compared by the controller to the predicted location of sheets based upon the detected motion of the unit drive motor (using servo or stepper motor feedback for example) and signals from the printer.

Figure 54:
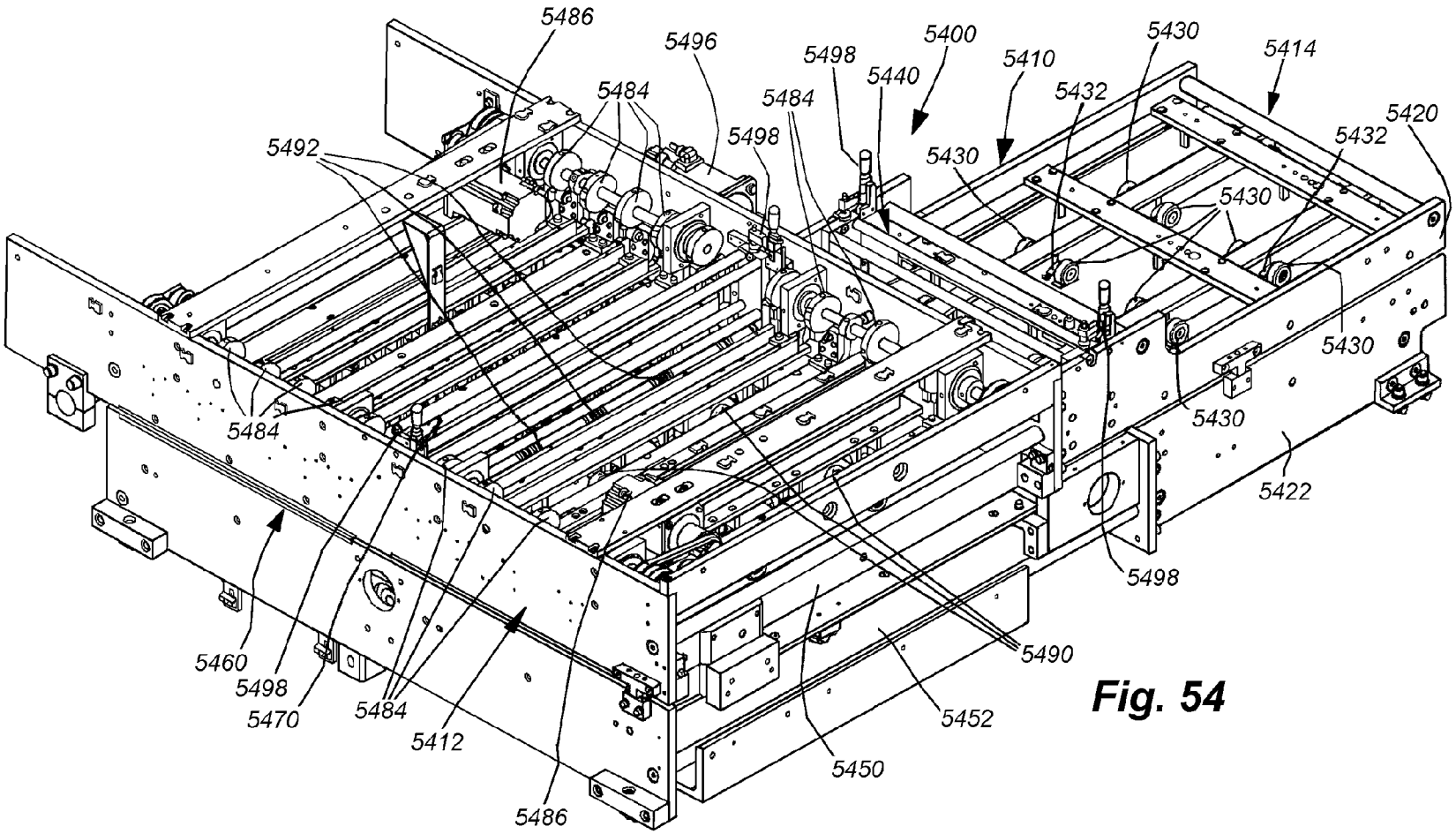
FIG. 54 is a perspective view of a slitting and rotating unit that receives sheets from the alignment unit of FIG. 51.
Figure 55:
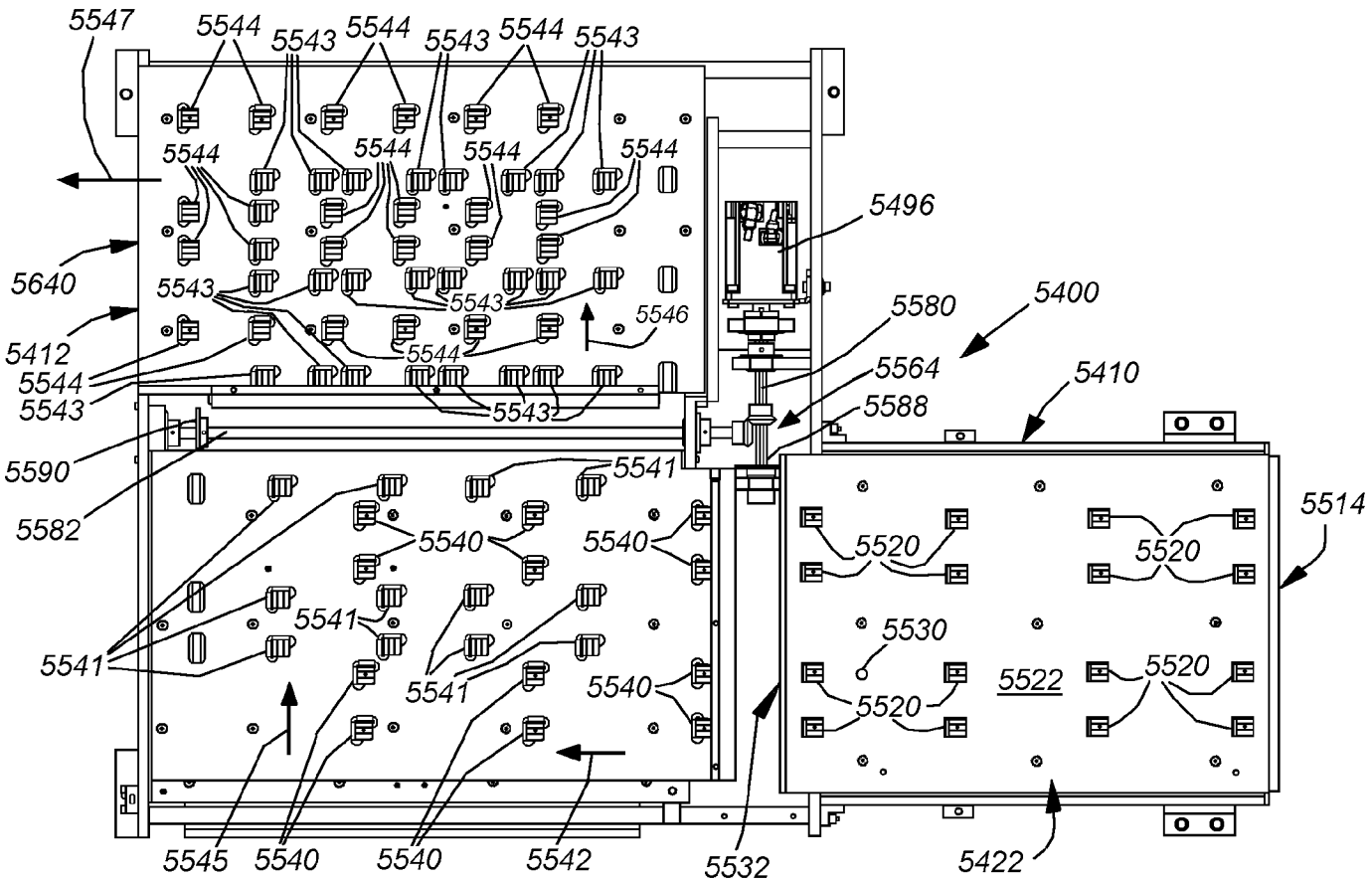
FIG. 55 is a plan view of the arrangement of drive rollers in each of two orthogonal orientation on a feed surface of the slitting and rotating unit of FIG. 54.
Figure 56:
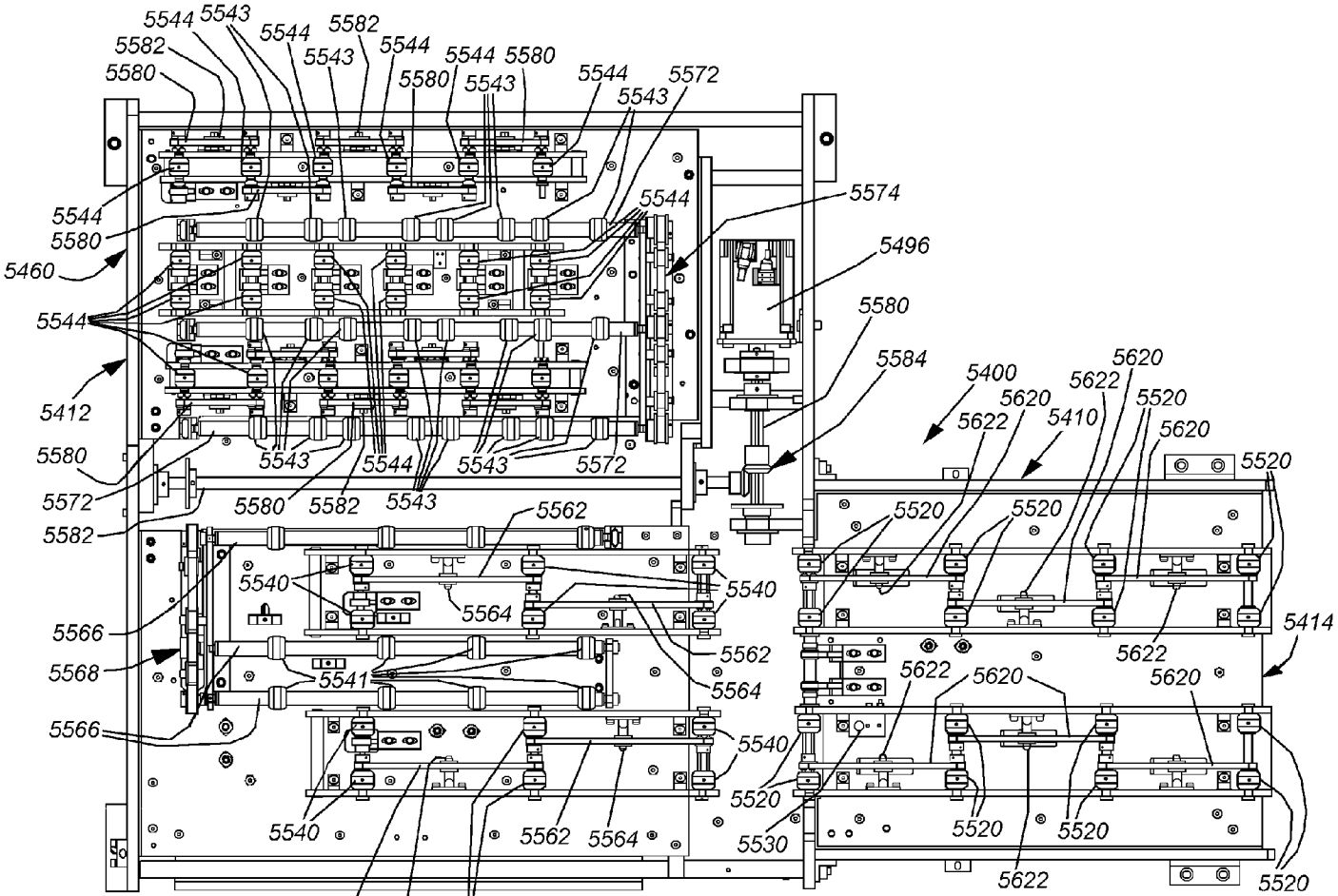
FIG. 56 is a plan view of the slitting and rotating unit of FIG. 56 with feed surface removed to detail the interconnection between various drive rollers.

With reference now to FIGS. 54-56, the alignment unit 5100 directs sheets downstream into the slitter and rotator unit 5400 according to the illustrative embodiment. The unit 5400 consists of a feed section 5410 and a right-angle turn section (also termed a "rotator") 5412. The feed section 5410 includes an upstream (input) end 5414 that receives sheets from the downstream (output) end of the alignment unit 5100. The feed section 5410 includes upper and lower portions 5420, 5422, respectively. The lower portion 5422 contains an arrangement of elastomeric drive rollers 5520 that protrude through a feed surface 5522. The rollers form nips with overlying idler rollers 5430 in the top portion 5420. These rollers are mounted on bearing shafts that are biased against the drive rollers 5520 by a surrounding tension spring 5432. The spring is secured, under tension on opposing sides of the shaft, and forces the shaft downwardly due to the tension bearing against the shaft. The various idler rollers employed in this unit are biased by such a spring arrangement. The rollers are arranged in pairs that are spaced across the width (orthogonal to the downstream direction) approximately 3-5 inches. This spacing allows at least two rollers to maintain in contact with a sheet at all times so sheets are free of skew as they are driven downstream. Wider sheets are engaged by more than two rollers across the width. One or more edge sensors 5530 are provided near the output side 5532 of the feed section 5410. These sensors detect jams and presence of sheets at a predetermined location along the feed section.

As shown further in FIG. 56, the rollers 5520 are driven by interconnected timing belts 5620 that are tensioned using intermediate idler assemblies 5622. A central motor (not shown) drives the belt arrangements. This motor can be implemented as a servo or stepper motor for accurate drive control. The motor receives instructions from the controller.

Each sheet is driven from the feed section 5410 at a predetermined time, as described generally above into a first slitter station 5440 (FIG. 54). The slitters are implemented as rotating (overlapping) circular shears in an illustrative embodiment. The slitter shears are mounted at predetermined locations along the width so as to slit the input sheet into at least two side-by-side sheets as described above. The sheets can also be edge trimmed and a center strip can be removed where appropriate (as described above). The trimmings can be directed downwardly by an appropriate deflector into a waste bin (as also described above).

Sheets fed from the feed section 5410 enter the right-angle turn (rotator) section 5412, which also includes a bottom portion 5450 and a top portion 5452. The bottom portion, as further detailed in FIGS. 55 and 56, includes rollers 5540, 5541, 5543 and 5544. The rollers 5540 are located directly downstream from the feed section 5410 and first slitter station 5440 and are arranged to drive sheets in the direction of arrow 5542. The rollers 5541 are located adjacent to the rollers 5540, and are oriented to drive sheets in an orthogonal (perpendicular) direction as detailed by arrow 5545. Sheets pass through a second slitter station 5470 when driven by the rollers 5541 in the direction 5545. The slit sheets are received by the rollers 5543, which continue to drive them along the direction of arrow 5546. The sheets are stopped, and then driven in an orthogonal (perpendicular direction) to the output end 5460, which is defined by a slot (See FIG. 54) between the top and bottom portions 5450, 5452.

With reference to FIG. 56, the rollers are driven by an arrangement of connected shafts, belts and idlers. The rollers 5540 are arranged in pairs, and are linked together by a set of belts 5562 and idlers 5564. The rollers 5541 are mounted on each of three common shafts 5566. The shafts are mechanically linked by a belt and pulley assembly 5568. The rollers 5540 are driven by a servo drive motor (not shown) under control of the controller. The rollers 5541 are, likewise, driven by another servo drive motor (not shown) under control of the controller.

The rollers 5543 are also provided on each of three common shafts 5572 that are mechanically linked by a belt and pulley assembly 5574. The shafts are also driven by a separate, servo drive motor (not shown) that is controlled by the controller. Finally, a series of belts 5580 and idlers 5582 interconnects the rollers 5544. A separate servo drive motor (not shown) drives this set of rollers under control of the controller. These mechanical interconnections between rollers allow all rollers in each discrete set to move simultaneously as a respective drive motor rotates them.

Note that the number of side-by-side rollers (across the width) in each downstream section increases to accommodate an increasing number of side-by-side, slit sheets of predetermined size. The rollers are arranged to provide a maximum eight-up feed pattern in this embodiment. A larger or smaller maximum can be provided by changing the total number of rollers. By way of example, a full size sheet is initially slit by the first slitter station 5440 into a pair of side-by side sheets as the rollers 5220 pass the sheet onto rollers 5540. The orthogonal rollers 5541 then pass each sheet through the second slitter station 5470 where (by way of example) up to four slitter shears divide each sheet into four side-by-side sheets that are received by the rollers 5543. The sheets are then directed orthogonally through the output 5460 in turn as described above.

To allow each set of orthogonal rollers to selectively engage the sheets, a cam set is employed. The cams selectively raise and lower frames that support confronting idler rollers. As shown in FIG. 54, a line of cams 5484 on each of opposing sides of the slitter section 5412 rotates to selectively lower the idlers 5490 and 5492 in each of opposing, orthogonal directions. In general, the idlers are contained on vertically movable frames that are spring-loaded to remain in a disengaged position until an eccentric surface on the cam interacts with the frames to case them to lower into engagement with the drive rollers, thereby forming a drive nip in the desired drive direction. Discrete servo motors 5486 on each side of the rotator section 5412 drive the cams via belts through a predetermined rotational arc at an appropriate time, in conjunction with rotation of the associated drive rollers. In this manner sheets are grasped and driven in the appropriate direction. Notably, the cams are shaped and arranged so that one set releases only slightly after another set is engaged. This ensures that sheets remain continually grasped by at least one pair of rollers at all times (thereby avoiding misalignment). Likewise, the drive rollers are powered to rotate only after the associated nip is formed with confronting idlers. The cam assemblies can include a projecting pin or other structure (not shown) that senses proximity and ensures that the cams return to an appropriate origin after a predetermined cam rotation cycle.

As shown, the shear wheels are powered by a motor 5496 that transmits power to each slitter station. A bevel gear arrangement 5584 powers drive shafts with drive gears 5588 and 5590. These gears engage associated gears in the frameworks of each slitter station, thereby rotating the shear wheels. The slitter stations are provided as removable cartridges with associated hold-downs. A variety of alternate attachment and/or locking mechanisms can be employed. The slitter stations are removable to allow wheels to be added, removed or adjusted. This increases the versatility of the unit, by allowing the size of sheets to be changed, by changing the placement and number of slitter wheels. The wheels can be supported on brackets as described above. The brackets are movable along rails in the cartridge frame, and can be selectively locked in an appropriate widthwise position. In an alternate embodiment, shear wheels can be adjusted automatically using, for example a lead screw mechanism that rotates to position one or more shear wheels at a desired location based upon an input instruction from the user.

In an illustrative embodiment, the slitter and rotator section drives output sheets at an increased drive speed with respect to the input speed to ensure sheets are properly removed for stacking In an example, the drives operate at a speed of approximately 140 inches per second.

Figure 57:
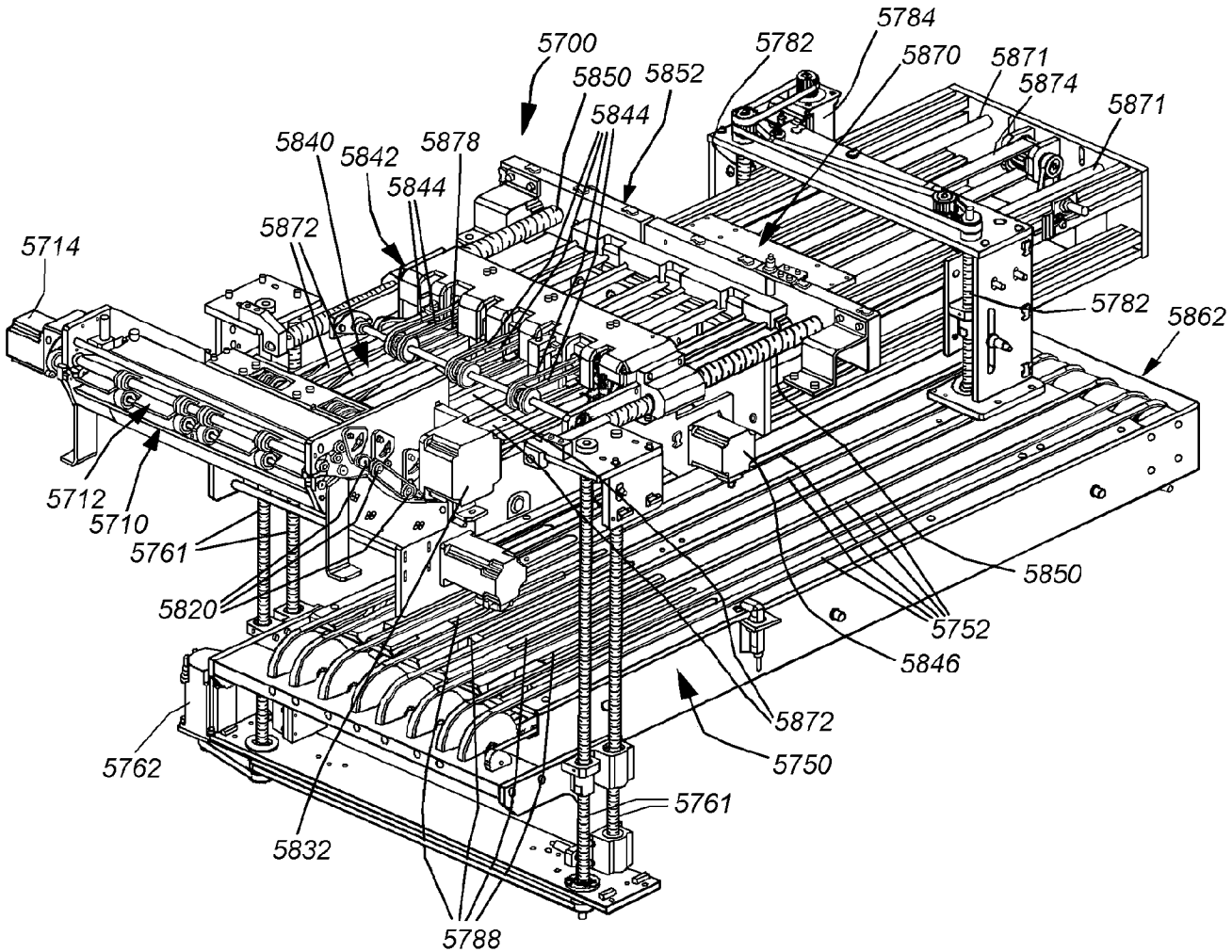
FIG. 57 is a perspective view of a divert gate assembly and stacking unit that receives sheets from the slitting and rotating unit of FIG. 54.
Figure 58:
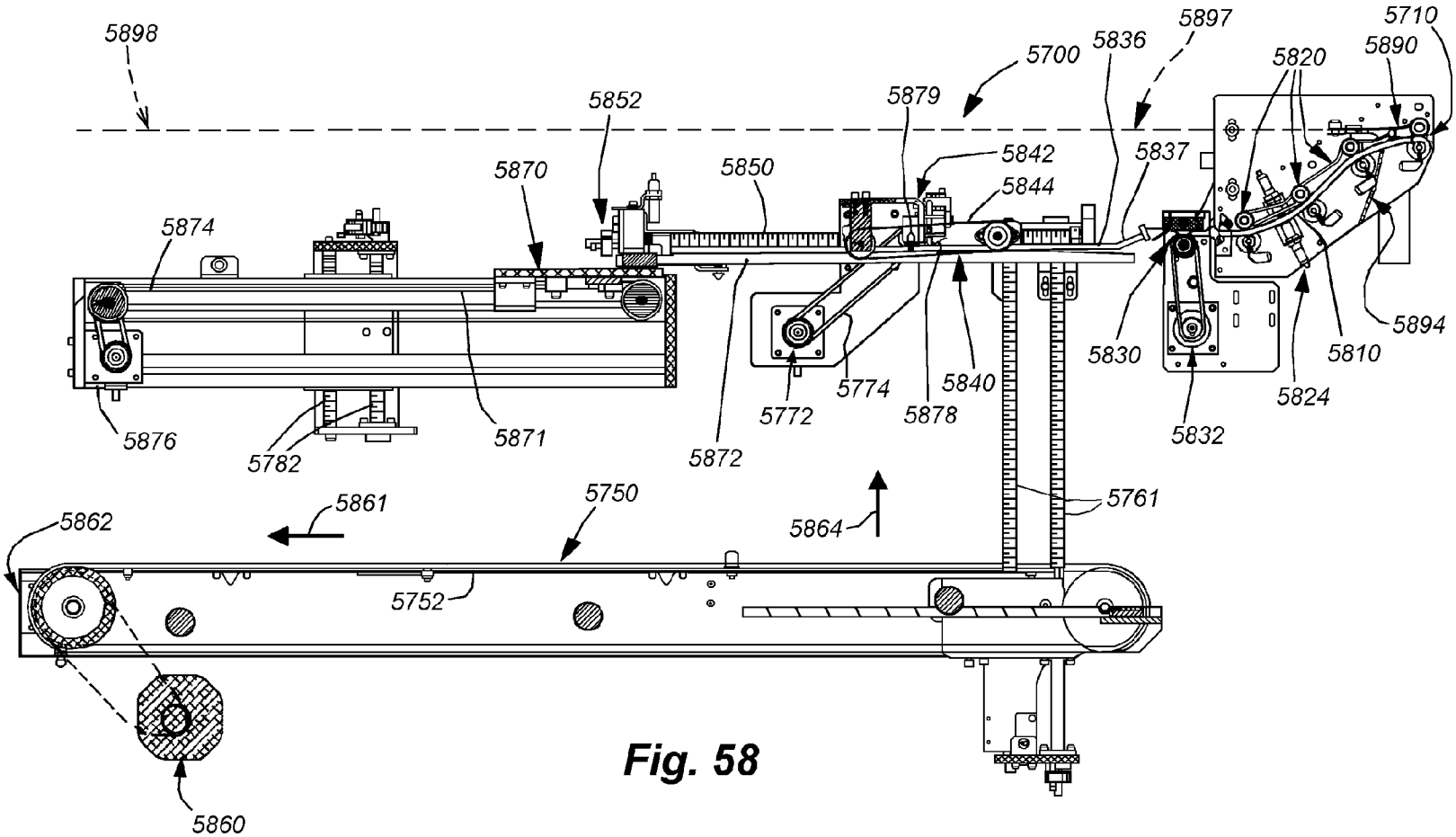
FIG. 58 is a side view of the divert gate assembly and stacking unit of FIG. 57.
Figure 59:
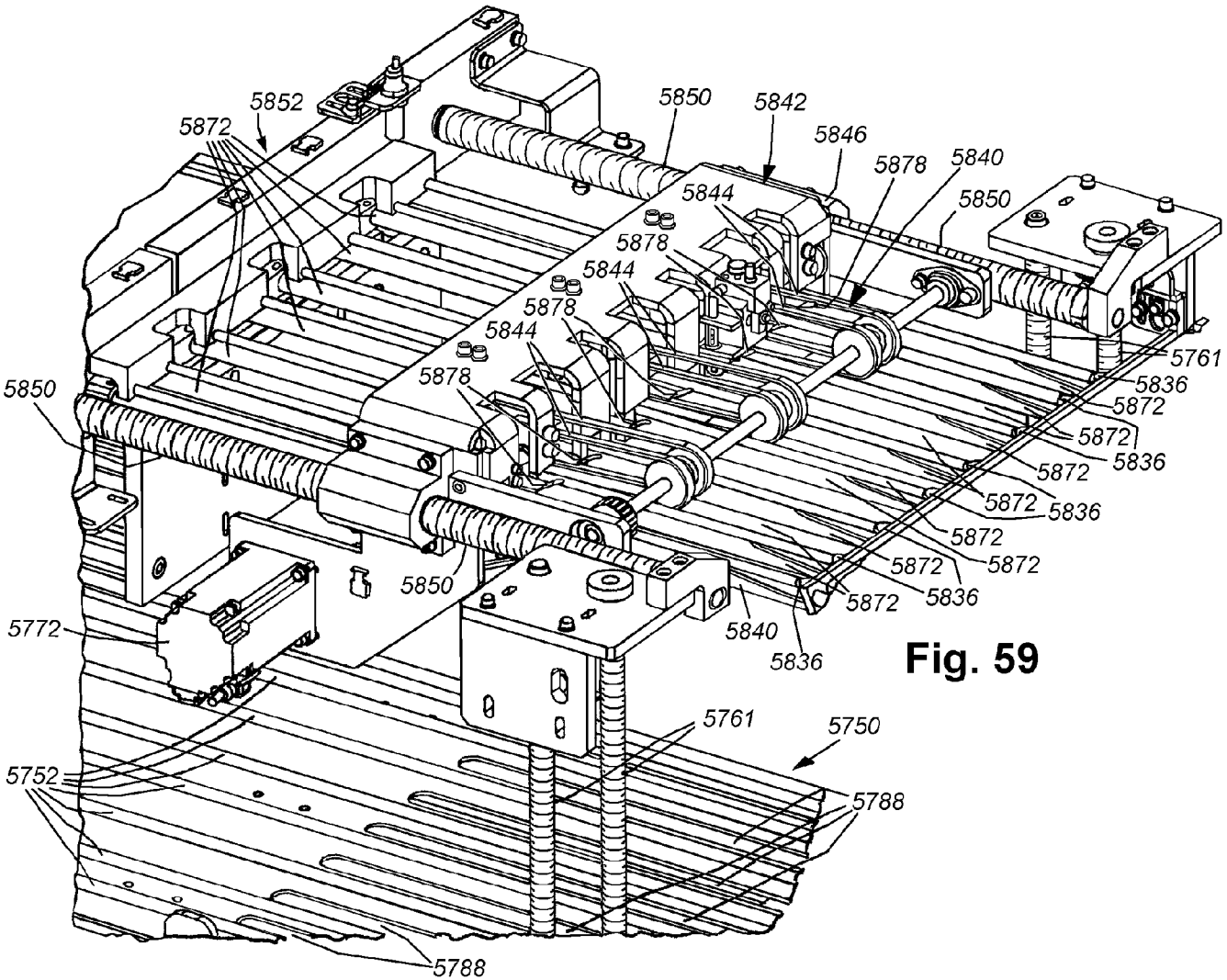
FIG. 59 is a more-detailed, fragmentary perspective view of the stack formation area and adjacent mechanisms of the stacking unit of FIG. 57.

With reference now to FIGS. 57-59, the rotator section outputs a series of slit sheets into the stacker unit 5700 through an input 5710. Various covers and outer frame members that support the stacker 5700 have been omitted in these views to assist the reader in understanding the functional components of the device. Similar to the alignment unit and slitter and rotator unit, it should be assumed that a frame (typically adapted to be portable) encloses and supports the various components of the stacker and can include movable panels and/or doors that allow the interior thereof to be accessed for service and maintenance. The interior can house a localized controller and other power-handling components, such as conventional power supplies, servo controls, relays and the like (not shown).

The input 5710 drives sheets through input rollers 5712. It is powered by a servo motor 5714. The input rollers lead down a curved chute 5810 that includes downstream nip roller assemblies 5820 interconnected by belts. An edge sensor 5824 in communication with the controller detects the arrival and departure of each sheet passing down the chute 5810. The sheets are directed into a downstream drive nip 5830 with a separate servo driving motor 5832. The motor 5832 operates to pass sheets into the stack formation area (stacking location) 5840 at a predetermined rate that typically decelerates. By decelerating the sheets, they engage the backstop assembly 5842 at a non-damaging velocity. A set of retaining rails 5836 with upturned ends 5839 at their input sides guide the sheets from the output 5830 to the stacking location 5840. These rails prevent the sheets from billowing up out of the stack and provide selective compression to the stack as it is formed. The backstop assembly includes a set of feed belts 5844 that reside between rails 5836, driven by a motor 5846, that bring the sheets to rest against the backstop as they enter the stacking area 5840. The backstop assembly is adjustable for differing-length sheets automatically based upon rotation of a powered lead screw assembly 5850. The lead screws rotate under power of a motor and belt assembly 5852 to move the framework that supports the backstop assembly 5842 forwardly and rearwardly with respect to the input 5710 of the stacker 5700.

In operation, sheets are stacked onto an elevator assembly 5750 that includes a set of drive belts 5752 powered by a servo motor 5860. The belts operate when the elevator is in a downward-most position as shown in FIG. 58, to move completed book stacks downstream (arrow 5861) to a stack output location 5862, a wide variety of manual and/or automated stack handling components can be placed at the output to receive completed stacks, including, but not limited to, carts, binding devices, further conveyors, flippers, and the like. The elevator assembly 5750 moves upwardly (arrow 5864) into engagement with the stacking area 5840 based upon lead screws 5761 that are driven by a servo motor assembly 5762. When the elevator assembly 5750 is adjacent to the stacking location, it slowly descends under operation of the elevator lead screws 5761 as the stack receives new sheets and grows taller. When a stack is completed, the elevator is moved downwardly to a lowered (typically bottom-most) position that clears the stacking location 5840, and also allows for transfer of the stack to a downstream component.

Notably, as a stack is completed, a carriage assembly 5870 (on a sliding rail assembly 5871) with a set of upstream-directed temporary support fingers 5872 is moved by a drive belt 5874 and motor 5876 into the stacking location 5840 to, essentially, "catch" the next sheets delivered by the feed 5830 after completion of the previous stack. This allows time for the new stack to begin forming while the previous stack is driven out of the stacker 5700 via the output 5862. The back-stop supports a set of deployable compression fingers 5878 that protrude beneath the rails 5872. These are deployed at appropriate times so as to maintain the stack in a compressed state. For example, the fingers are deployed as the stack before the completed stack is moved downwardly by the elevator. The fingers are selectively rotated into and out of a deployed position by a common shaft 5879 that interconnects to a belt 5774 and servo motor 5772. A variety of alternate actuation mechanisms are expressly contemplated. The finger carriage assembly 5870, rail assembly 5871 and associated drive components are mounted on a short (2-5 inches of vertical motion) set of vertical lead screws 5782, powered by a servo motor 5784. These screws 5782 drive the carriage 5870 and associated fingers 5872 vertically from an upper-most position (as shown in FIG. 58) when the new stack is first formed, to a predetermined lower position as the new stack continues growing and requires further height-clearance. When the elevator 5750 has off-loaded the old stack, it rises vertically until the fingers 5872 pass through aligned slots 5788 in the elevator's top surface. This allows the elevator to "take-over" support of the new stack, and the carriage can then withdraw the fingers 5872 until the new stack is completed. The fingers are raised to an upper-most position prior to the completion of the new stack so they are ready to intervene again.

The generalized feed pattern and sequence of events undertaken by the elevators and fingers in the formation of successive stacks for the stacker 5700 is approximately similar to that described in U.S. Pat. No. 7,402,130, entitled SYSTEM AND METHOD FOR FOLDING AND HANDLING STACKS OF CONTINUOUS WEB, the teachings of which are expressly incorporated herein by reference as useful background information.

With further reference to FIG. 58, the input 5710 is constructed and arranged to enable diversion of sheets to a plurality of destinations as described generally above. A divert gate assembly 5890 of conventional design allows for three options. The first option, as described above, allows sheets to descend down the chute 5810 to be deposited in a book stack on the elevator's top supporting surface (or temporary support fingers). Another option allows sheets to be directed downwardly against a guide plate 5894 toward a waste bin or other disposal device (not shown) positioned beneath the chute. This option is desirable where the printer or other system component (e.g. a sheet inspection vision system) determines that a particular sheet or group of sheets is either defective or unneeded. In such instances, the divert gate is actuated to direct the sheet(s) to the waste bin. A third option allows the sheets to travel across the stacker without being stacked or disposed of, along an upper path 5897 shown in phantom) to the output side 5898. While not shown for clarity, the upper path can be implemented using a straight or acutely-angled (for alignment) belt and plurality of weighted balls similar to those implemented with respect to the sheet transport of the alignment unit. The belt and weights are located to support a stream of potentially narrower sheets than those initially presented to the alignment unit, since sheets are typically slit at least once by the first slitter station, rendering them at least half as wide. However the transport can have surfaces capable of supporting wider sheets that may have been only edge trimmed and left unslit—or completely untouched by the first slitter station.

It should be clear that the above-described automated aligning, trimming, slitting, rotating, cross-slitting and stacking system according to the various embodiments described herein provides a high-speed, versatile solution in the handling of single and multi-page sheets. The system, in a variety of arrangements, allows formation of finished book blocks/stacks from either a feed of conveyed sheets or from a de-stackable stack of printed sheets. Through the use of various automated divert gates, a large number of individual pages separated from each discrete, handled sheet. The placement of actuatable nip rollers along the feed path allows for handling of a wide range of sheet sizes. Likewise, the setup of system components, such as slitter elements can be automated to allow separation of a wide range of sizes from a variety of differing-dimensioned input sheets.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the system controllers described herein can be integrated with controllers in upstream and downstream processing units (for example, the printer controller can be used to issue control and tracking signals to the system using an appropriate protocol). Likewise, the sizes of sheets, size and/or number of pages created and handled, and/or the throughput rate are all highly variable. Also, while the selectively actuable drive elements are shown and described as nip rollers, it is expressly contemplated that other forms of actuable drives can be employed including, but not limited to, belts of various lengths, rotating disks and shuttle arrangements. Likewise, while one rotator section and two separate trimming stations are employed (on either side of the rotator), one trimming station for each orientation, it is expressly contemplated that additional trimming stations can be employed to accommodate sheets in the same or a different rotational orientation along the feed path. Likewise, a plurality of rotators can be employed, allowing for additional non-90-degree rotation of sheets and corresponding angled slitting operations to occur. In addition, the controllers and control functions for various system components (e.g. roller driving/actuation, rotation, divert gate operation, stacking, de-stacking, etc.) can be implemented using electronic hardware, software or a combination of hardware and software. Accordingly, this description is meant to be taken only by way of example, and not to otherwise limit the scope of this invention.

What is claimed is:

1. A system for handling sheets provided by an upstream source, each of the sheets defining at least one book page thereon, comprising:

a drive that directs each of the sheets along a feed path in a downstream direction from the source, the drive including selectively actuable drive elements that engage each of the sheets to drive, disengage each of the sheets to allow non-interference therewith, at predetermined times;

at least one trimming station constructed and arranged to trim at least one edge margin strip from each of the sheets at a downstream location from the source;

a rotator that selectively engages each of the sheets in a first orientation and that rotates each of the sheets into an orthogonal, second orientation when the drive elements are disengaged; and a stacker assembly, that receives each of the page-sized sheets and that stacks each of the page-sized sheets in a predetermined page order;

wherein the rotator comprises a first plurality of drive rollers arranged to drive the sheets in a first direction and a second plurality of rollers arranged to drive the sheets in a second orthogonal direction, each of the first plurality of drive rollers and each of the second plurality of drive rollers including first selectively actuable idlers and second selective actuable idlers, respectively, that form a drive nip so as to drive the sheets selectively in either the first orientation or the second orthogonal orientation.

2. The system as set forth in claim 1 wherein the at least one trimming station is disposed upstream of the rotator, and further including a second trimming station that receives each of the sheets from the rotator, the second trimming station constructed and arranged to trim at least one orthogonal margin strip for each of the sheets so as to form approximately page-sized sheets.

3. The system as set forth in claim 2 wherein the second trimming station includes a pair or outer slitter elements that each respectively trim each of a pair or opposing margin strips from opposing outer edges of each of the sheets.

4. The system as set forth in claim 3 wherein the second trimming station includes at least one central slitter assembly constructed and arranged to separate each of the sheets along an upstream-to-downstream oriented separation line into at least two widthwise-side-by-side, page-sized sheets.

5. The system as set forth in claim 4 wherein the at least one central slitter assembly includes a pair of confronting slitter elements constructed and arranged to cut a gutter strip between each of the page-sized sheets, and further comprising a vacuum port that draws away at least one of the margin strips and the gutter strip.

6. The system as set forth in claim 5 further comprising a vacuum port that draws away at least one of the margin strips and the gutter strip.

7. The system as set forth in claim 1 further comprising an alignment unit, upstream of the drive that includes a drive belt that is angled so as to bias each of the sheets against an edge guide parallel to the downstream direction.

8. The system as set forth in claim 1 wherein the first selectively actuable idlers are mounted on a first frame interconnected with a first set of rotating cams that selectively move the first selectively actuable idlers into and out of engagement with the first plurality of drive rollers and the second selectively actuable idlers are mounted on a second frame interconnected with a second set of rotating cams that selectively move the second selectively actuable idlers into and out of engagement with the second plurality of drive roller.

9. The system as set forth in claim 1 wherein the at least one trimming station includes a first trimming station that includes a pair or outer slitter elements that each respectively trim each of a pair or opposing margin strips from opposing outer edges of each of the sheets.

10. The system as set forth in claim 9 wherein the first trimming station includes at least one central slitter assembly constructed and arranged to separate each of the sheets along an upstream-to-downstream oriented separation line into at least two widthwise-side-by-side sheets.

11. The system as set forth in claim 10 further comprising a vacuum port that draws away at least one of the margin strips and the gutter strip.

12. The system as set forth in claim 1 wherein the stacker includes a divert gate that selectively moves each of the sheets to one of a stacking location, a stacker bypass path and a waste location.

13. The system as set forth in claim 1 wherein the stacker includes an elevator that moves vertically to allow a stack of the sheets to grow thereon and that, in a vertically lowered position, is constructed and arranged to move each stack, when complete, to an output location.

14. The system as set forth in claim 13 wherein the stacker further includes temporary support fingers that temporarily engage and support a new stack as the elevator moves to the lowered position to output the complete stack.

15. The system as set forth in claim 1 further comprising a right-angle merge assembly that transfers each of the page-sized sheets from either of the trimming stations in the predetermined page order to the stacker assembly.

16. The system as set forth in claim 15 wherein the right-angle merge assembly includes a plurality of selectively engaged sets of drive nips, each of the sets being oriented to drive at a different angle, and one of the sets of drive nips being constructed and arranged to selectively drive sheets to a position that generates an offsets with respect to other sheets driven by the one of the sets of drive nips.

17. The system as set forth in claim 16 wherein the right-angle merge assembly includes a plurality of selectively engaged sets of drive nips, each of the sets being oriented to drive at a different angle, and one of the sets of drive nips being constructed and arranged to selectively drive sheets from the trim station in a direct path, free of right-angle driving, to an alternate sheet location for alternate handling thereof.

18. The system as set forth in claim 15 wherein the wherein the right-angle merge assembly includes a plurality of decks and a divert gate constructed and arranged to selectively direct each of the page-sized sheets to a respective of the plurality of decks based upon the predetermined page order, each of the decks selectively directing each of the page-sized sheets to the stacker assembly at a predetermined time based upon the predetermined page order.

19. The system as set forth in claim 1 wherein the sheets include indicia and further comprising an ID reader that reads the indicia so as to allow tracking of each of the sheets.

20. The system as set forth in claim 19 wherein the indicia are located with respect to at least one of edge margins and gutter sections.

* * * * *